US012378858B2

(12) United States Patent
Steele et al.

(10) Patent No.: US 12,378,858 B2
(45) Date of Patent: Aug. 5, 2025

(54) PRESSURE INDICATION ALIGNMENT USING AN ORIENTATION PORT AND AN ORIENTATION SLOT IN A WEIGHTED SWIVEL

(71) Applicant: Halliburton Energy Services, Inc., Houston, TX (US)

(72) Inventors: David Joe Steele, Carrollton, TX (US); Eulalio De Jesus Rosas Fermin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/661,380

(22) Filed: May 10, 2024

(65) Prior Publication Data

US 2024/0295165 A1 Sep. 5, 2024

Related U.S. Application Data

(63) Continuation of application No. 17/855,399, filed on Jun. 30, 2022, now Pat. No. 12,000,250.

(60) Provisional application No. 63/217,786, filed on Jul. 2, 2021.

(51) Int. Cl.

| | |
|---|---|
| ***E21B 43/14*** | (2006.01) |
| ***E21B 41/00*** | (2006.01) |
| ***E21B 43/26*** | (2006.01) |

(52) U.S. Cl.

CPC ..... *E21B 43/14* (2013.01); *E21B 43/26* (2013.01); *E21B 41/0035* (2013.01)

(58) Field of Classification Search

CPC ..... E21B 43/14; E21B 43/26; E21B 41/0035

See application file for complete search history.

(56) References Cited

U.S. PATENT DOCUMENTS

| | | | |
|---|---|---|---|
| 5,259,468 | A | 11/1993 | Warren et al. |
| 6,209,635 | B1 | 4/2001 | Gotlib et al. |
| 7,234,543 | B2 | 6/2007 | Schaaf |
| 8,534,379 | B2 | 9/2013 | Giroux et al. |
| 9,500,031 | B2 | 11/2016 | Coull et al. |
| 9,874,062 | B2 | 1/2018 | Lajesic et al. |
| 10,174,605 | B2 | 1/2019 | Cune et al. |
| 10,683,740 | B2 | 6/2020 | Randall et al. |
| 10,954,769 | B2 | 3/2021 | Randall et al. |
| 2002/0003040 | A1 | 1/2002 | Brunet |
| 2002/0046841 | A1 | 4/2002 | Shu et al. |

(Continued)

FOREIGN PATENT DOCUMENTS

| | | | |
|---|---|---|---|
| WO | 2011011306 | A1 | 1/2011 |
| WO | 2014080178 | A2 | 5/2014 |
| WO | 2016066713 | A1 | 5/2016 |

*Primary Examiner* — Aaron L Lembo

(74) *Attorney, Agent, or Firm* — Scott Richardson; Parker Justiss, P.C.

(57) ABSTRACT

Provided is an inner string and a well system. The inner string, in one aspect, includes an inner tubular including a sidewall having a thickness ($t_3$), the inner tubular having an orientation port extending entirely through the sidewall to provide fluid access from an interior of the inner tubular to an exterior of the inner tubular. The inner string, according to one aspect, further includes a weighted swivel located around the inner tubular, the weighted swivel including an orientation slot, the orientation slot configured to align with the orientation port to provide a pressure reading indicative of a relative location of the inner tubular to the weighted swivel.

40 Claims, 59 Drawing Sheets

(56) References Cited

U.S. PATENT DOCUMENTS

| | | | |
|---|---|---|---|
| 2003/0047702 | A1 | 3/2003 | Gunnarsson et al. |
| 2004/0035578 | A1 | 2/2004 | Ross et al. |
| 2012/0048562 | A1 | 3/2012 | Zimmerman et al. |
| 2012/0103594 | A1 | 5/2012 | Hall et al. |
| 2014/0251627 | A1 | 9/2014 | Holderman et al. |
| 2015/0159469 | A1 | 6/2015 | Purkis et al. |
| 2015/0218938 | A1 | 8/2015 | Weisbeck et al. |
| 2016/0333666 | A1 | 11/2016 | McGlothen |
| 2017/0275966 | A1 | 9/2017 | Flores |
| 2018/0023370 | A1 | 1/2018 | Silva |
| 2018/0156011 | A1 | 6/2018 | Eidem |
| 2018/0187519 | A1 | 7/2018 | Rodriguez et al. |
| 2018/0347311 | A1 | 12/2018 | Coffin et al. |
| 2020/0056436 | A1 | 2/2020 | Roseman et al. |
| 2020/0284118 | A1 | 9/2020 | Xiao |
| 2022/0049560 | A1 | 2/2022 | Liagov et al. |

550
355
510
260
$x_3$
350
270
210
280
345
310
225
220
340
320
330

500

550
355
510
$x_3$
350
260
270
210
280
345
340
320
225
220
310
330

500

550
355
510
$x_4$
260
350
270
210
280
345
340
320
310
225
220
330

500

550
355
510
260
$x_4$
350
270
210
280
345
310
340
320
520
225
220
330

500

550
355
510
$x_4$
260
350
270
210
280
345
310
320
340
220
225
520
330

500

PRESSURE INDICATION ALIGNMENT USING AN ORIENTATION PORT AND AN ORIENTATION SLOT IN A WEIGHTED SWIVEL

CROSS-REFERENCE TO RELATED APPLICATION

This application is a continuation of U.S. application Ser. No. 17/855,399, filed on Jun. 30, 2022, entitled "PRESSURE INDICATION ALIGNMENT USING AN ORIENTATION PORT AND AN ORIENTATION SLOT IN A WEIGHTED SWIVEL," which claims the benefit of U.S. Provisional Application Ser. No. 63/217,786, filed on Jul. 2, 2021, entitled "PRESSURE INDICATION ALIGNMENT," commonly assigned with this application and incorporated herein by reference in their entirety.

BACKGROUND

A variety of borehole operations require selective access to specific areas of the wellbore. One such selective borehole operation is horizontal multistage hydraulic stimulation, as well as multistage hydraulic fracturing ("frac" or "fracking"). In multilateral wells, the multistage stimulation treatments are performed inside multiple lateral wellbores. Efficient access to all lateral wellbores is critical to complete a successful pressure stimulation treatment, as well as is critical to selectively enter the multiple lateral wellbores with other downhole devices.

BRIEF DESCRIPTION

Reference is now made to the following descriptions taken in conjunction with the accompanying drawings, in which.

Figure 1:
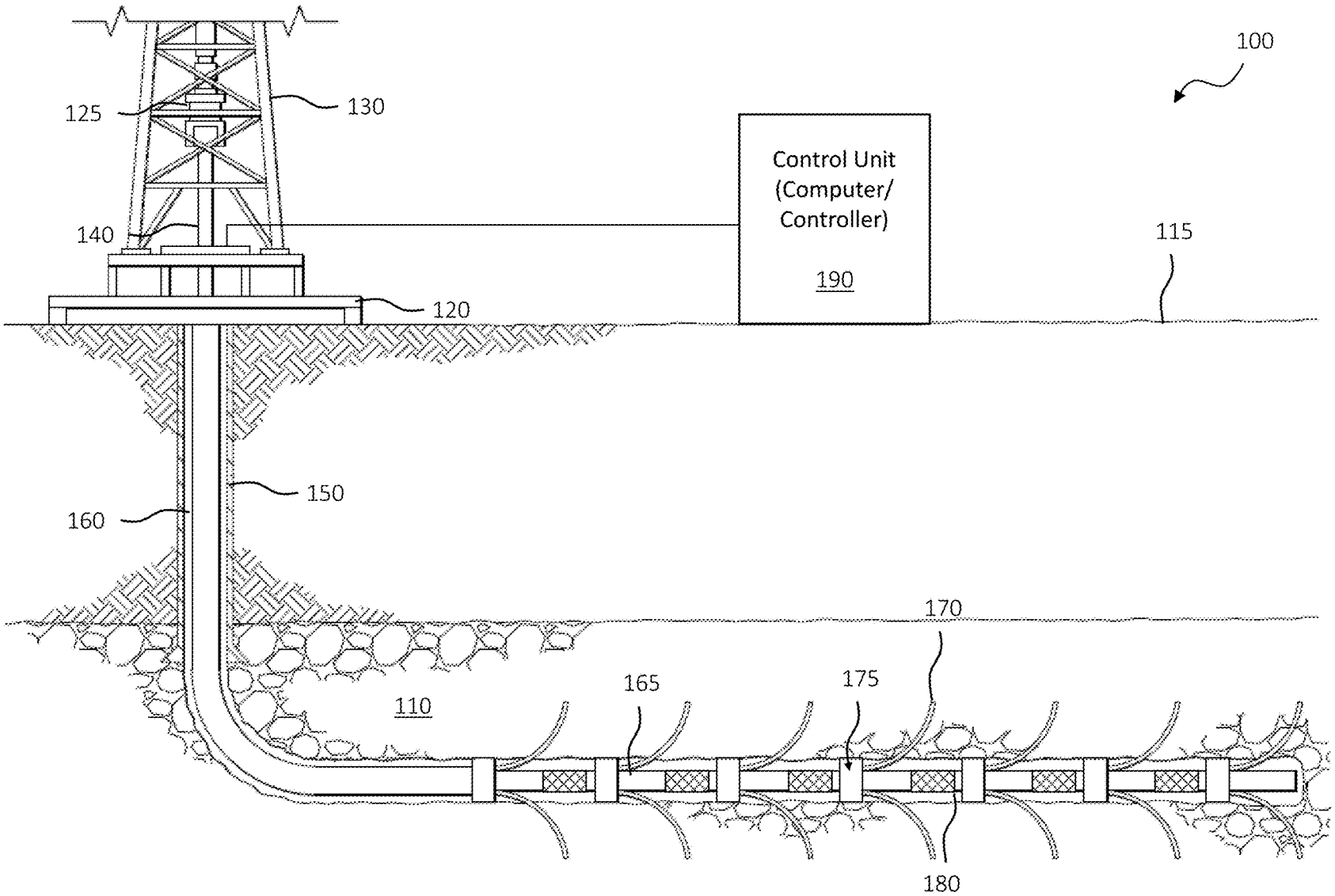
FIG. 1 illustrates a well system including a pressure indication alignment system designed, manufactured, and operated according to one or more embodiments of the disclosure.

FIGS. 9A through 9E illustrate various different views of an alternative embodiment of an inner string designed, manufactured and/or operated according to one or more embodiments of the disclosure; and FIGS. 10A through 10F illustrate various different views of an alternative embodiment of an inner string designed, manufactured and/or operated according to one or more embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure, for the first time, has recognized that a "dead zone" exists in downhole orientation devices (muleshoe 350, etc.), of for example an IsoRite® system. The dead zone may be +/− four degrees in certain embodiments, where the alignment key (e.g., of the inner string) will dive under the muleshoe (e.g., of the outer string), instead of orienting itself within a guide slot in the muleshoe above the liner hanger (e.g., XG liner hanger). The present disclosure has further recognized that there is an issue/concern in the inability to locate the collet latch system and then pull up to install the liner hanger bushing (e.g., the donut).

Based at least in part upon the foregoing recognitions, the present disclosure has developed one or more axial and/or rotational alignment system, which allow the user to avoid this dead zone. In certain embodiments, the axial and/or rotational alignment system allows a user thereof to sense when the alignment key is within the dead zone (e.g., misaligned). In other embodiments, the axial and/or rotational alignment system allows a user thereof to sense when the alignment key is outside of the dead zone (e.g., aligned).

In at least one embodiment, the disclosure employs an orientation port and/or orientation seal(s) so that they will either: 1) seal and hold pressure while they are aligned within the dead zone, or 2) will not hold pressure while they are aligned within the dead zone. In one embodiment, the collet latch will have a collet that is not permanently supported when in the latched-in position as the current latch does. The collet may have a final setting step to "lock" the collet latch in the supported position. In many embodiments, the collet will be able to unsnap out of the XG's MLT groove (or another groove/feature) with a slight over-pull (e.g., 10,000-lbs). This will give the operator an indication that the Collet Latch was indeed located within the MLT groove/feature and not hanging up on something else in the wellbore. Once other operations have been performed, one or both features (pressure-indication and re-latching feature) may be employed to re-latch the collet latch with full assurance that the alignment key is in proper alignment and the collet latch is located at the proper depth (e.g., in the MLT Groove). Other features, additions, embodiments may become apparent in taking in the details below.

Turning to FIG. 1, illustrated is a well system 100 designed, manufactured, and operated according to one or more embodiments of the disclosure, and including a pressure indication alignment system (not shown) designed, manufactured, and operated according to one or more embodiments of the disclosure. The well system 100 includes a platform 120 positioned over a subterranean formation 110 located below the earth's surface 115. The platform 120, in at least one embodiment, has a hoisting apparatus 125 and a derrick 130 for raising and lowering a downhole conveyance 140, such as a drill string, casing string, tubing string, coiled tubing, intervention tool, etc. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

The well system 100 in one or more embodiments includes a main wellbore 150. The main wellbore 150, in the illustrated embodiment, includes tubing 160, 165, which may have differing tubular diameters. Extending from the main wellbore 150, in one or more embodiments, may be one or more lateral wellbores 170. Furthermore, a plurality of multilateral junctions 175 may be positioned at junctions (intersection of one wellbore with another wellbore) between the main wellbore 150 and the lateral wellbores 170. The well system 100 may additionally include one or more Interval Control Valve (ICVs) 180 positioned at various positions within the main wellbore 150 and/or one or more of the lateral wellbores 170. The ICVs 180 may comprise an ICV designed, manufactured, or operated according to the disclosure. The well system 100 may additionally include a control unit 190. The control unit 190, in this embodiment, is operable to provide control to or received signals from, one or more downhole devices, including the pressure indication alignment system. For example, the control unit 190 may be employed to sense pressure drops, pressure spikes, or a lack thereof, and thus help ascertain whether an inner string is appropriately axially and/or rotationally located within an outer string. In this embodiment, control unit 190 is also operable to provide power to one or more downhole devices.

Figure 2A:
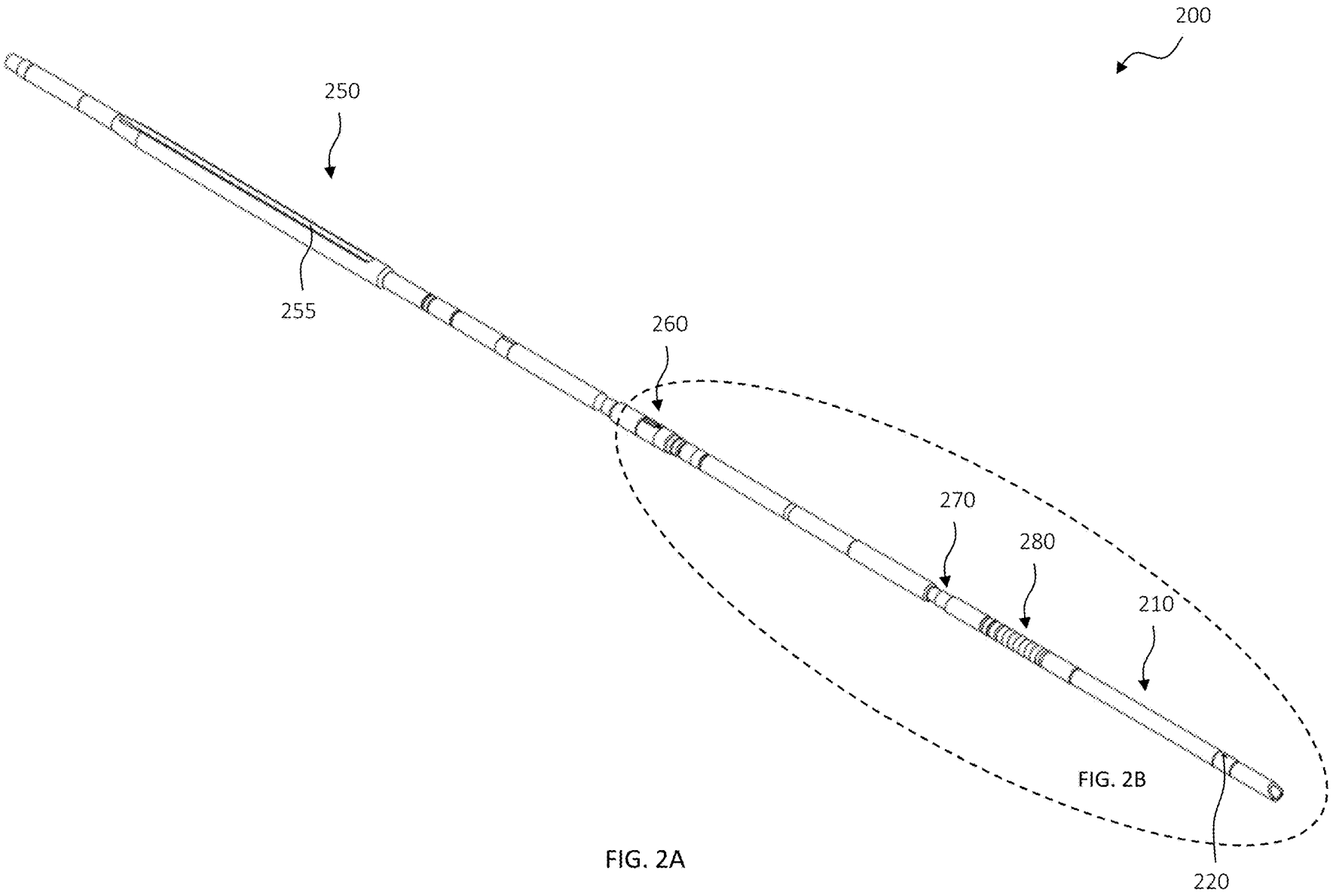
FIGS. 2A through 2E illustrate various different views of an inner string designed, manufactured and/or operated according to one or more embodiments of the disclosure.

Turning to FIG. 2A, illustrated is one embodiment of an inner string 200 designed, manufactured and/or operated according to one or more embodiments of the disclosure. The inner string 200, in the illustrated embodiment, includes an inner tubular 210 configured to extend at least partially within a seal bore (e.g., 4.250" slotted seal boar) of an outer tubular, the inner tubular 210 including a sidewall having a thickness ($t_1$). The inner tubular 210, in at least one embodiment, includes an orientation port 220 extending entirely through the sidewall of the inner tubular 210 to provide fluid access from an interior of the inner tubular 210 to an exterior of the inner tubular 210. In at least one embodiment, the orientation port 220 is configured to align with an orientation slot in an outer tubular that it is configured to engage with, for example to provide a pressure reading indicative of a relative location of the inner tubular 210 to the outer tubular.

The inner string 200, in the illustrated embodiment, additionally includes a completion window 250 coupled to the inner tubular 210, the completion window having a window opening 255 (e.g., completion window opening) configured to align with a lateral wellbore opening. In at least one embodiment, a radial centerpoint ($CP_{op}$) of the orientation port is radially aligned with a radial centerpoint ($CP_{wo}$) of the window opening. The inner string 200, in the illustrated embodiment, further includes an alignment key 260 extending radially outward from the inner tubular 210, a latch mechanism 270 extending radially outward from the inner tubular 210, and one or more production seals 280. In the illustrated embodiment, the one or more production seals 280 are located along the exterior of the inner tubular 210, and are positioned between the orientation port 220 and the alignment key 260. Any type of latch mechanism 270 may be used and remain within the scope of the disclosure.

Figure 2B:
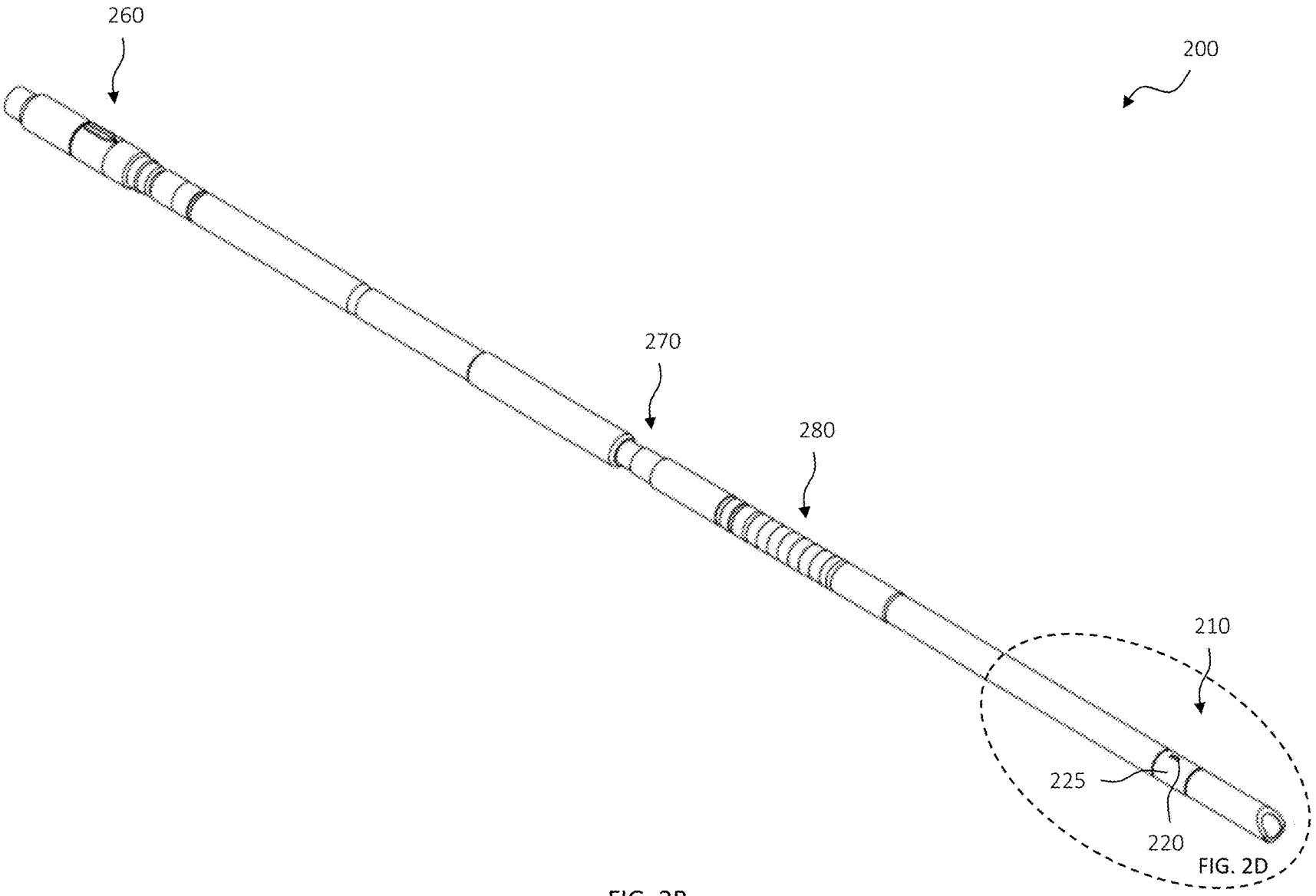
Figure 2C:
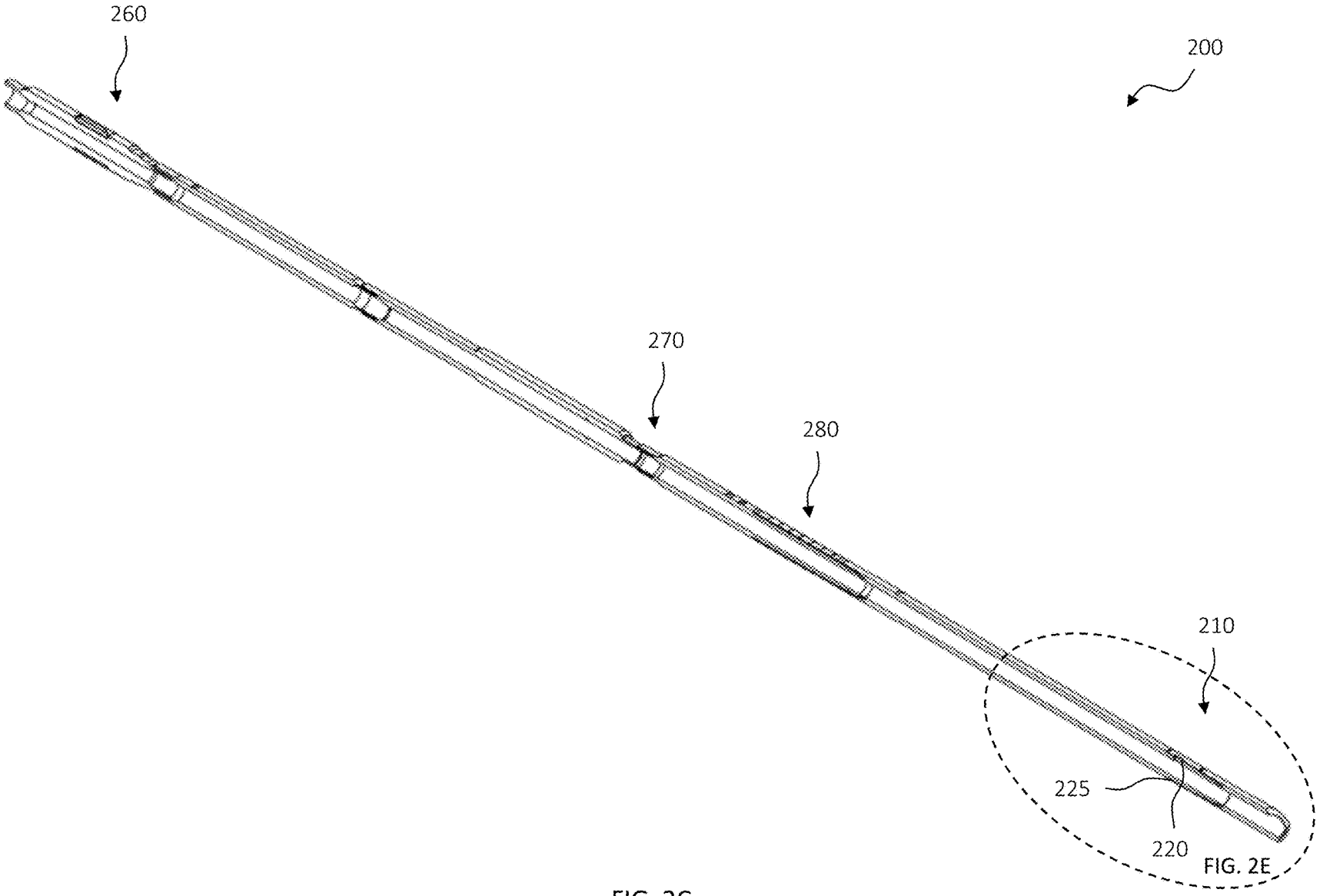

Turning to FIGS. 2B and 2C, illustrated are a perspective view and cross-sectional perspective view, respectively, of a portion of the inner string 200 illustrated in FIG. 2A. In the illustrated embodiment of FIGS. 2B and 2C, one or more orientation seals 225 are located along the exterior of the inner tubular 210 and surrounding the orientation port 220. Further to the embodiment of FIGS. 2B and 2C, a single orientation seal 225 is located along the exterior of the inner tubular 210 and surrounding all sides of the orientation port 220. As shown in the illustrated embodiment, the single orientation seal 225 not only encircles the orientation port 220, but also extends entirely around the inner tubular 210. Many different types of materials may be used for the one or more orientation seals 225 and remain within the scope of the disclosure. Nevertheless, in at least one embodiment the one or more orientation seals 225 are one or more elastomeric or metal-to-metal seals. Furthermore, in the illustrated embodiment, a radial centerpoint ($CP_{op}$) of the orientation port 220 is radially aligned with a radial centerpoint ($CP_{ak}$) of the alignment key 260. Moreover, the inner tubular 210 may comprise a collection of separate tubular coupled together, as opposed to a single tubular.

Figure 2D:
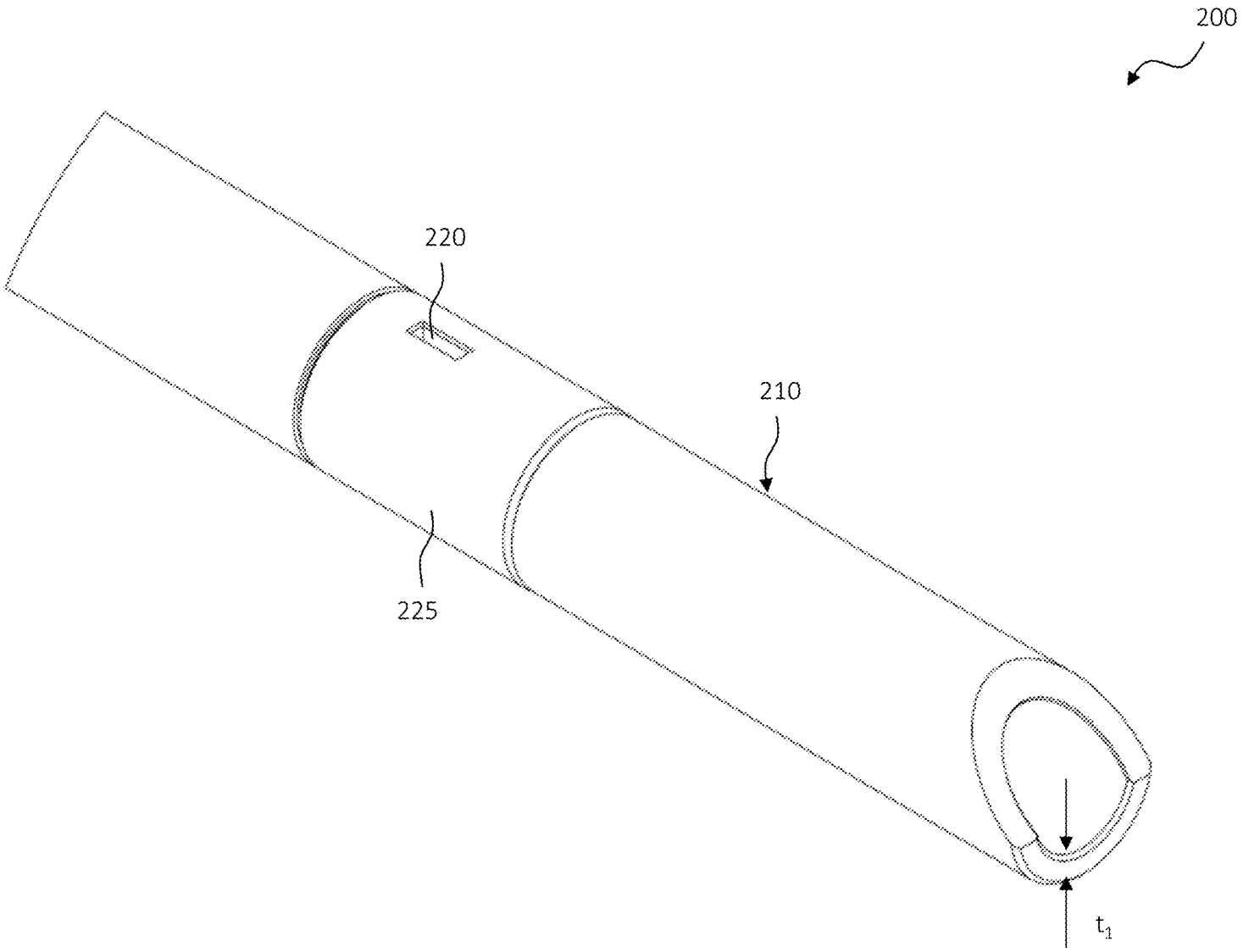
Figure 2E:
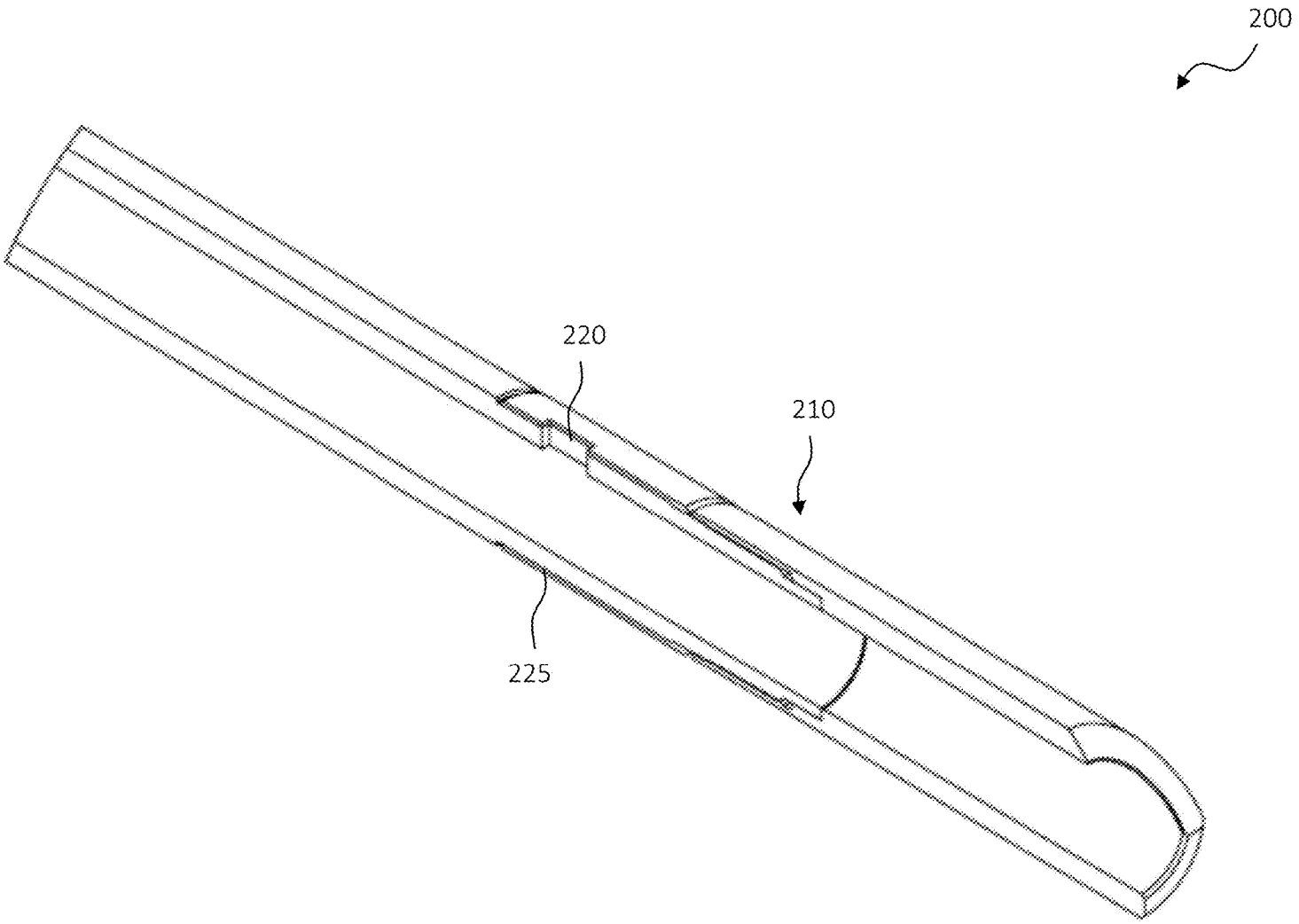

Turning to FIGS. 2D and 2E, illustrated are a perspective view and cross-sectional perspective view, respectively, of a portion of the inner string 200 illustrated in FIGS. 2B and 2C. As shown in this embodiment, only a single orientation port 220 is located in the inner tubular 210. Furthermore, in the illustrated embodiment the orientation port 220 is a polygon shaped orientation port, such as a rectangular shaped orientation port. Nevertheless, other shapes, sizes and numbers for the orientation port 220 are within the scope of the disclosure.

Figure 3A:
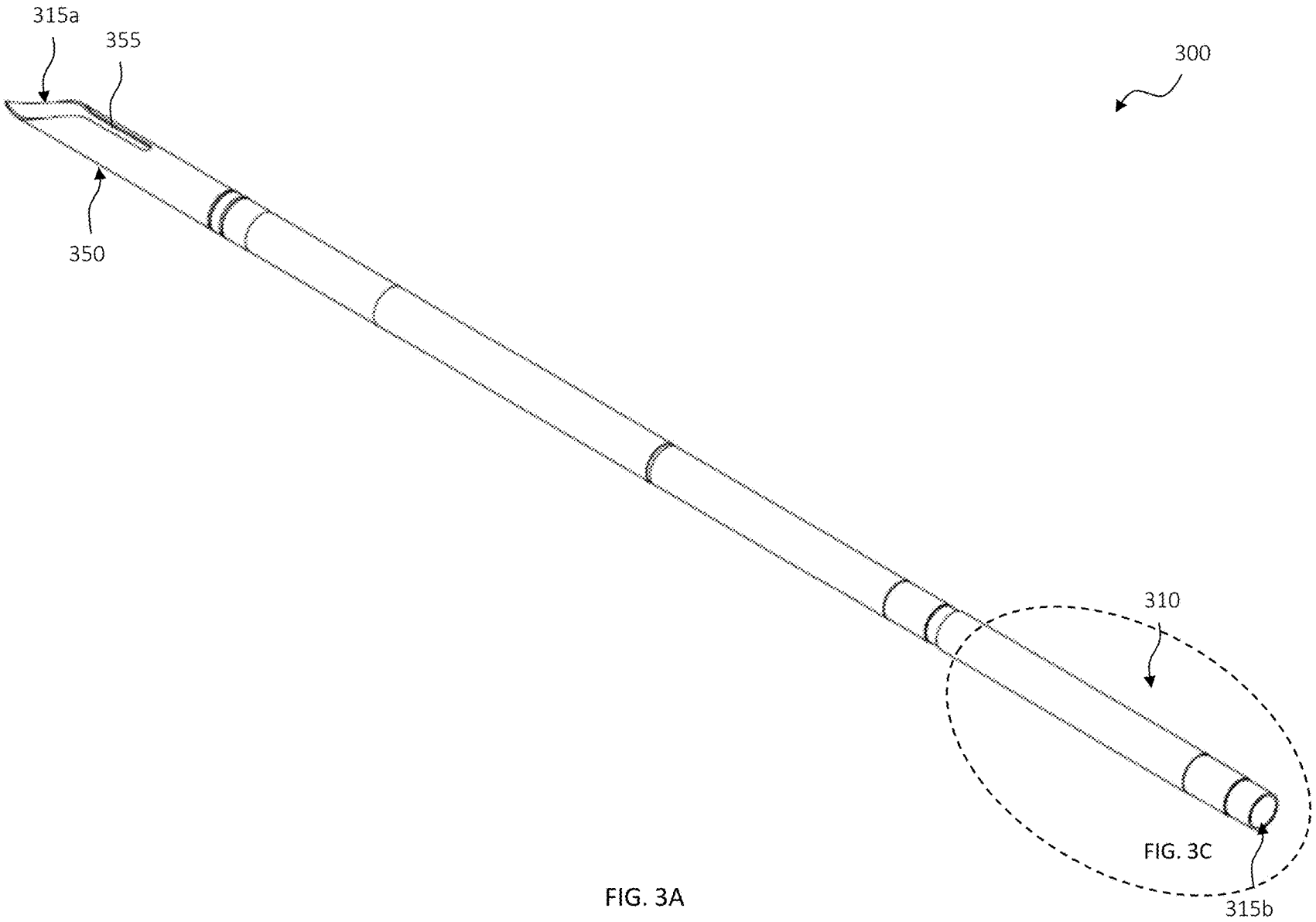
FIGS. 3A through 3F illustrate various different views of an outer string designed, manufactured and/or operated according to one or more embodiments of the disclosure.
Figure 3B:
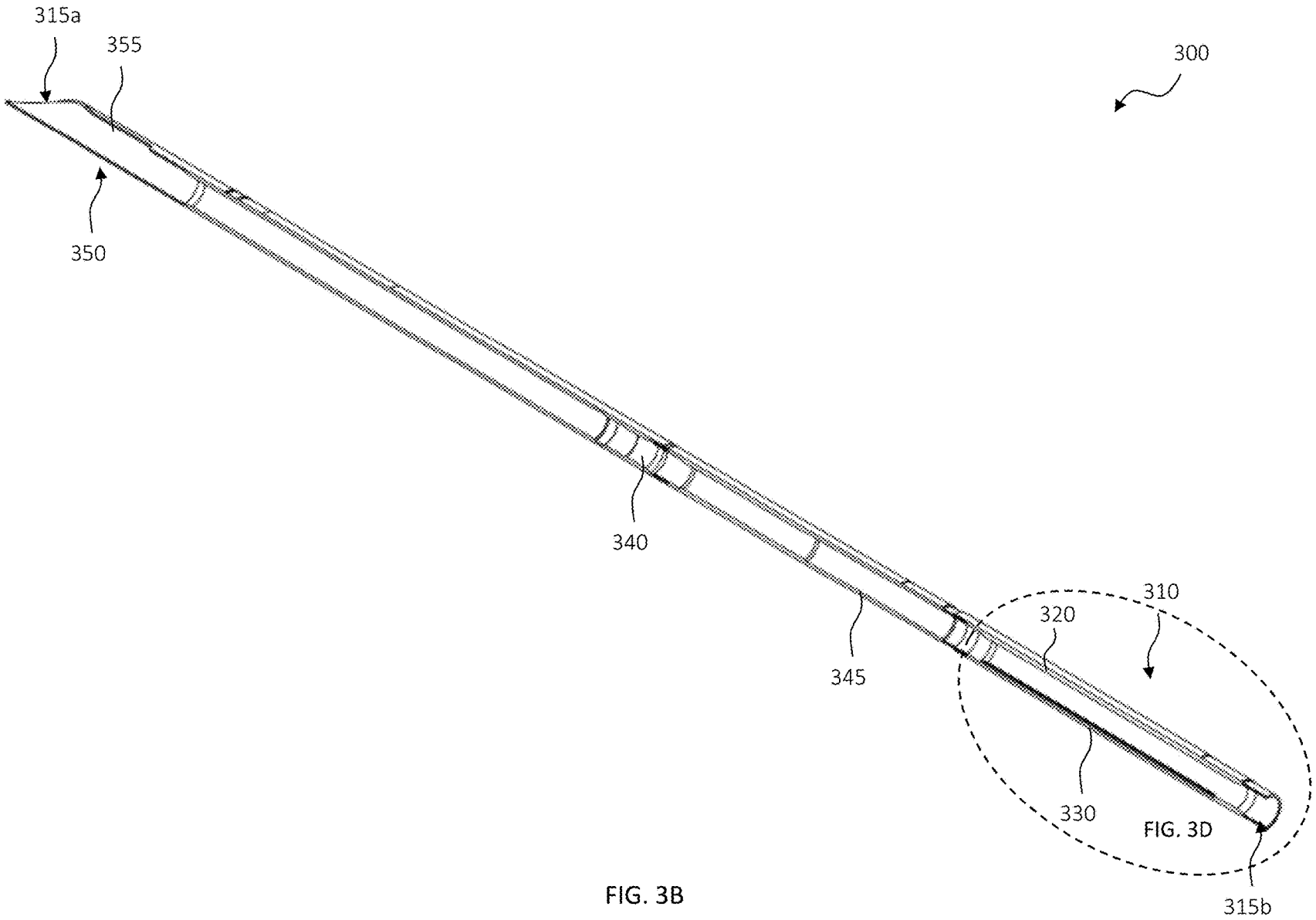

Turning to FIGS. 3A and 3B, illustrated are a perspective view and cross-sectional perspective view of an outer string 300 designed, manufactured and/or operated according to one or more embodiments of the disclosure. The outer string 300, in the illustrated embodiment, includes an outer tubular 310 configured to extend at least partially around an inner tubular (e.g., the inner tubular 210 of the inner string 200 of FIG. 2). The outer tubular 310, in the illustrated embodiment, includes a seal surface 320. The outer tubular 310, in one or more embodiments, further includes an orientation slot 330 located along an inside surface of the outer tubular 310. The orientation slot 330, as will be discussed in detail below, is configured to align with an orientation port in the inner tubular (e.g., orientation port 220 of the inner string 200 of FIG. 2) that it is configured to engage with, to provide a pressure reading indicative of a relative location of the inner tubular to the outer tubular 310.

The outer tubular 310, in at least one embodiment, includes an uphole end 315*a* and a downhole end 315*b*. In one or more embodiments, the orientation slot 330 is positioned between the downhole end 315*a* and the seal surface 320. The outer tubular 310, in at least one embodiment, further includes a latch profile 340 and a production seal bore 345 located along the inside surface. In at least one embodiment, the latch profile 340 is positioned between the uphole end 315*a* and the seal surface 320, and may be used to engage with a latch mechanism (e.g., latch mechanism 270 of FIG. 2). Similarly, the production seal bore 345 is located between the latch mechanism and the downhole end 315*b*, and may be used to engage with one or more production seals (e.g., production seals 280).

In at least one embodiment, such as shown, the outer tubular 310 forms at least a portion of a liner hanger. For example, the liner hanger could include a muleshoe 350 with a muleshoe guide slot 355 proximate the uphole end 315*a* thereof. In at least one embodiment, a radial centerpoint ($CP_{os}$) of the orientation slot 330 is radially misaligned with a radial centerpoint ($CP_{gs}$) of the muleshoe guide slot 355. For example, in at least one embodiment the radial centerpoint ($CP_{os}$) of the orientation slot 330 is radially misaligned by 180 degrees relative to the radial centerpoint ($CP_{gs}$) of the muleshoe guide slot 355.

Figure 3C:
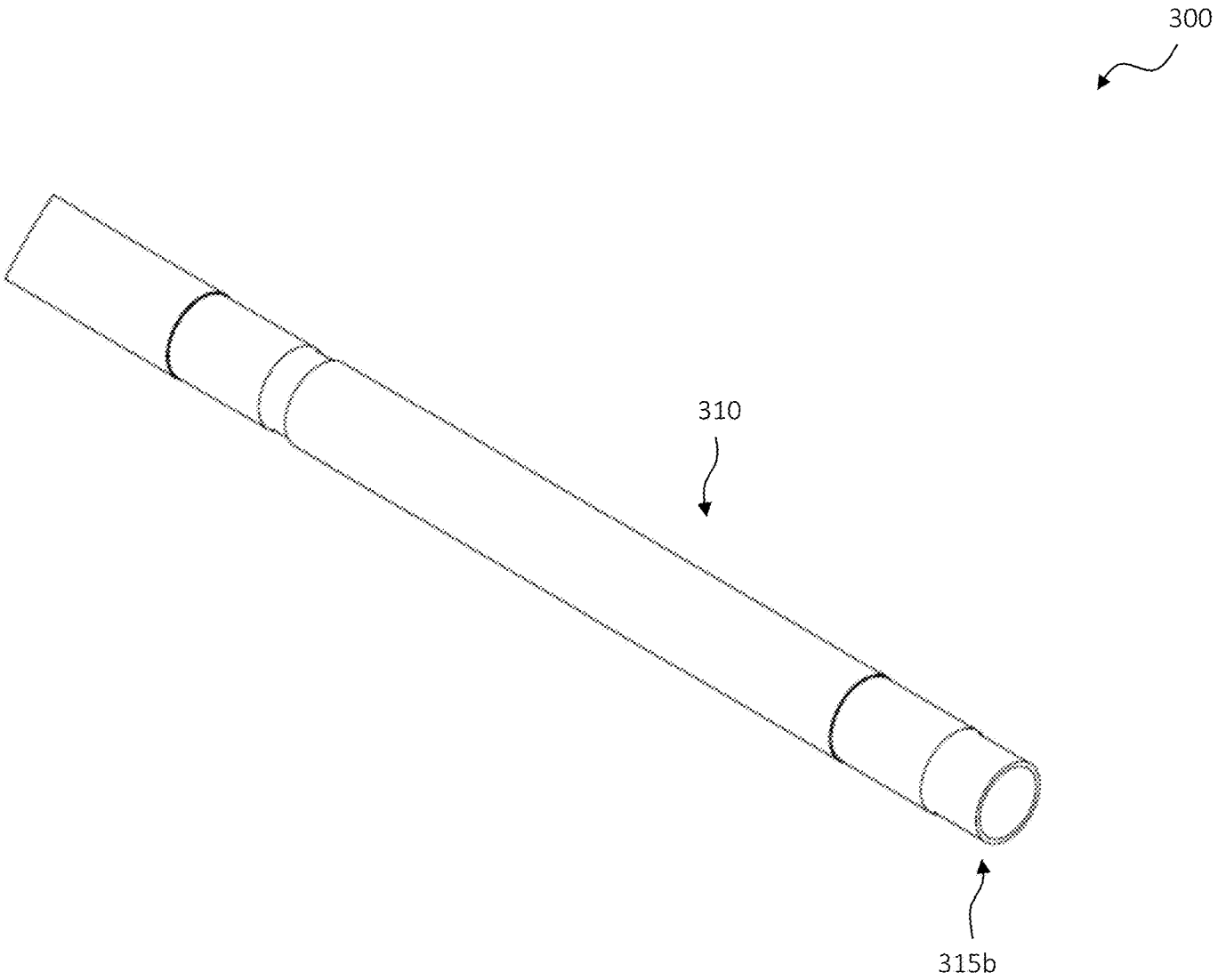
Figure 3D:
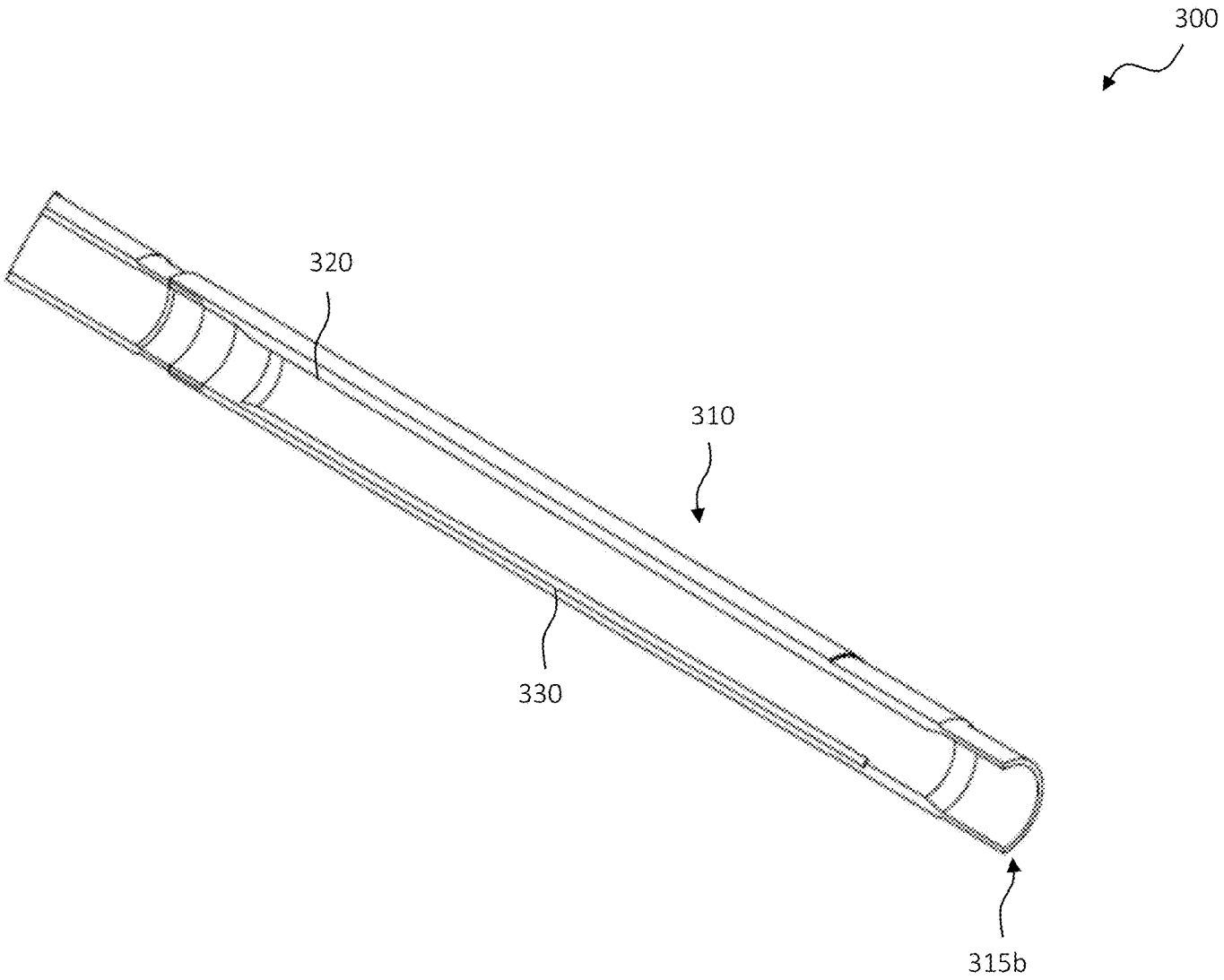

Turning to FIGS. 3C and 3D, illustrated are a perspective view and cross-sectional perspective view, respectively, of a portion of the outer string 300 illustrated in FIGS. 3A and 3B.

Figure 3E:
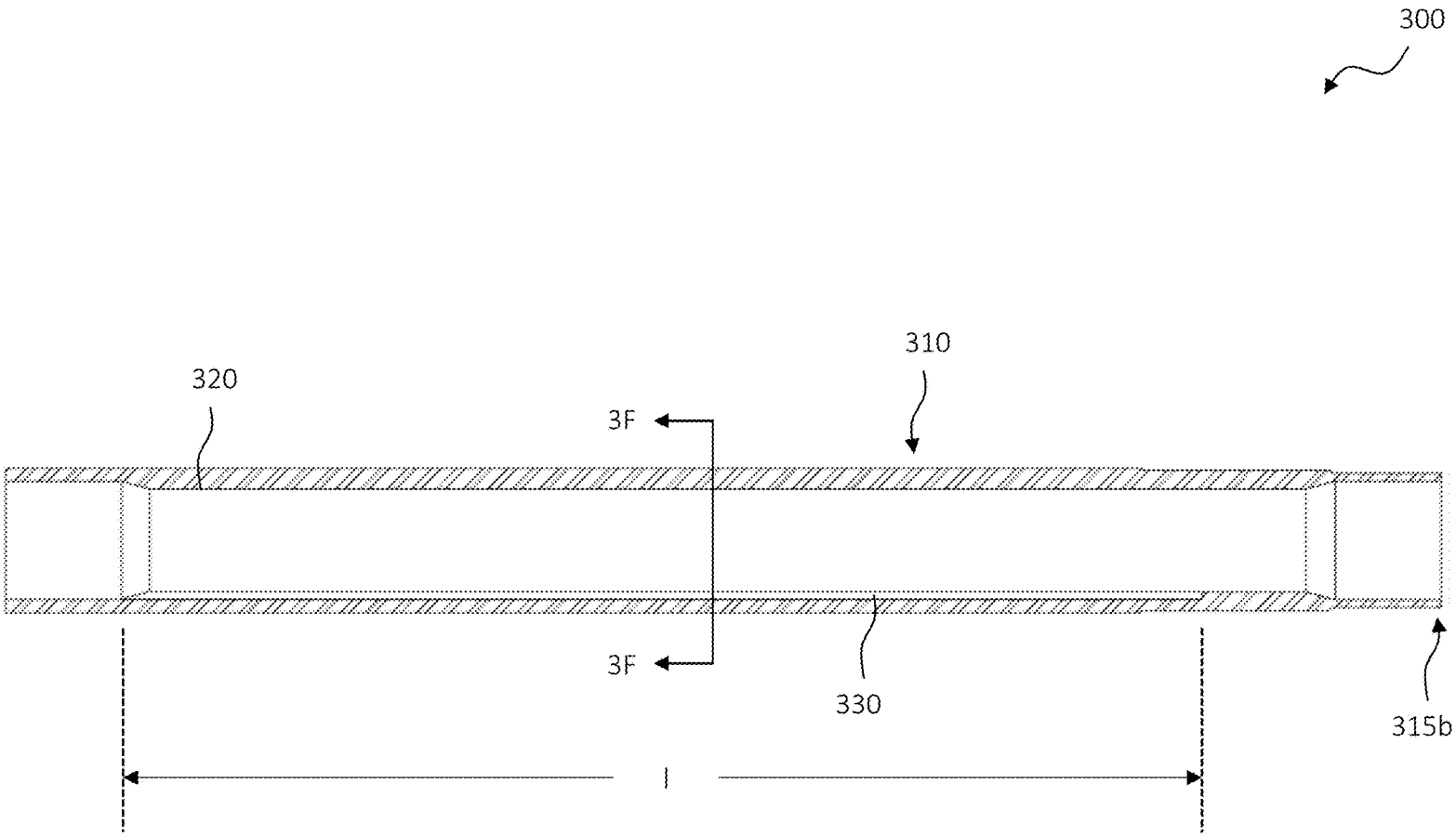
Figure 3F:
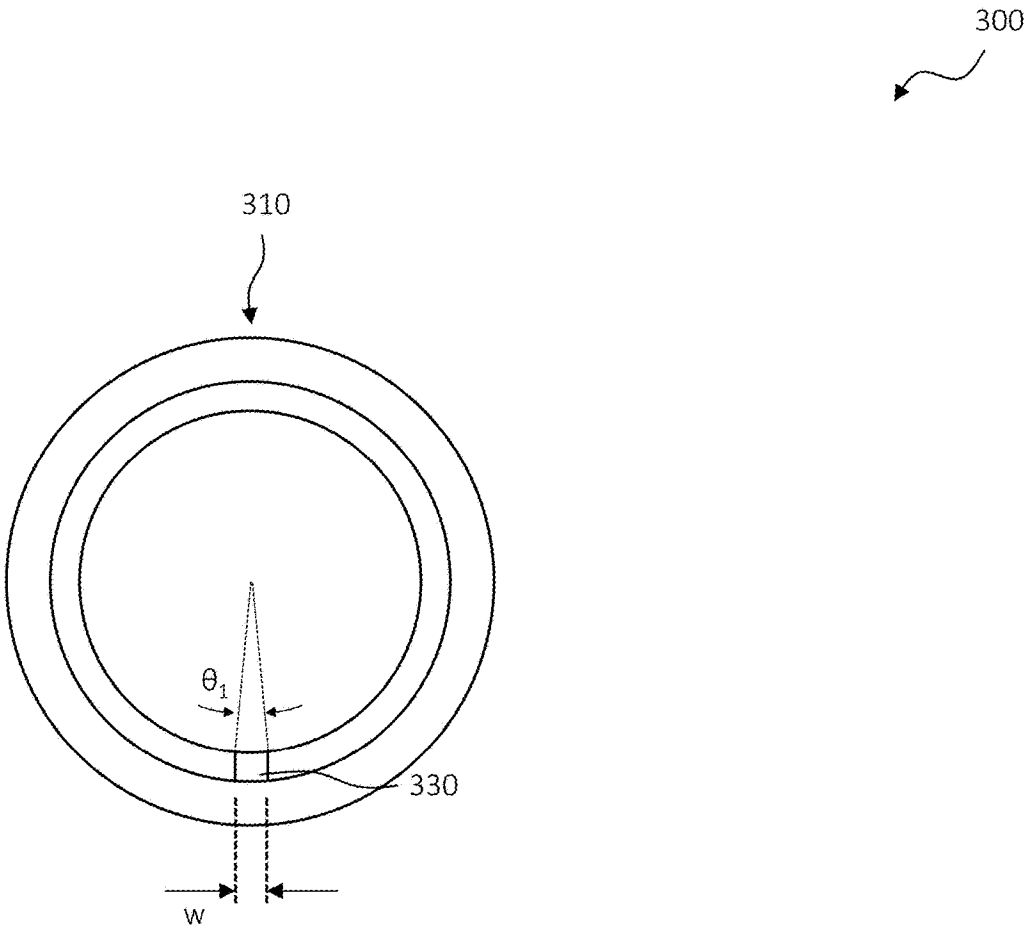

Turning to FIGS. 3E and 3F, illustrated are alternative cross-sectional views of a portion of the outer string 300 illustrated in FIGS. 3A and 3B. As shown in the view of FIGS. 3E and 3F, the orientation slot 330 may be a longitudinal orientation slot. For example, the longitudinal orientation slot 330 may have a length (l) and a width (w). In at least one embodiment, the length (l) of the longitudinal orientation slot 330 is greater than the width (w) of the longitudinal orientation slot 330. It may be observed that in this embodiment, the length (l) is rather long. For example, the length (l) may in one or more embodiments be at least 60.95 cm long (e.g., 24 inches long), in another embodiment at least 91.44 cm long (e.g., 36 inches long), and in yet another embodiment, at least 101.6 cm long (e.g., 40 inches long), and in yet even another embodiment, 111.76 cm long (e.g., about 44 inches long). In other embodiments, the length (l) may be much shorter. For example, the length (l) may be about 5 cm long (e.g., a few inches long); just long enough to provide a pressure-indication at surface that the alignment key is not aligned with the muleshoe tip just prior to engagement (e.g., 30.48 cm long, or 12 inches long) and just after the alignment key makes full contact with the muleshoe guide slot. In at least one embodiment, the orientation slot 330 spans a radial angle ($\theta_1$) of at least 4 degrees, if not at least 6 degrees, if not at least 8 degrees, if not at least 10 degrees, if not at least 12 degrees, or more.

FIGS. 2A through 3F above have been discussed in relation to a completion device, for example including a completion window and liner hanger, nevertheless the inventive aspects of the present disclosure are applicable to many other downhole tools. For example, the inventive aspects of the present disclosure could be used with: 1) tools to create lateral wellbores, including whipstocks; 2) tools to guide other tools to re-enter laterals, including re-entry whipstocks; 3) tools to re-enter laterals including kickover tools, bent subs, etc.: 4) tools for articulating downhole, including knuckle joints, kickover tools for wireline, coiled tubing, slickline, tubing and drillpipe workstrings, etc.; 5) tools for installation, retrieval and maintenance of tools and/or devices installed in a wellbore or tubular that is offset from the main axis of the wellbore and/or tubular such as a Merla-type kickover tool or other kickover tool (e.g., side pocket mandrel, gas lift valve mandrel, electric submersible pump, and/or other tools including a y-tool and/or bypass system); and 6) tools for completing a well, including oriented perforations, Level 1-6 multilaterals and the tools required therein, among others.

Figure 4:
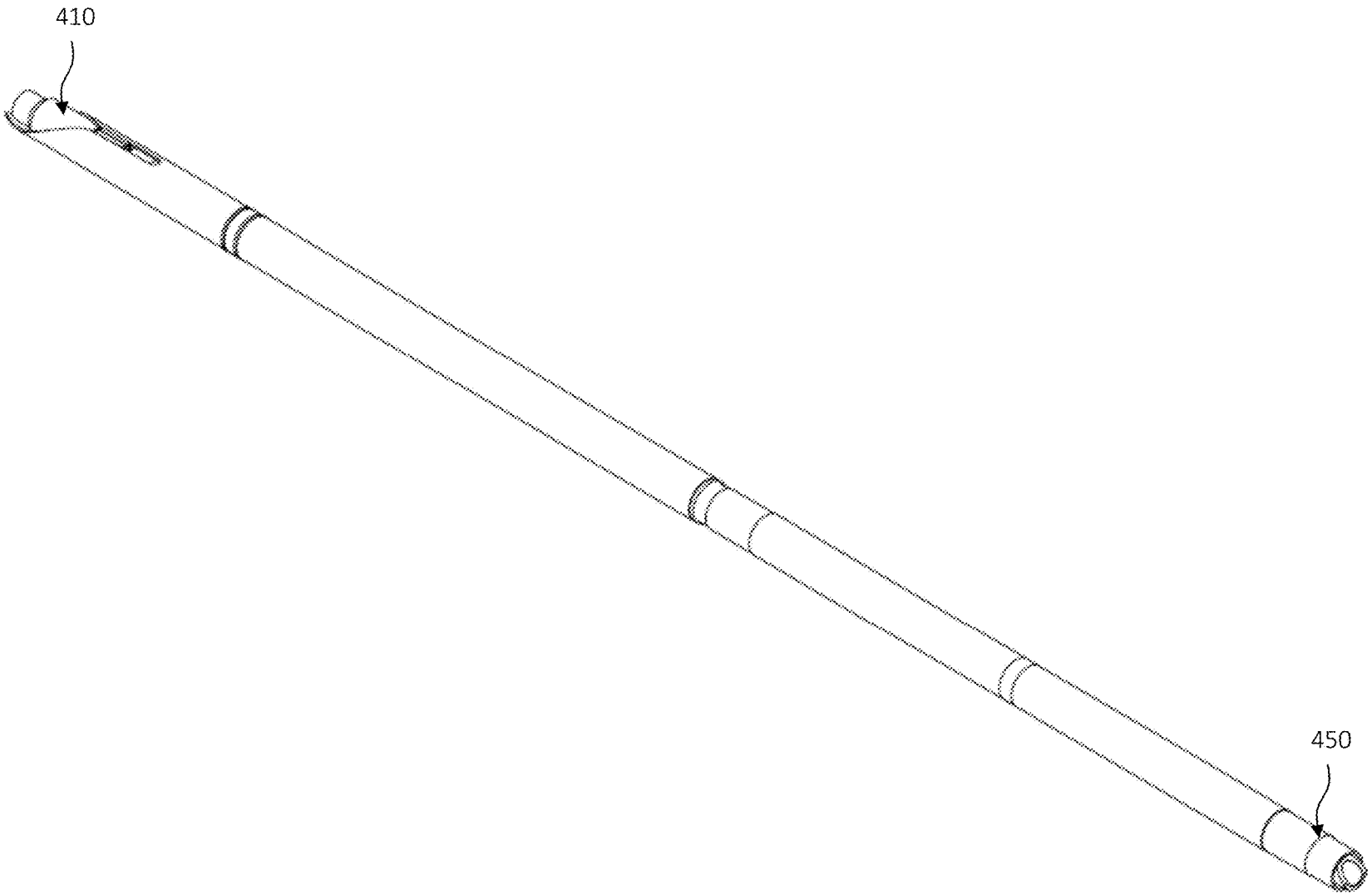
FIG. 4 illustrates a perspective view of an inner string according to the disclosure positioned within an outer string according to the disclosure.

Turning to FIG. 4, illustrated is a perspective view of an inner string 410 positioned within an outer string 450. In at least one embodiment, the inner string 410 may be similar to the inner string 200 discussed above with regard to FIG. 2, whereas the outer string 450 may be similar to the outer string 300 discussed above with regard to FIG. 3.

Figure 5A:
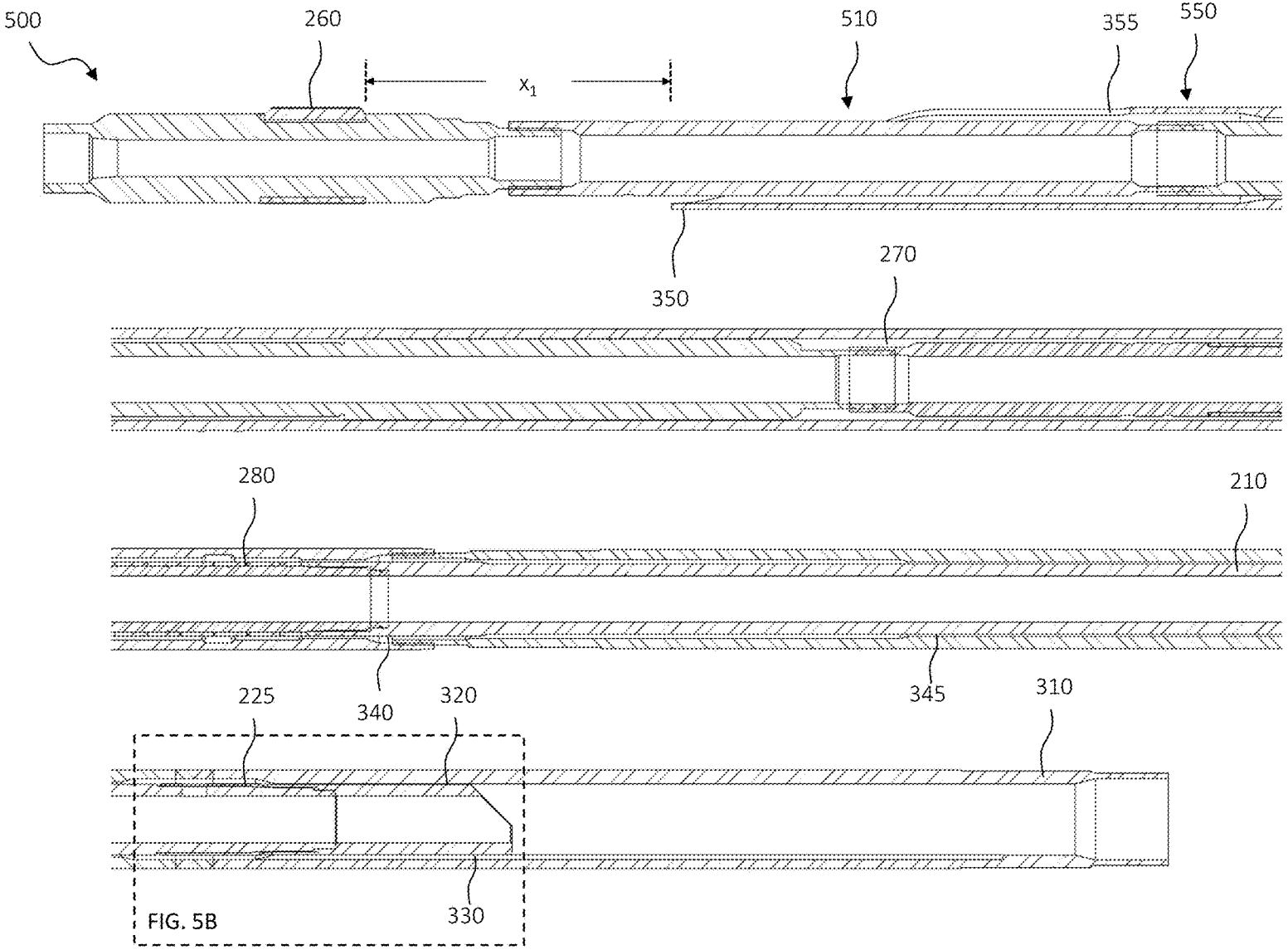
FIGS. 5A through 5P illustrate various different cross-sectional views of one embodiment of a pressure indication alignment system designed, manufactured and/or operated according to one or more embodiments of the disclosure at different relative positions as the inner string is being insert within the outer string.
Figure 5B:
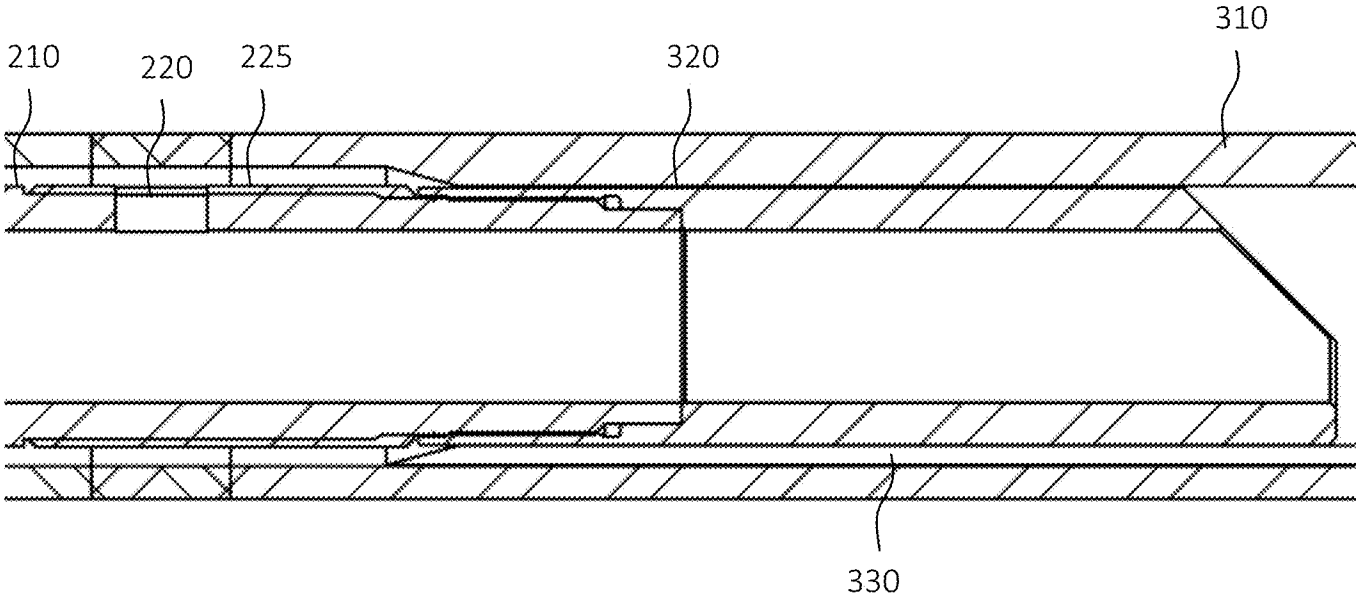
Figure 5A:
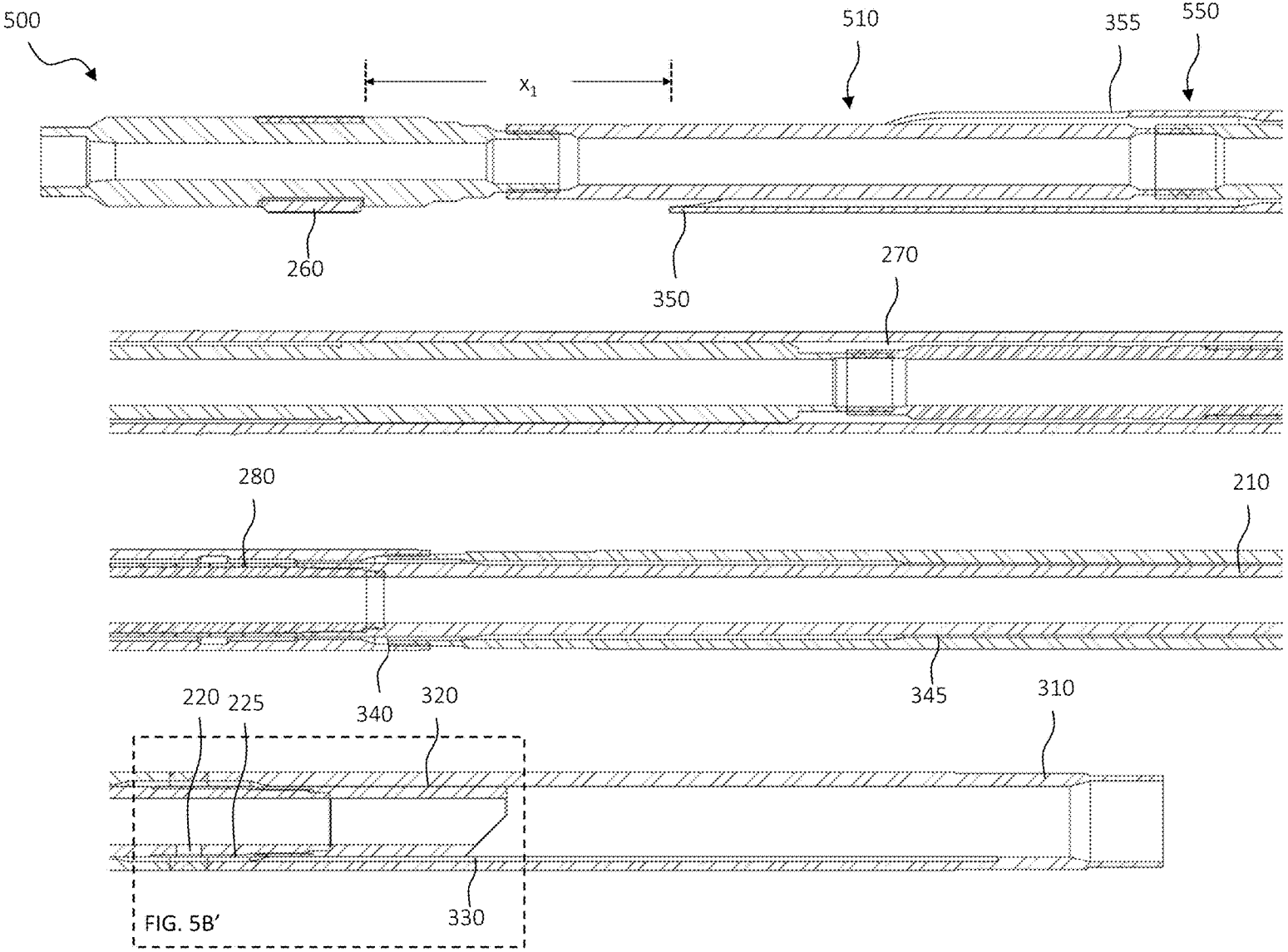
Figure 5B:
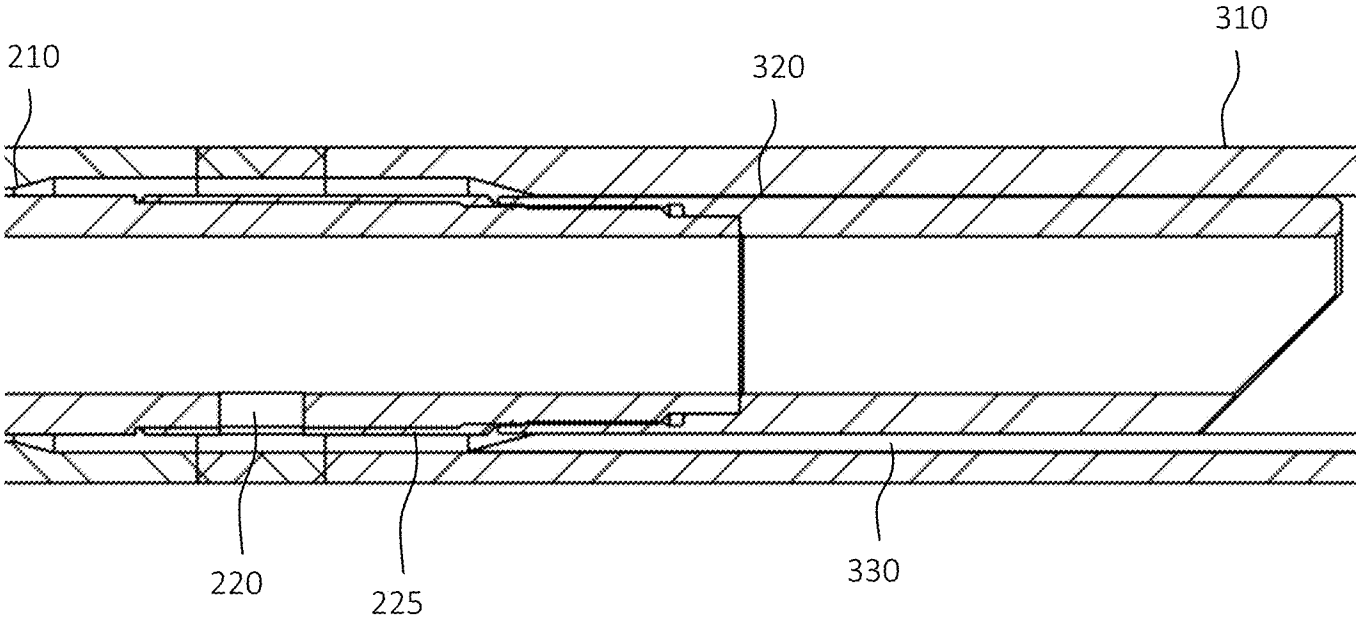
Figure 5C:
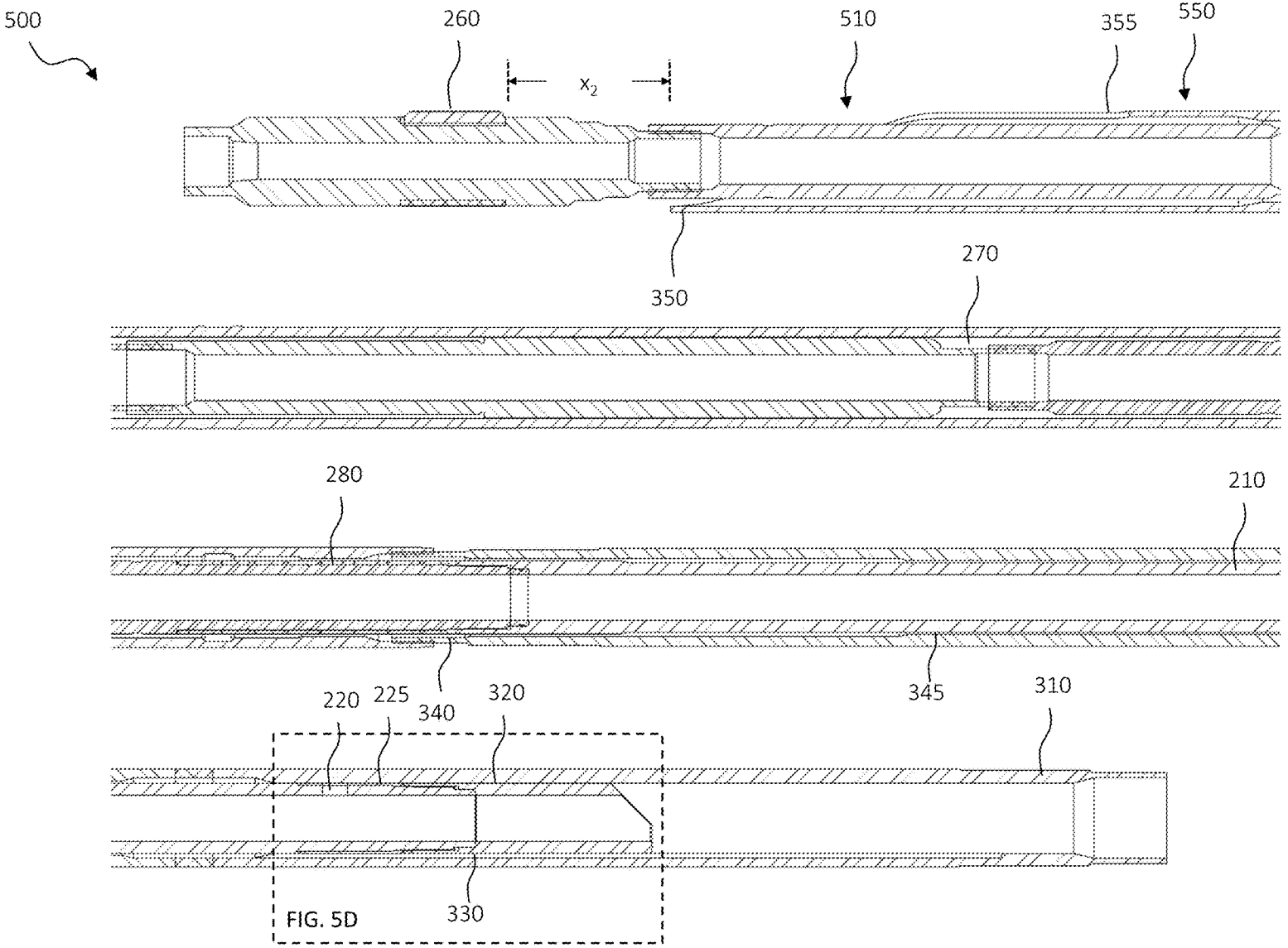
Figure 5D:
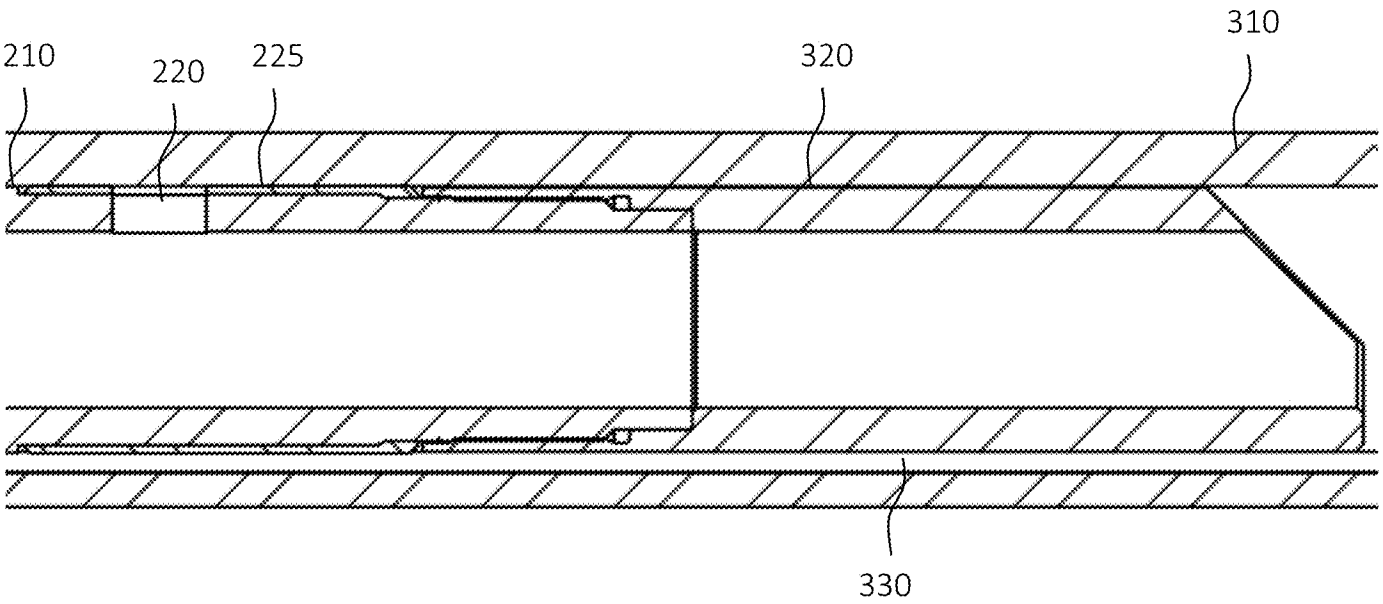
Figure 5C:
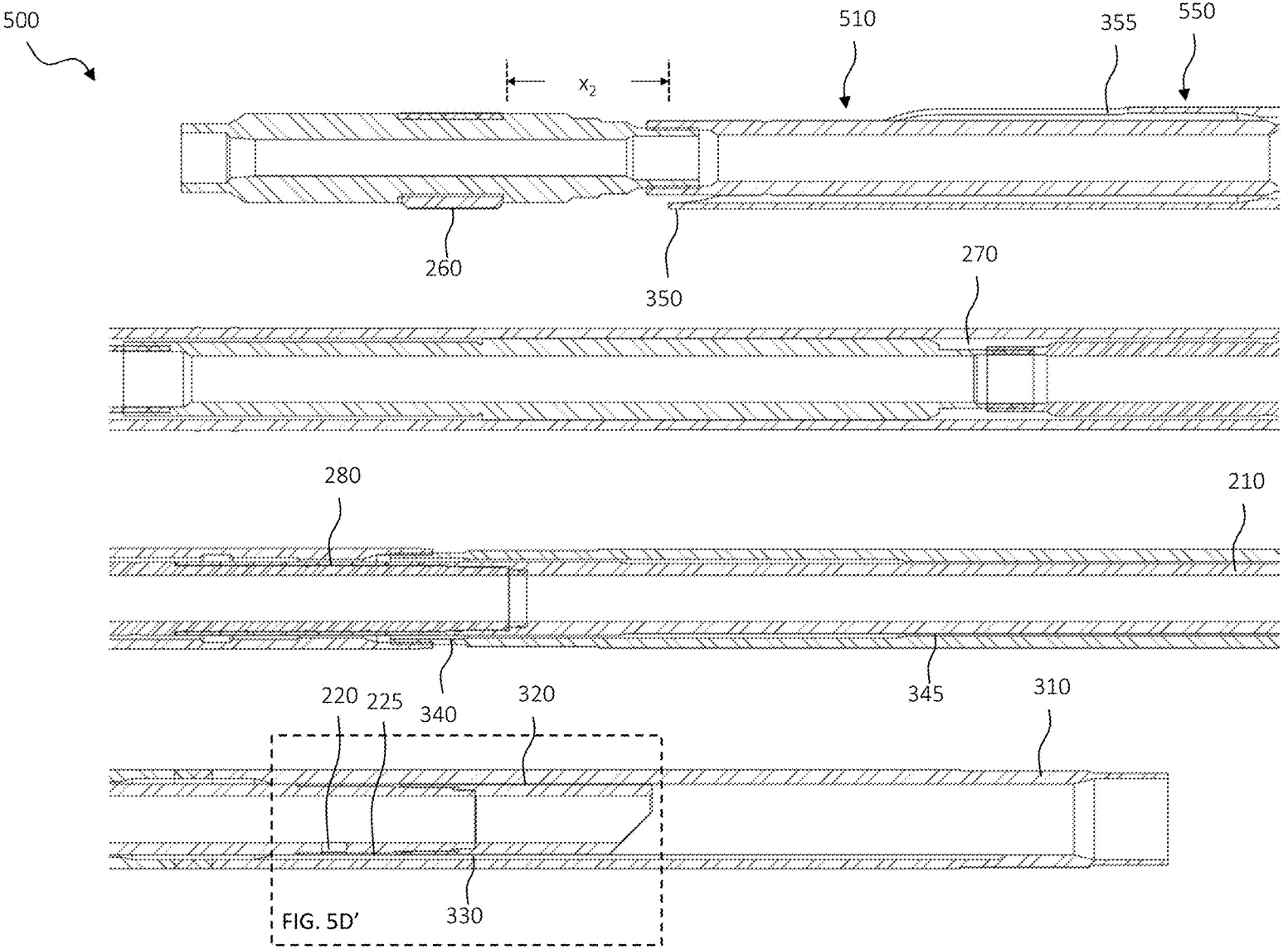
Figure 5D:
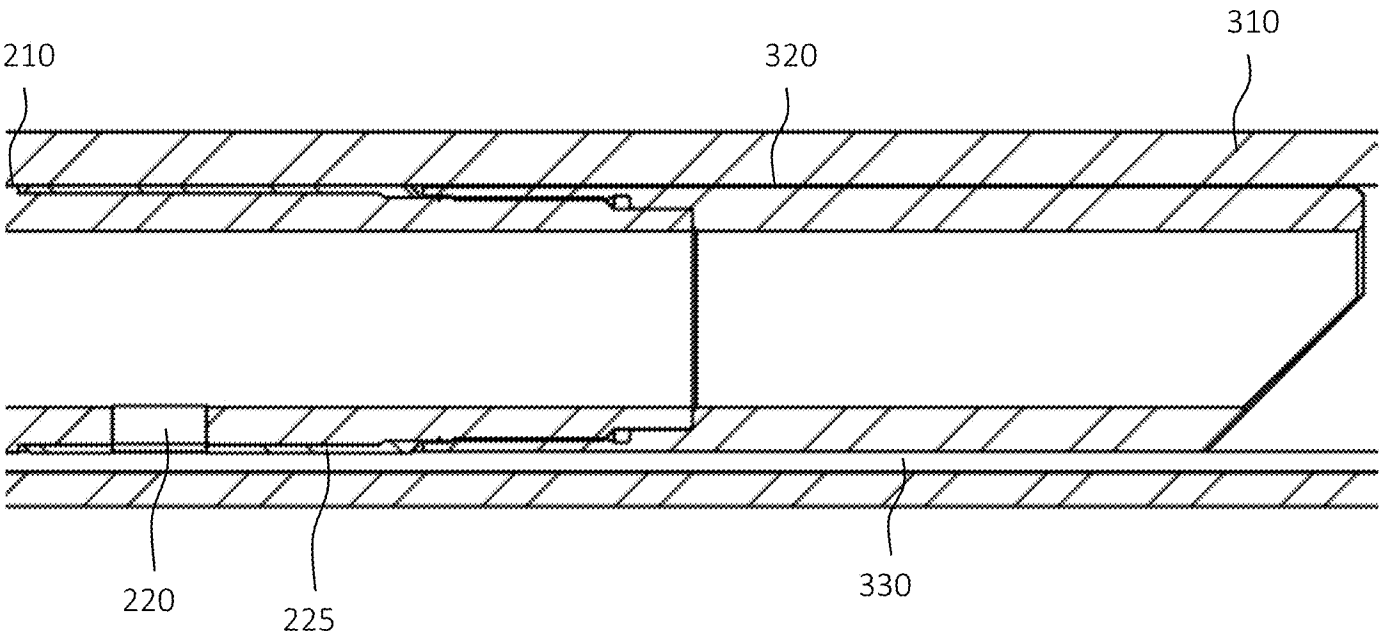
Figures 5E, 5F:
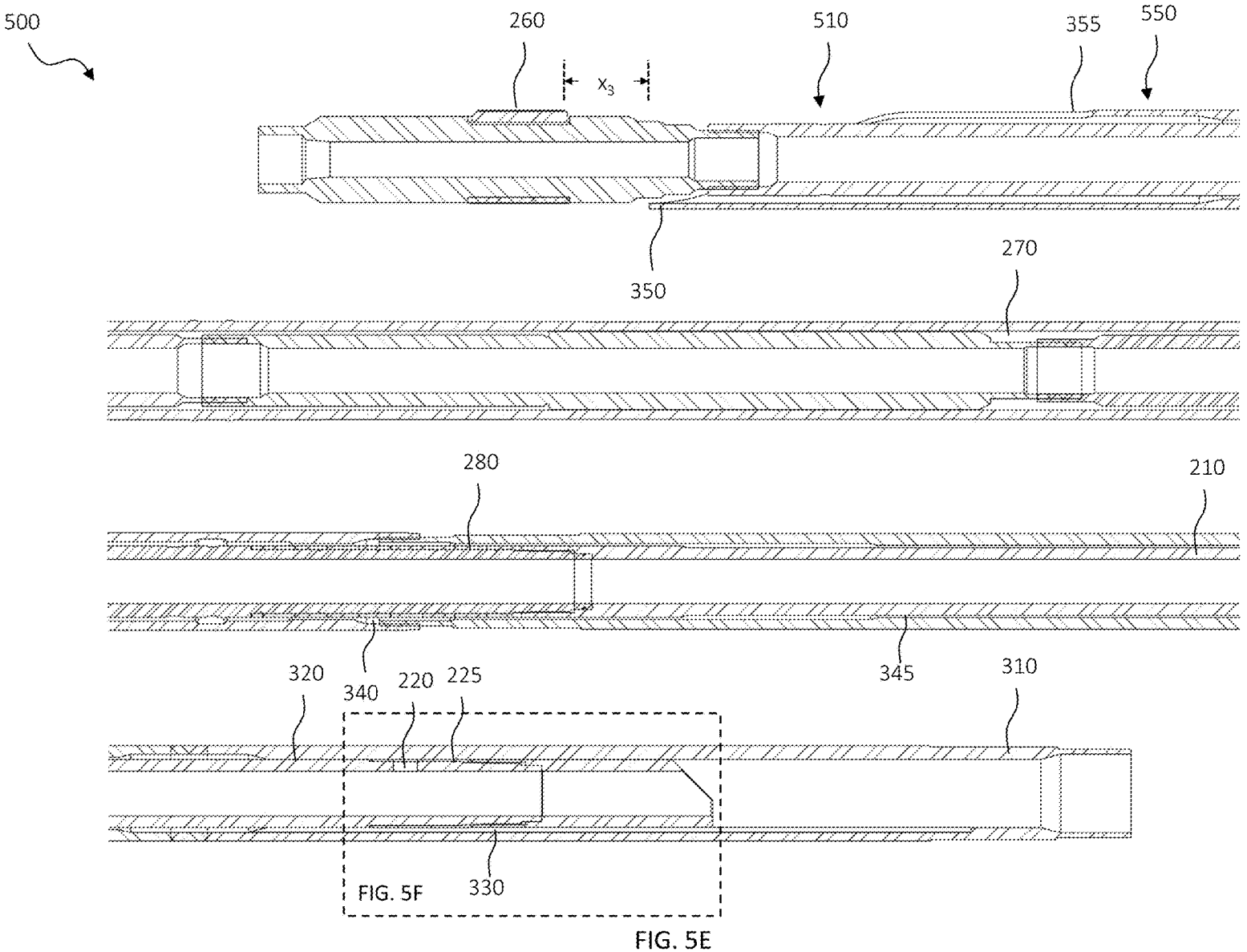
Figure 5F:
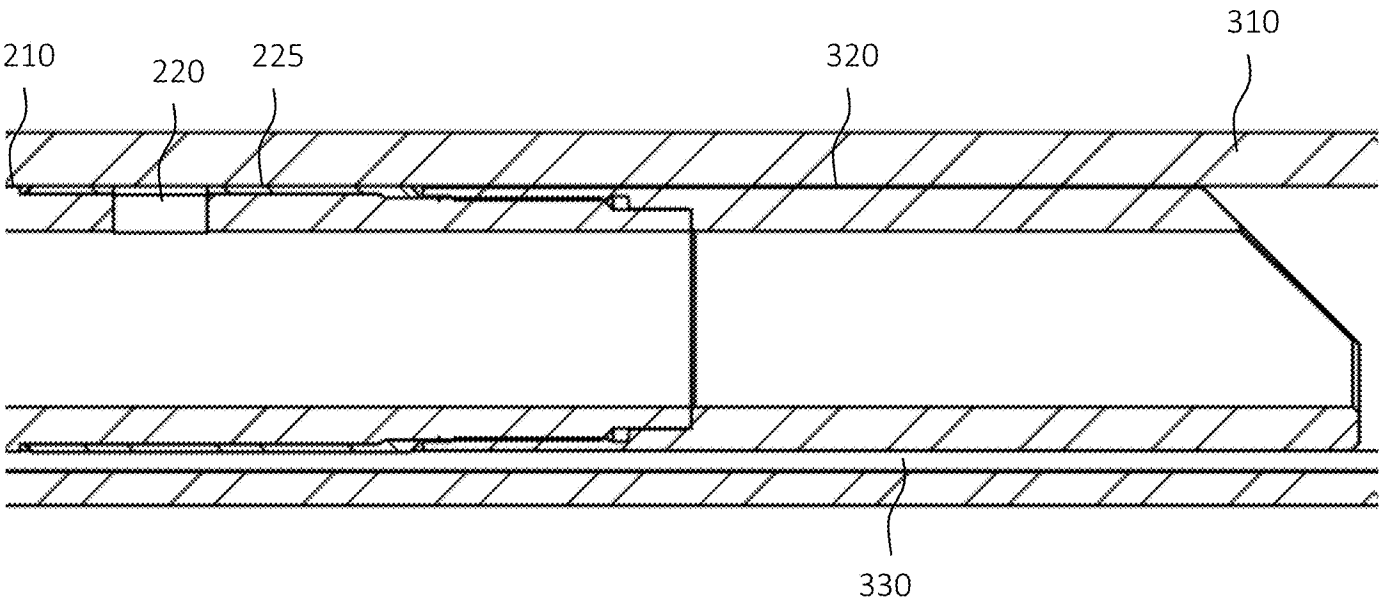
Figures 5E, 5F:
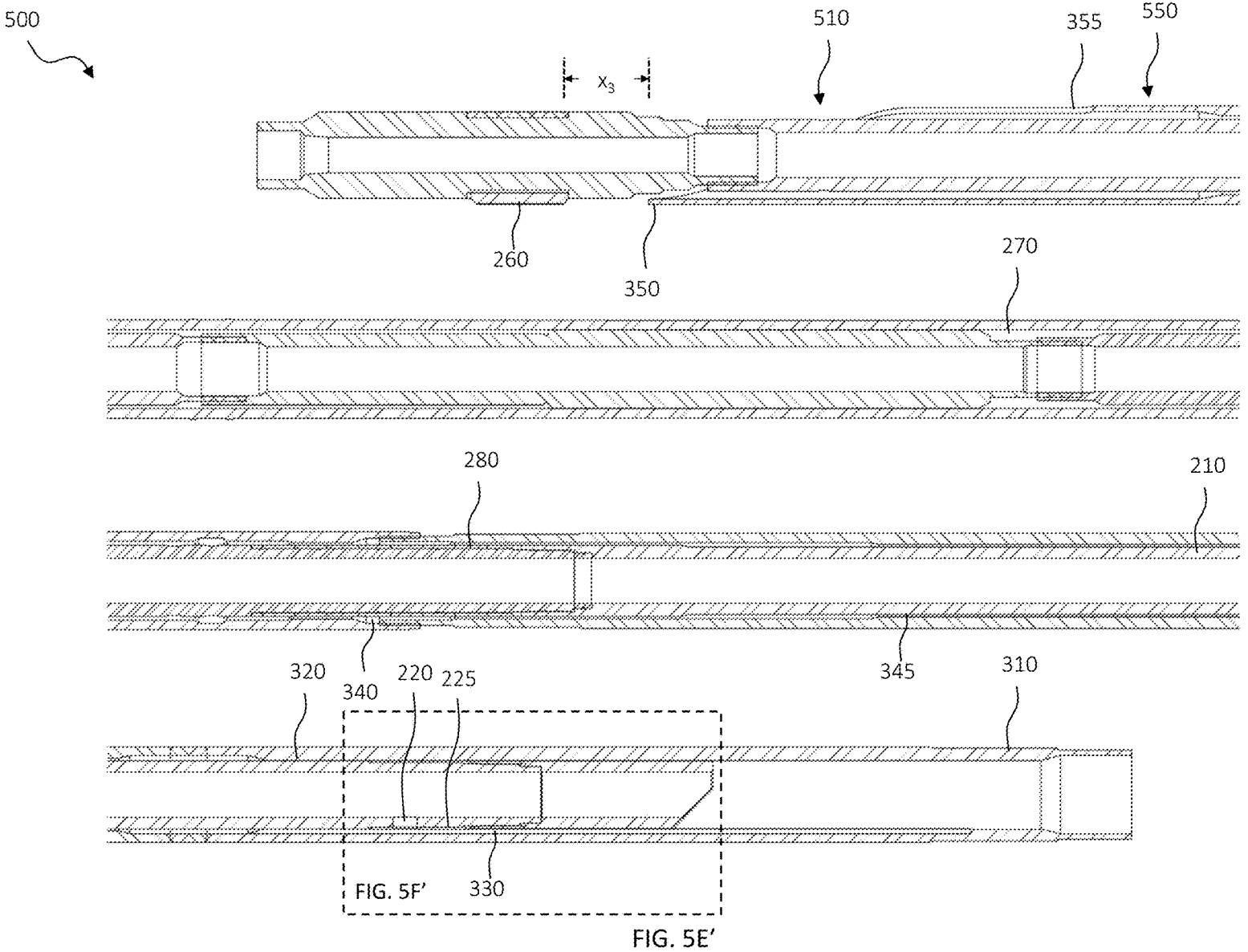
Figure 5F:
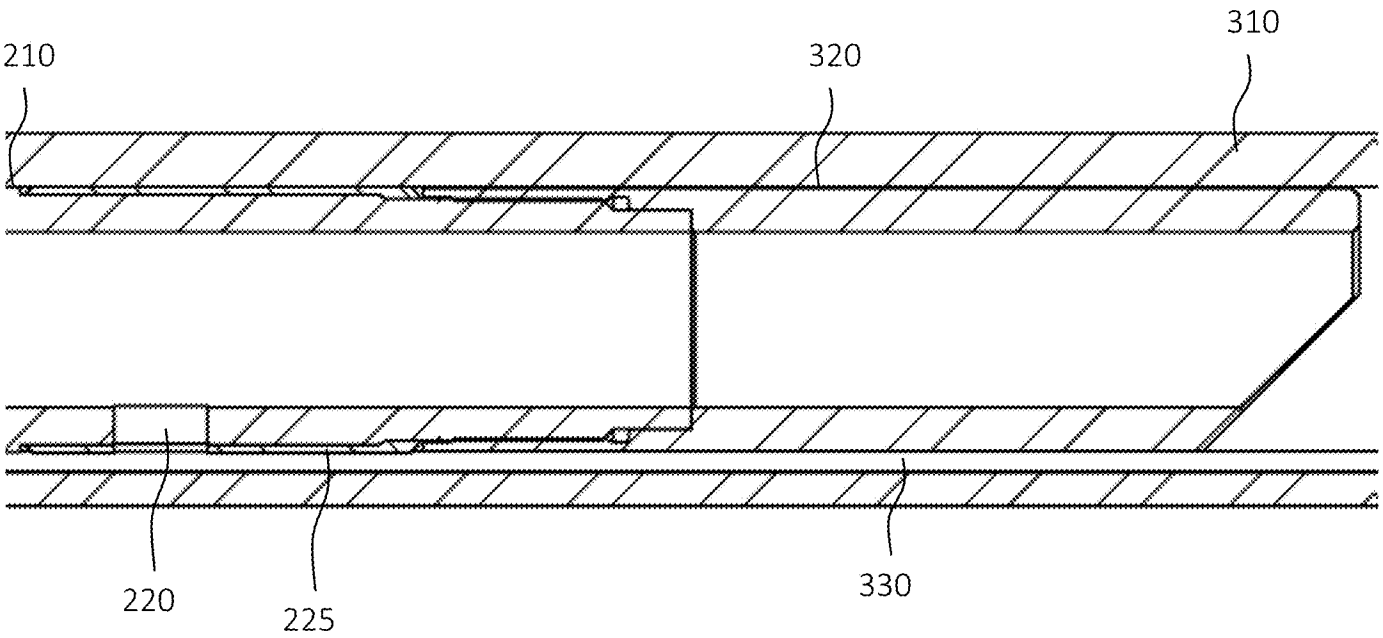
Figure 5G:
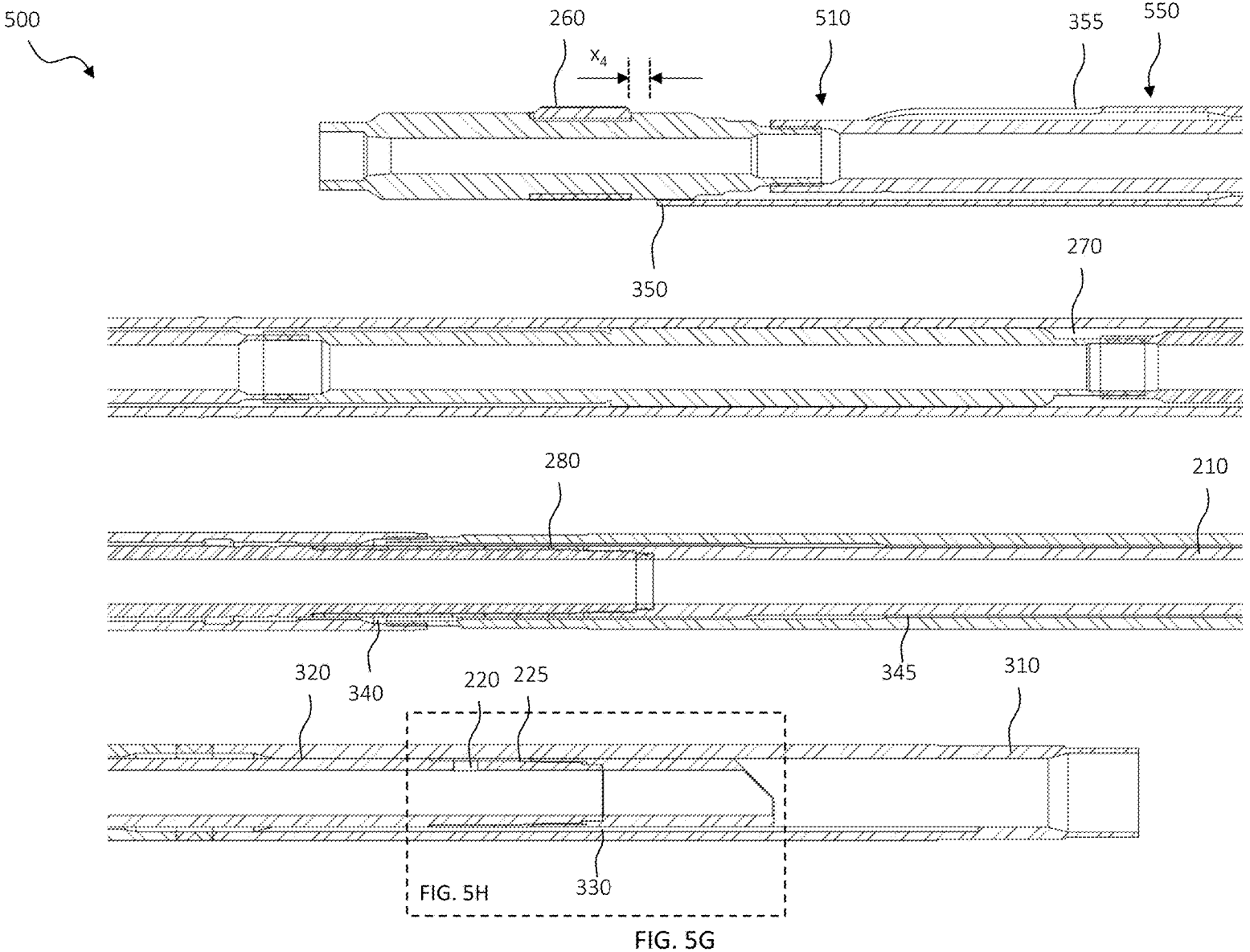
Figure 5H:
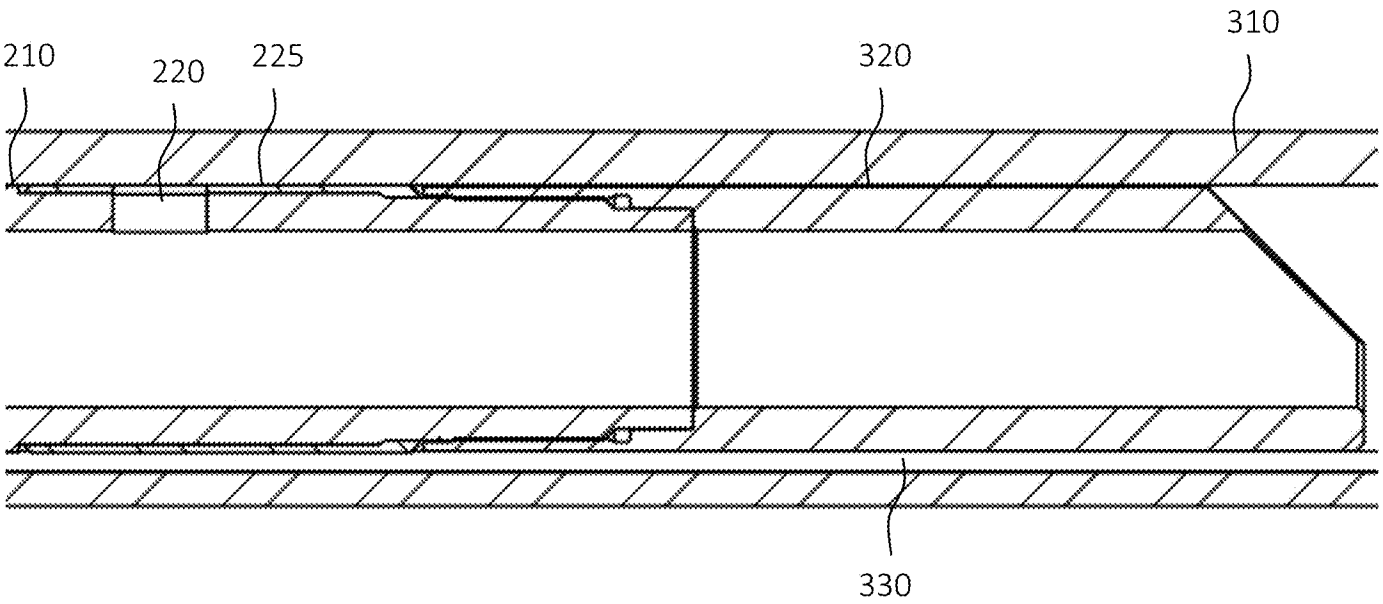
Figures 5G, 5H:
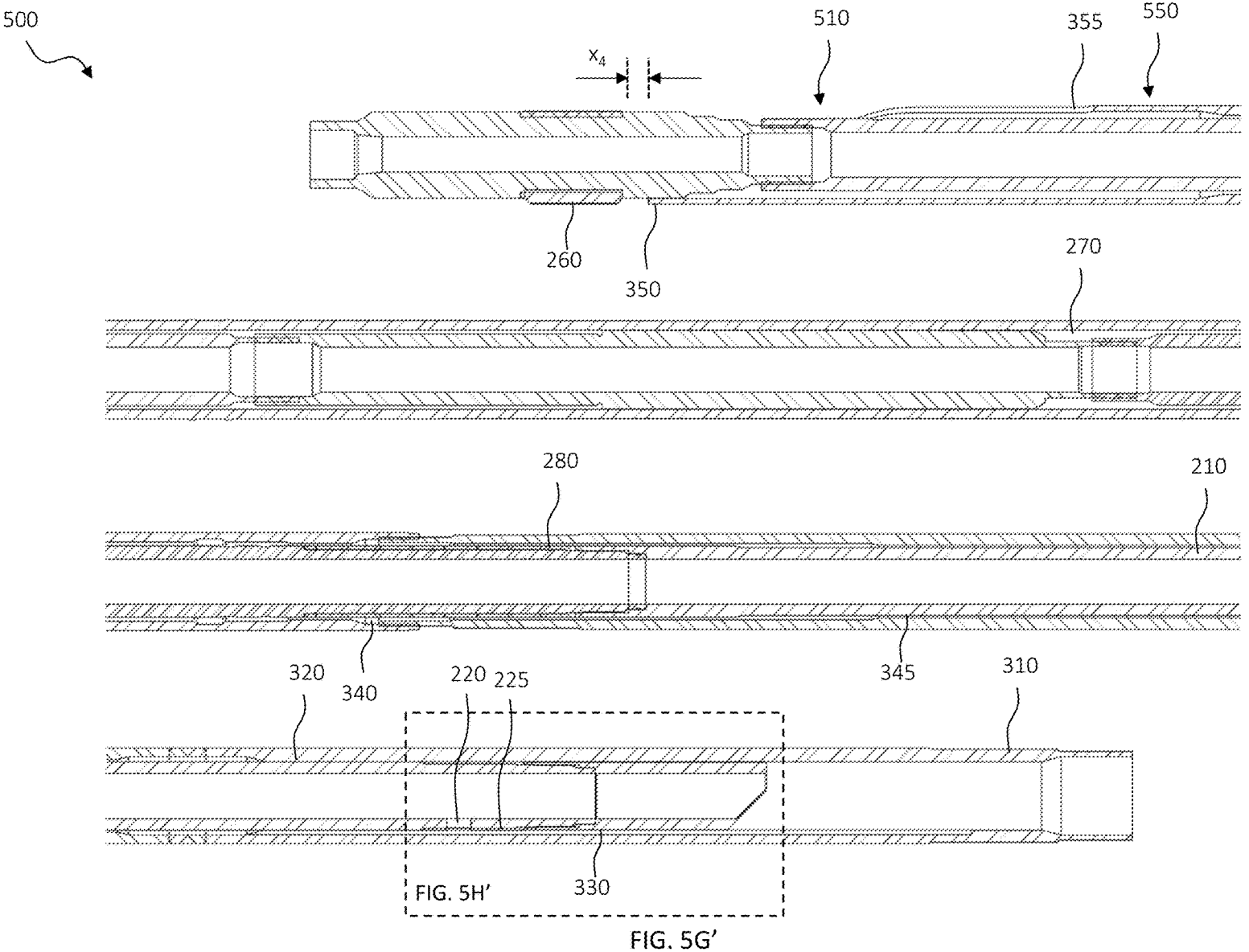
Figure 5H:
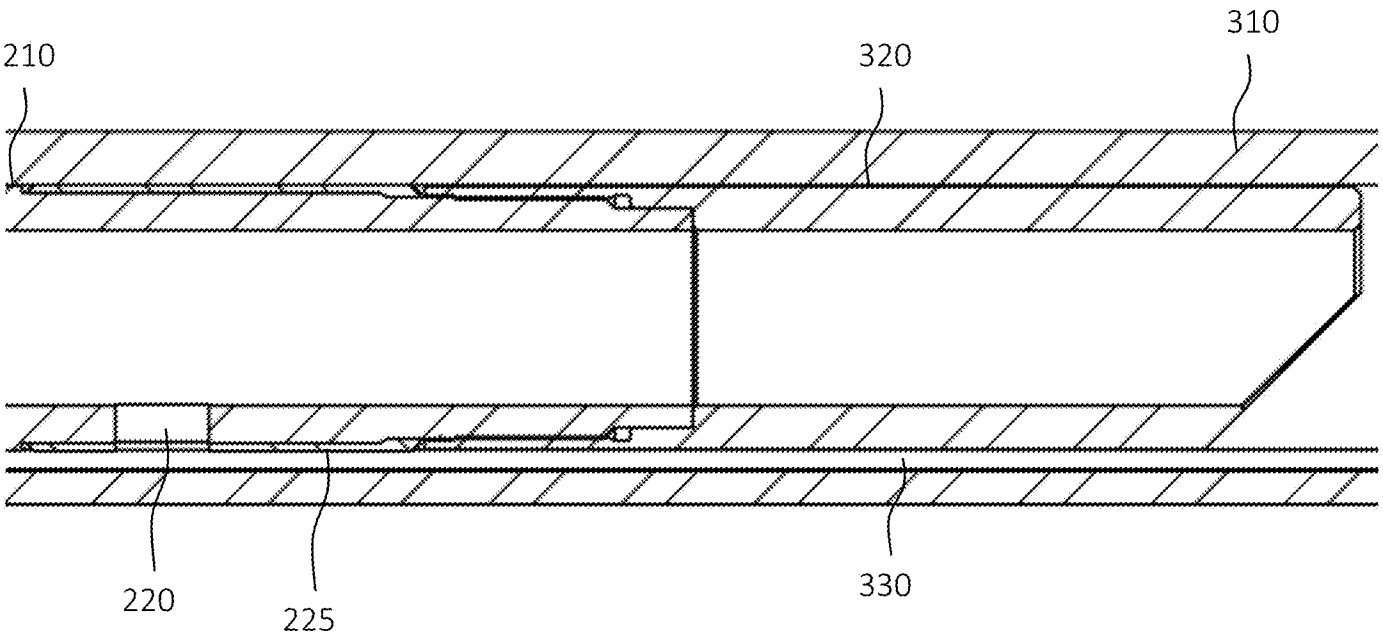
Figures 5G, 5H:
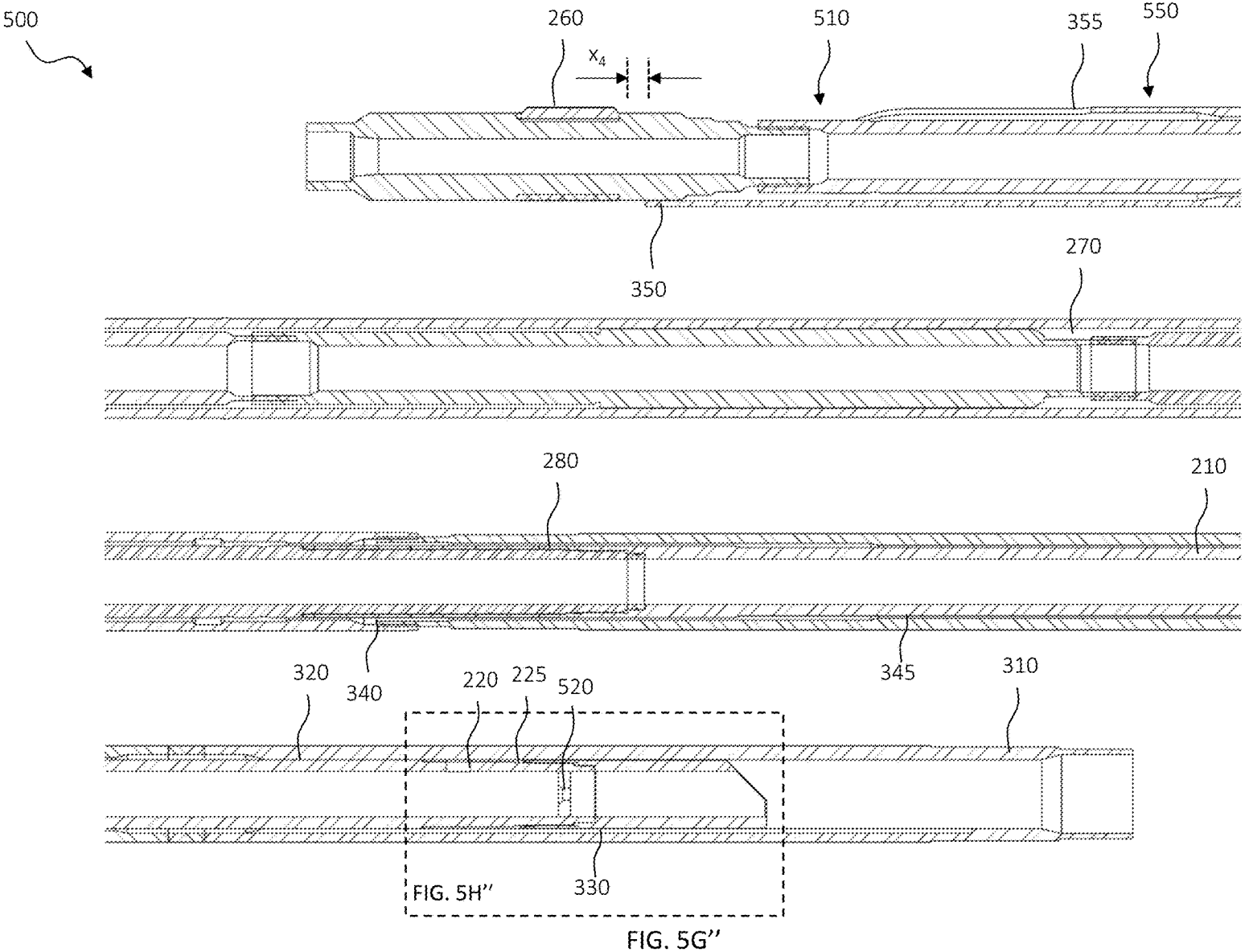
Figure 5H:
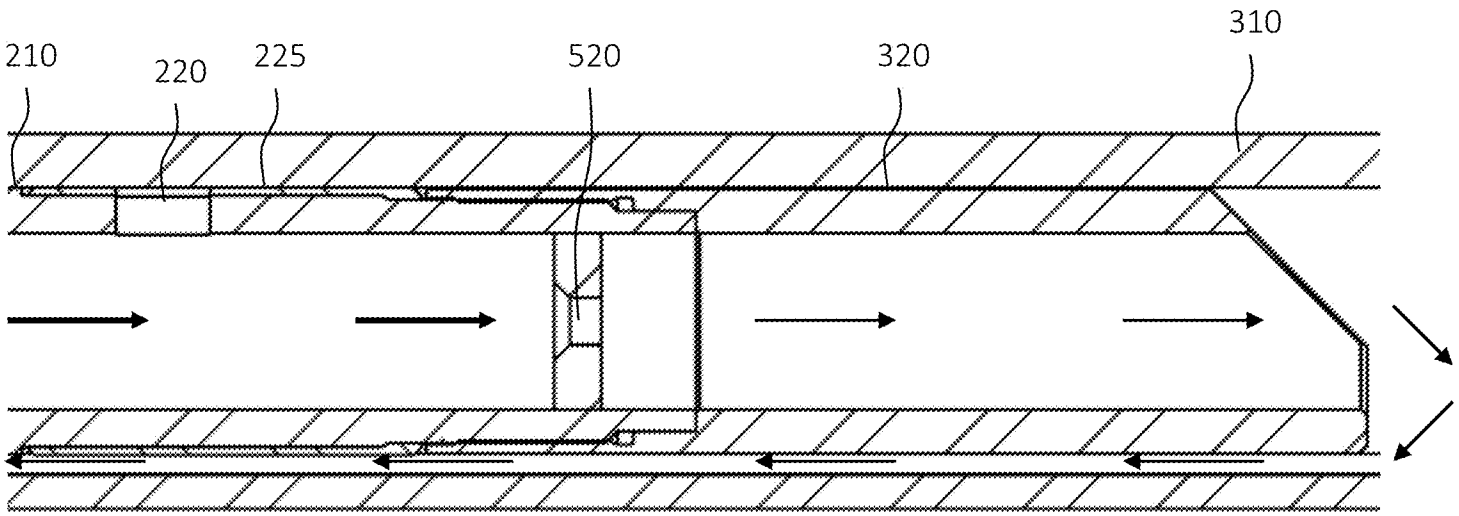
Figures 5G, 5H:
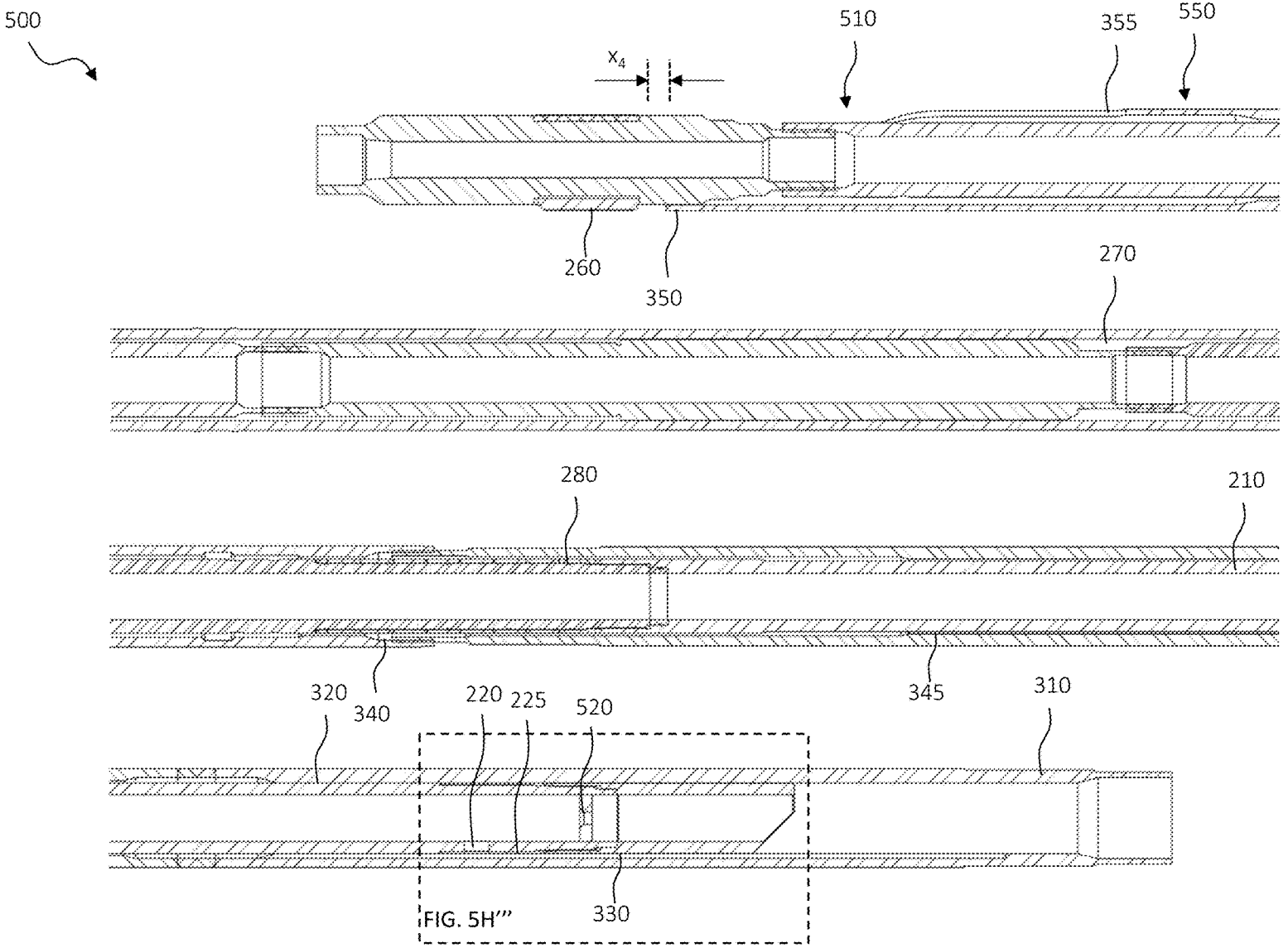
Figure 5H:
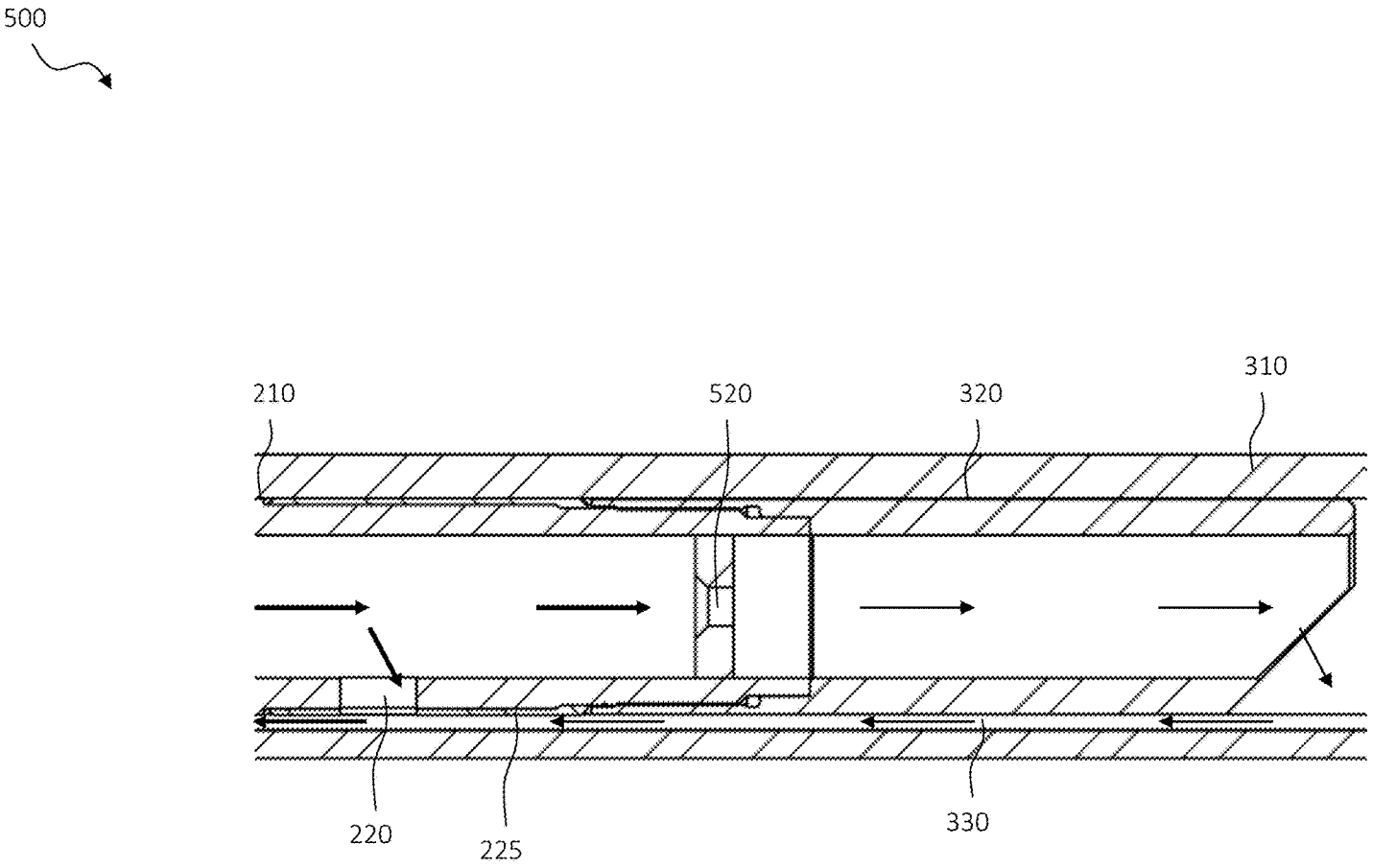
Figure 5I:
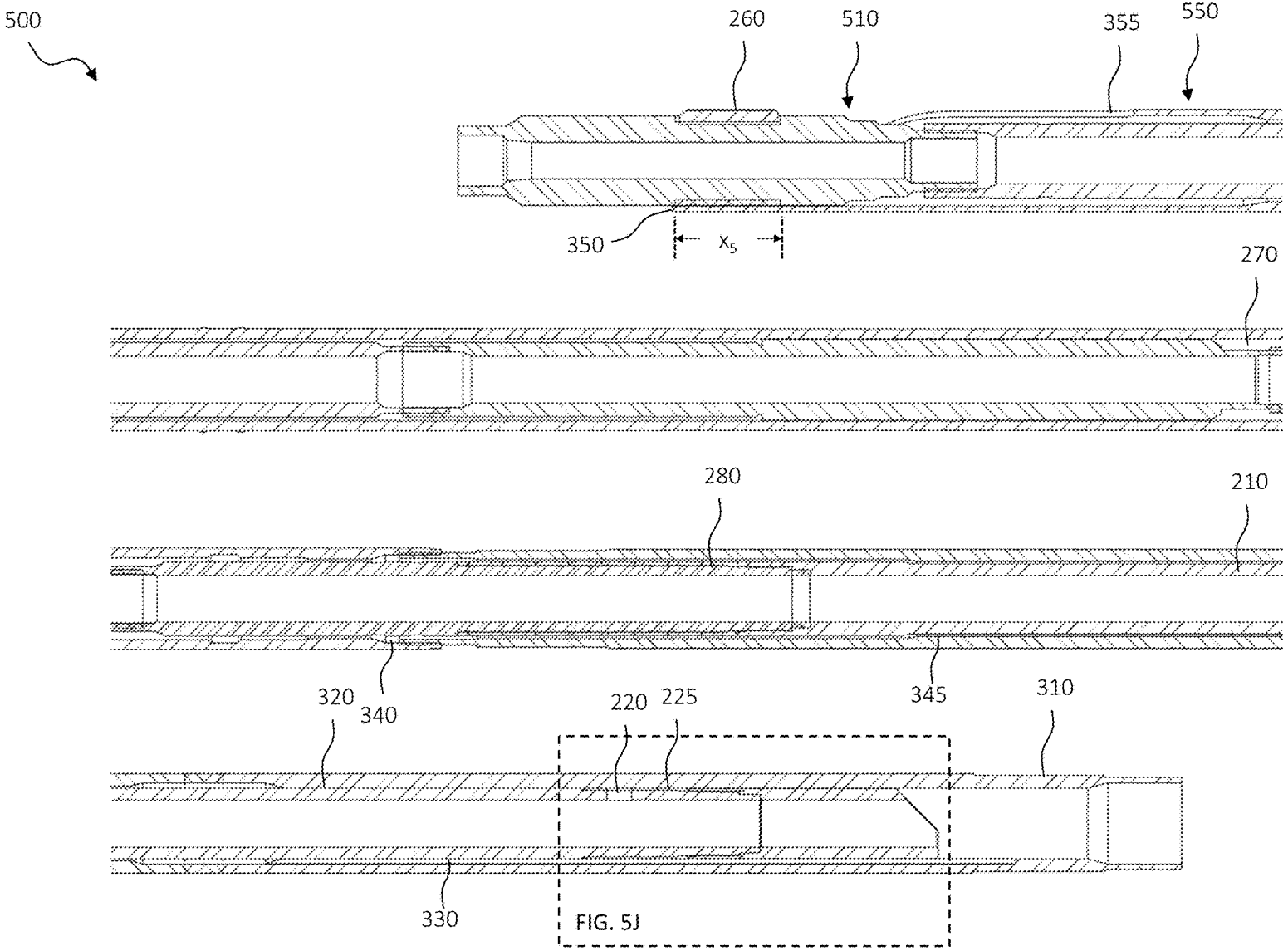
Figure 5J:
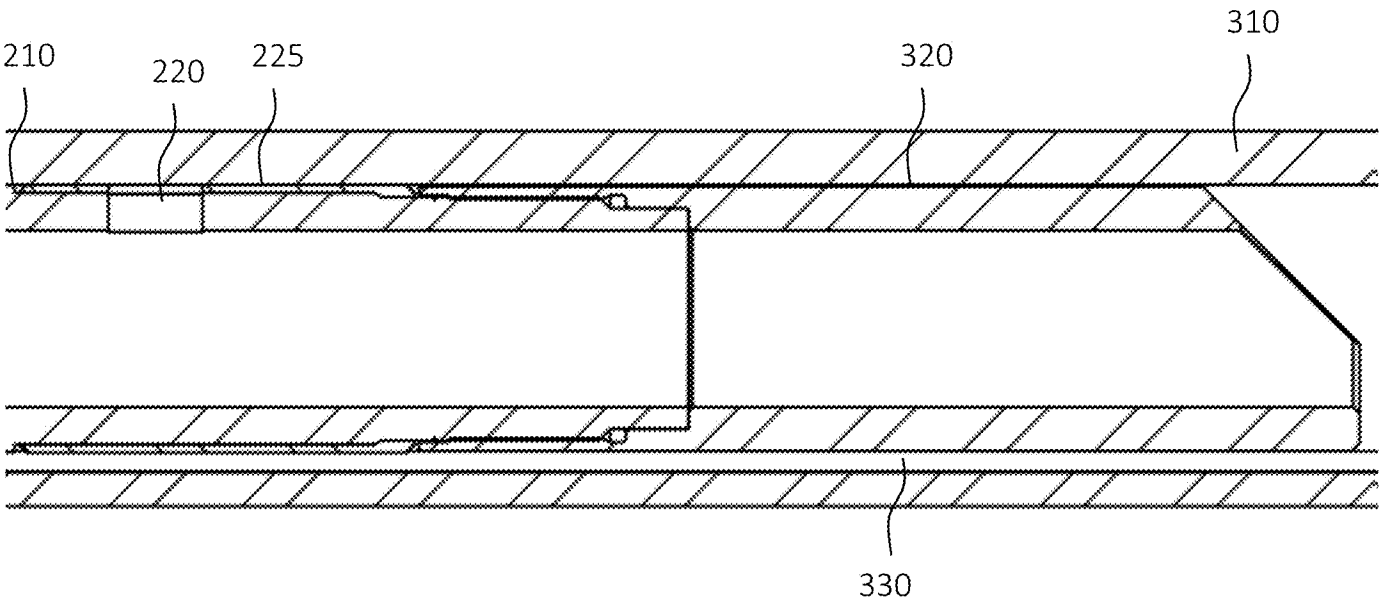
Figure 5K:
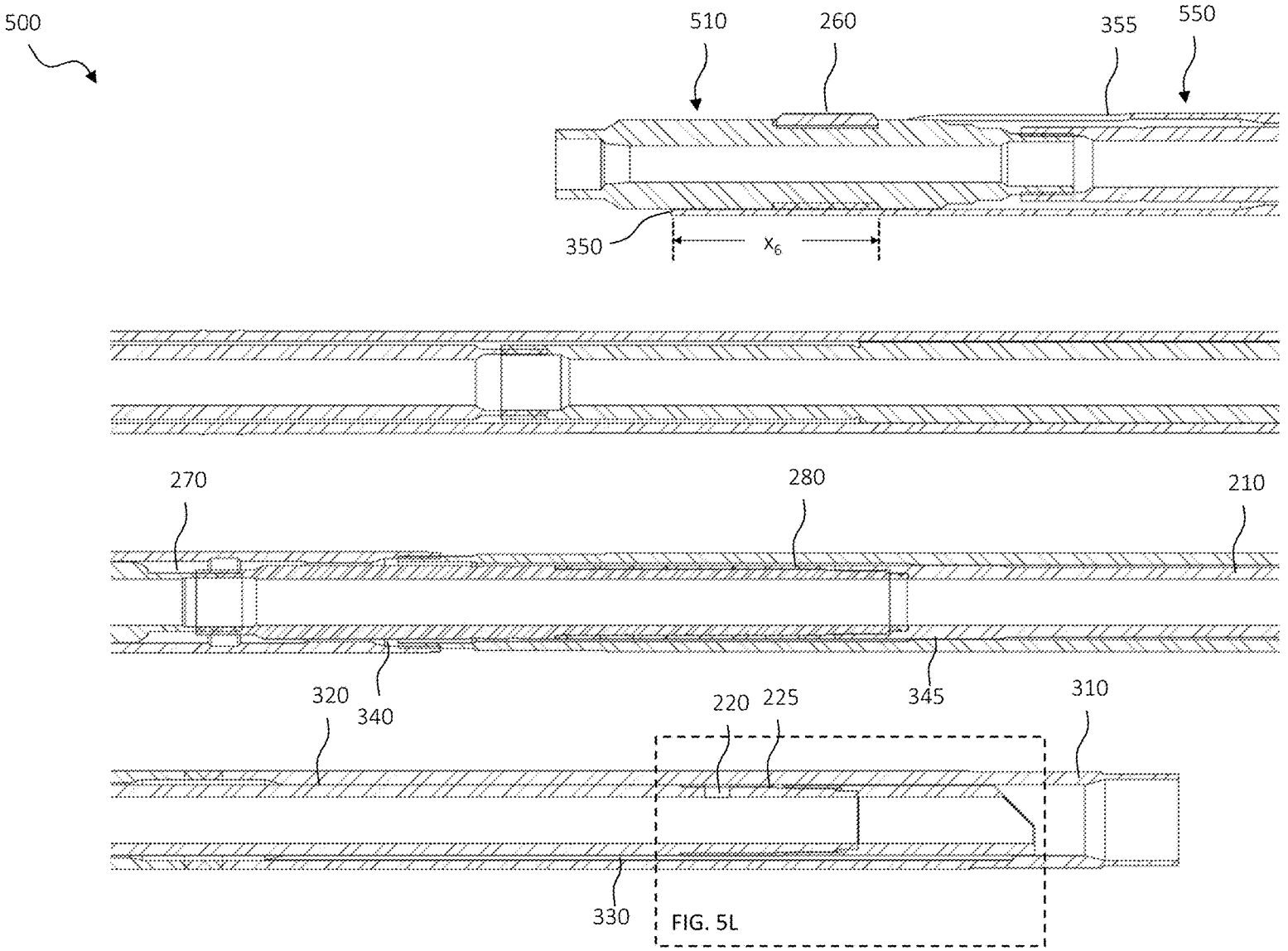
Figure 5L:
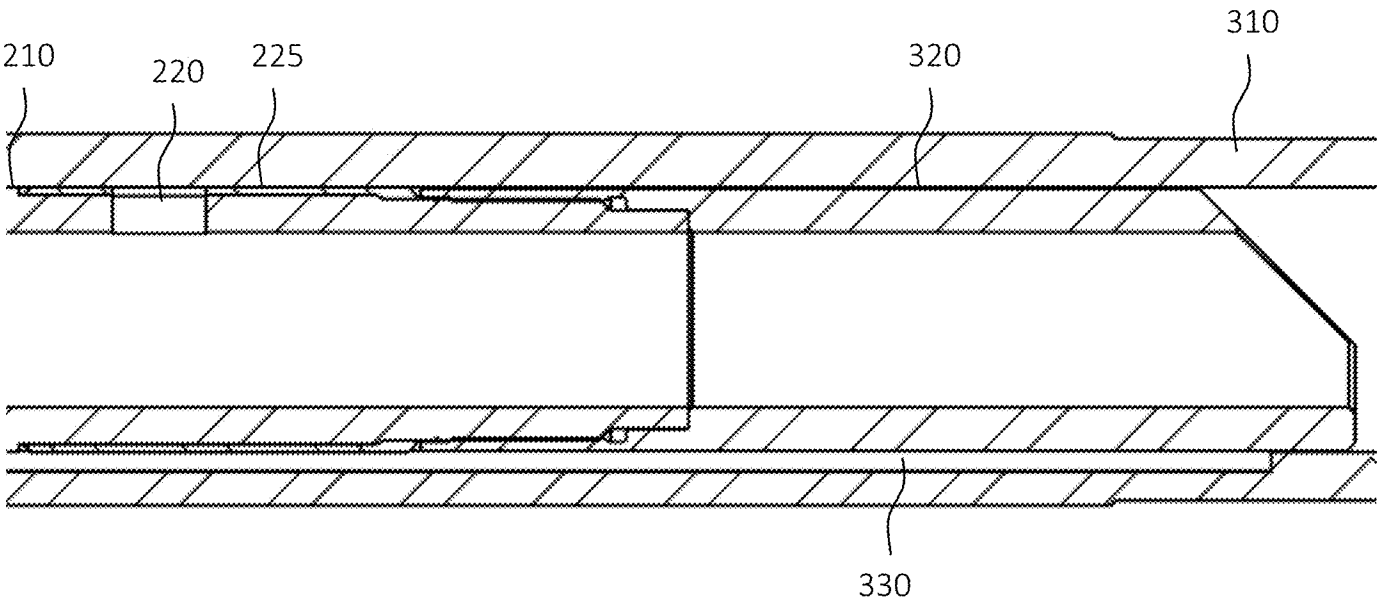
Figure 5M:
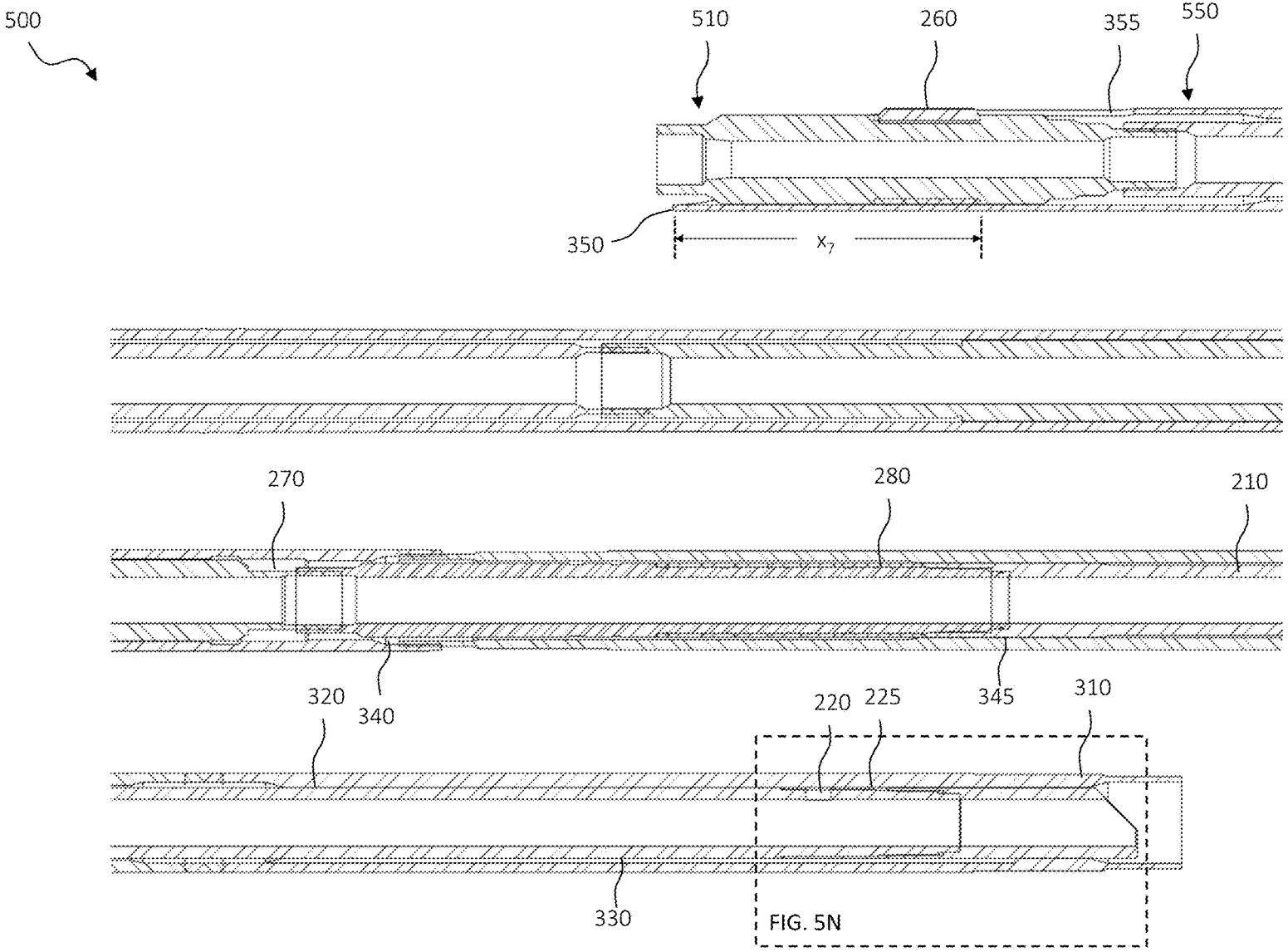
Figure 5N:
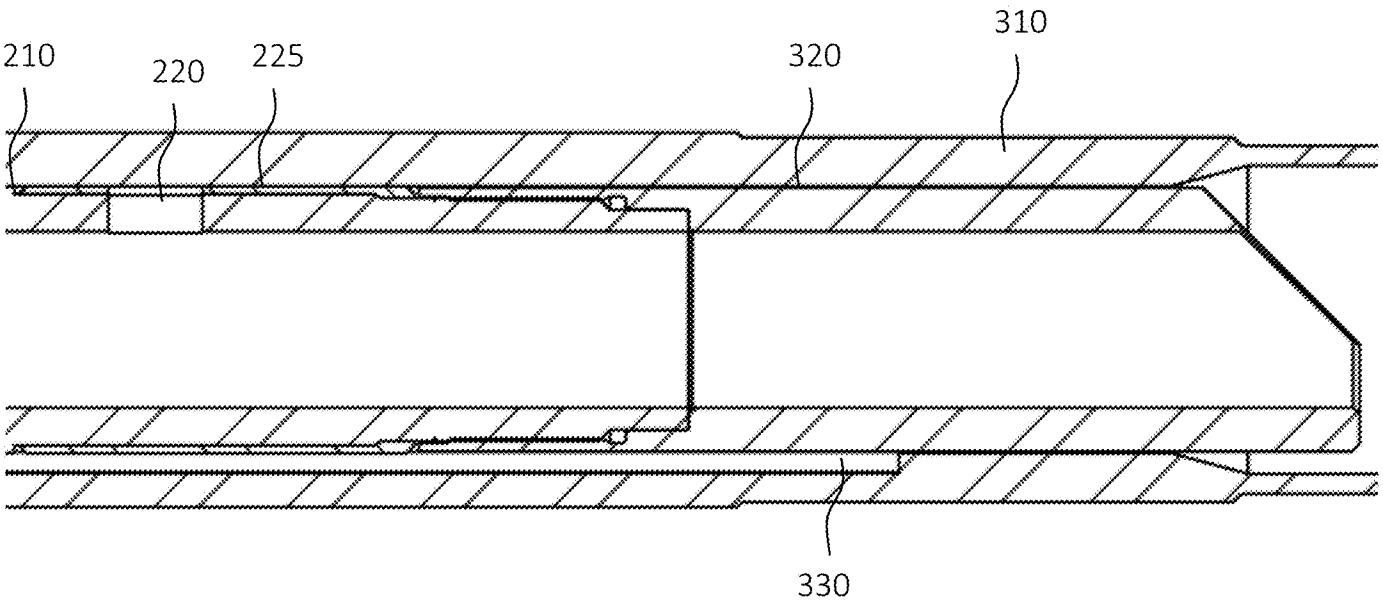
Figure 5O:
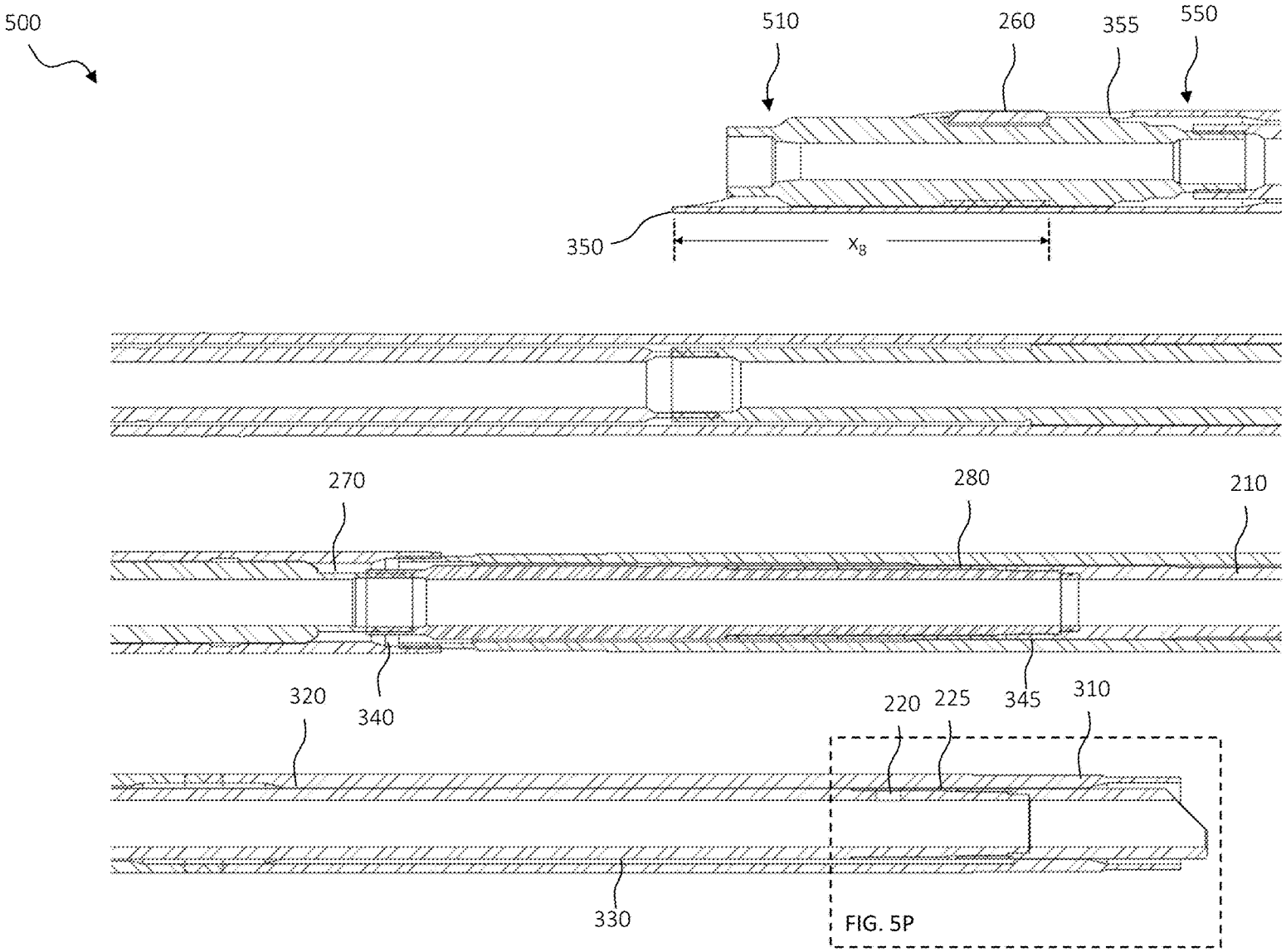
Figure 5P:
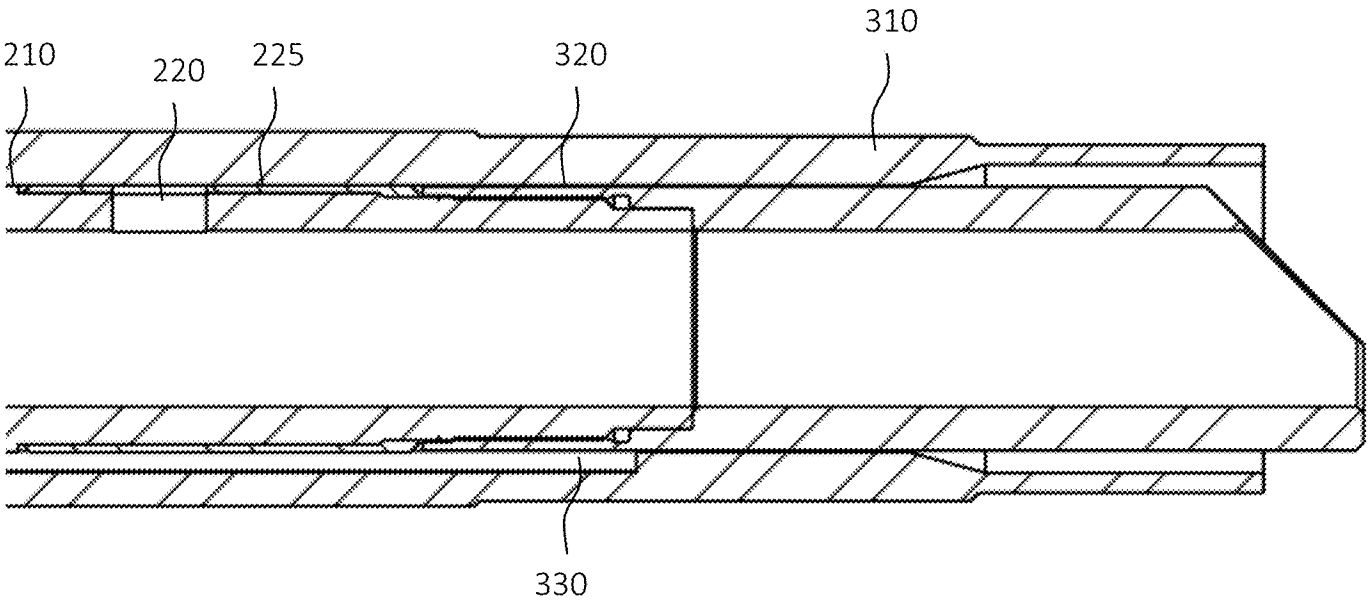

Turning now to FIGS. 5A through 5P, illustrated are various different cross-sectional views of one or more embodiments of a pressure indication alignment system 500 designed, manufactured and/or operated according to one or more embodiments of the disclosure at various different operational stages. In the illustrated embodiment, the pressure indication alignment system 500 includes an inner string 510 and an outer string 550 according to one or more embodiments of the disclosure. The inner string 510 is similar in many respects to the inner string 200 discussed above. Similarly, the outer string 550 is similar in many respects to the outer string 300 discussed above. Accordingly, like reference numbers have been used to illustrate similar, if not identical, features. FIGS. 5A through 5P illustrate the inner string 510 and outer string 550 at different relative positions as the inner string 510 is being insert within the outer string 550.

In accordance with one embodiment of the disclosure, the orientation port 220 is configured to align and/or misalign with the orientation slot 330 to provide a pressure reading indicative of a relative location of the inner tubular 210 to the outer tubular 310. In one embodiment, the orientation port 220 is ultimately axially and rotationally aligned with the orientation slot 330, the axial and rotational alignment configured to provide a pressure drop (or pressure spike) indicative of the relative location of the inner tubular 210 to the outer tubular 310. For example, the axial and rotational alignment may provide a pressure drop indicative of an acceptable rotational placement of the inner tubular 210 to the outer tubular 310, or alternatively the axial and rotational alignment may provide a pressure drop indicative of an unacceptable rotational placement of the inner tubular 210 to the outer tubular 310, depending on the design of the pressure indication alignment system 500. In yet another embodiment, the orientation port 220 is ultimately axially aligned and rotationally misaligned with the orientation slot 330, the axial alignment and rotational misalignment configured to provide a pressure reading indicative of the relative location of the inner tubular 210 to the outer tubular 310. For example, the axial alignment and rotational misalignment may provide a pressure reading indicative of an acceptable rotational placement of the inner tubular 210 to the outer tubular 310, or alternatively the axial alignment and rotational misalignment may provide a pressure reading indicative of an unacceptable rotational placement of the inner tubular 210 to the outer tubular 310, depending on the design of the pressure indication alignment system 500. Ultimately, the detection of a pressure drop, lack of detection of a pressure drop, detection of a pressure spike, or lack of pressure spike (e.g., when the orientation port 220 is ultimately axially aligned with the orientation slot 330) provides valuable information. For example, in at least one embodiment the pressure drops and/or spikes may be used to determine the axial and rotational location of the alignment key relative to the muleshoe (e.g., muleshoe guide slot).

With initial reference to FIGS. 5A and 5B, the inner string 510 has just been insert within the outer string 550, but the orientation port 220 is yet to be axially aligned with the orientation slot 330. For instance, the alignment key 260 is shown a greatest distance ($x_1$) (e.g., 45.72 cm/18 inches in one embodiment) from a tip of the muleshoe 350. Furthermore, the orientation port 220 is located on a high side of the outer string 550, for example, opposite the orientation slot 330. Accordingly, at this stage, the orientation port 220 is axially and rotationally misaligned with the orientation slot 330, which depending on the design could mean an acceptable rotational placement (as shown) or an unacceptable rotational placement (not shown). In this position, flow from inside the orientation port 220 may pass to the annular space therearound with minimal restriction.

Turning briefly to FIGS. 5A' and 5B', illustrated is an alternative orientation of the inner string 510 within the outer string 550, wherein the orientation port 220 is located on a low side of the outer string 550, for example, at least partially rotationally aligned with the orientation slot 330.

With continued reference to FIGS. 5C and 5D, the inner string 510 continues to be insert within the outer string 550, but the orientation port 220 is yet to be axially aligned with the orientation slot 330. For instance, the alignment key 260 is shown a lesser distance ($x_2$) (e.g., 25.4 cm/10 inches in one embodiment) from a tip of the muleshoe 350. In fact, in FIGS. 5C and 5D the orientation port 220, and related orientation seal 225, are axially aligned with the seal surface 320. The orientation port 220 remains located on a high side of the outer string 550, for example, opposite the orientation slot 330. Accordingly, at this stage, the orientation port 220 is axially and rotationally misaligned with the orientation slot 330, which depending on the design could mean an acceptable rotational placement (as shown) or an unacceptable rotational placement (not shown).

In this position, flow from inside the orientation port 220 is blocked from passing to the annular space. This provides a higher-pressure indication at the surface regarding the location of the alignment key 260. As the inner string 510 is continually lowered, flow from inside the orientation port 220 is blocked from passing to the annular space if the alignment key 260 is not aligned with the tip of the muleshoe 350. In the next few cm/inches, if the alignment key 260 becomes aligned with the tip of the muleshoe 350 (e.g., or within +/−5-degrees of the tip), a drop in pressure will occur and be noticed at the surface.

Turning briefly to FIGS. 5C' and 5D', illustrated is an alternative orientation of the inner string 510 within the outer string 550, wherein the orientation port 220 is located on a low side of the outer string 550, for example, at least partially rotationally aligned with the orientation slot 330. In such a situation, the inner tubular 210 would be rotated to assure the user that the inner tubular 210 is outside of the dead zone. In at least one embodiment, to be safe, the user would rotate the inner tubular by an angle greater than the radial angle ($\theta_1$), if not an angle at least 1.5 times the radial angle ($\theta_1$). In certain embodiments, the inner string 510 would be withdrawn uphole a slight amount before rotating the inner tubular 210, and then being run back downhole. Nevertheless, the inner string 510 may be rotated, as discussed, at most any point (e.g., axial location) wherein the orientation port 220 is axially aligned and at least partially rotationally aligned with the orientation slot 330. However, it is advisable to rotate the inner string 510 prior to the orientation port 220 axially passing a downhole end of the orientation slot 330.

With continued reference to FIGS. 5E and 5F, the inner string 510 continues to be insert within the outer string 550, and the alignment key 260 has yet to encounter the muleshoe 350, but the orientation port 220 is now axially aligned with the orientation slot 330. For instance, the alignment key 260 is shown a lesser distance ($x_3$) (e.g., 12.7 cm/5 inches in one embodiment) from a tip of the muleshoe 350. The orientation port 220 remains located on a high side of the outer string 550, for example, opposite the orientation slot 330. Accordingly, at this stage, the orientation port 220 is axially aligned but rotationally misaligned with the orientation slot 330, which depending on the design could mean an acceptable rotational placement (as shown) or an unacceptable rotational placement (not shown). Given that the orientation port 220, and related orientation seal 225, are radially misaligned with the orientation slot 330 (e.g., seal against the inner surface of the outer tubular 310) fluid travelling through the inner tubular 210 will not exit into the orientation slot 330, and thus will not register a pressure drop. In the illustrated embodiment, this information is indicative of an acceptable rotational placement of the inner tubular 210 to the outer tubular 310, and an indication that the inner tubular 210 has missed the dead zone.

Turning briefly to FIGS. 5E' and 5F', illustrated is an alternative orientation of the inner string 510 within the outer string 550, wherein the orientation port 220 is located on a low side of the outer string 550, for example, at least partially rotationally aligned with the orientation slot 330. Given that the orientation port 220, and related orientation seal 225, are rotationally aligned with the orientation slot 330 (e.g., do not seal against the inner surface of the outer tubular 310) a certain amount of the fluid travelling through the inner tubular 210 will exit into the orientation slot 330, and thus will register a pressure drop. In the illustrated embodiment, this information is indicative of an unacceptable rotational placement of the inner tubular 210 to the outer tubular 310, and an indication that the inner tubular 210 may be within the dead zone. Again, if the inner string 510 were still located in the dead zone at this axial location, it would be advisable to rotate it.

With continued reference to FIGS. 5G and 5H, the inner string 510 continues to be insert within the outer string 550, and the alignment key 260 has yet to encounter the muleshoe 350, but the orientation port 220 is now axially aligned with the orientation slot 330. For instance, the alignment key 260 is shown a lesser distance ($x_4$) (e.g., 4.064 cm/1.6 inches in one embodiment) from a tip of the muleshoe 350. The orientation port 220 remains located on a high side of the outer string 550, for example, opposite the orientation slot 330. Accordingly, at this stage, the orientation port 220 is axially aligned but rotationally misaligned with the orientation slot 330, which depending on the design could mean an acceptable rotational placement (as shown) or an unacceptable rotational placement (not shown). Given that the orientation port 220, and related orientation seal 225, are radially misaligned with the orientation slot 330 (e.g., seal against the inner surface of the outer tubular 310) fluid travelling through the inner tubular 210 will not exit into the orientation slot 330, and thus will not register a pressure drop. In the illustrated embodiment, this information is indicative of an acceptable rotational placement of the inner tubular 210 to the outer tubular 310, and an indication that the inner tubular 210 has missed the dead zone.

Turning briefly to FIGS. 5G' and 5H', illustrated is an alternative orientation of the inner string 510 within the outer string 550, wherein the orientation port 220 is located on a low side of the outer string 550, for example, at least partially rotationally aligned with the orientation slot 330. Given that the orientation port 220, and related orientation seal 225, are rotationally aligned with the orientation slot 330 (e.g., do not seal against the inner surface of the outer tubular 310) a certain amount of the fluid travelling through the inner tubular 210 will exit into the orientation slot 330, and thus will register a pressure drop. In the illustrated embodiment, this information is indicative of an unacceptable rotational placement of the inner tubular 210 to the outer tubular 310, and an indication that the inner tubular 210 may be within the dead zone. Again, if the inner string 510 were still located in the dead zone at this axial location, it would be advisable to rotate it, as the alignment key 260 is approaching the muleshoe 350.

Turning briefly to FIGS. 5G" through 5H"', illustrated is an alternative embodiment of the inner string 510 of FIGS. 5G through 5H'. In one or more embodiment it may be desirable to optimize the flow parameters to create a desired effect. For example, as shown in this embodiment, a flow restrictor 520 has been placed in the inner string 510 below the orientation port 220. The flow restrictor 520 may have a smaller flow area which, at a constant flow rate, will cause a higher pressure drop across the orifice. This means a higher pressure will exist above the flow restrictor 520 when the orientation port 220 is misaligned with the orientation slot 330 (e.g., as shown in FIGS. 5G" and 5H"). Hence, when the orientation port 220 becomes aligned with the orientation slot 330 (e.g., as shown in FIGS. 5G"' and 5H"'), a larger decrease in pressure will occur which may be easier to notice at the surface (drilling rig floor). This is especially helpful in deeper wells where circulation pressures (due to friction) are higher and a higher decrease in pressure would be more noticeable.

The flow restrictor 520 may be one or more types of flow restrictors known in the industry, including, but not limited to, frangible discs, rupture discs (e.g., tantalum rupture discs) dissolvable plugs/nozzles (e.g., ceramic nozzles), expendable restrictors, disappearing tubing hanger plugs, inflow control devices (ICDs), ball valves, mechanically-removable plugs/nozzles, etc.

With continued reference to FIGS. 5I and 5J, the inner string 510 continues to be insert within the outer string 550, including allowing the alignment key 260 to enter into the muleshoe 350. For instance, the alignment key 260 is shown a distance ($x_5$) (e.g., 15.24 cm/6 inches in one embodiment) past the tip of the muleshoe 350. Given the knowledge provided by the pressure indication alignment system 500, the user may be confident that the inner string 510 is not within the dead zone. In the illustrated embodiment, the orientation port 220 remains located on a high side of the outer string 550, for example, opposite the orientation slot 330.

With continued reference to FIGS. 5K and 5L, the inner string 510 continues to be insert within the outer string 550, including allowing the alignment key 260 to further enter into the muleshoe 350. For instance, the alignment key 260 is shown a distance ($x_6$) (e.g., 30.48 cm/12 inches in one embodiment) past the tip of the muleshoe 350. It should be noted that in FIG. 5K the production seals 280 have not entered into the production seal bore 345 (e.g., 14.48 cm/5.7 inch from seal bore). This feature may be desirable in some embodiments. For example, if the production seals 280 were already engaged in the production seal bore 345, the pressure-drop would not be possible due to the production seals 280 sealing. Given the knowledge provided by the pressure indication alignment system 500, the user may be confident that the inner string 510 is not within the dead zone. In the illustrated embodiment, the orientation port 220 remains located on a high side of the outer string 550, for example, opposite the orientation slot 330.

With continued reference to FIGS. 5M and 5N, the inner string 510 continues to be insert within the outer string 550, including allowing the alignment key 260 to enter into the muleshoe guide slot 355 of the muleshoe 350. For instance, the alignment key 260 is shown a distance ($x_7$) (e.g., 45.72 cm/18 inches in one embodiment) past the tip of the muleshoe 350. Given the knowledge provided by the pressure indication alignment system 500, the user may be confident that the inner string 510 is not within the dead zone. It should be noted that in FIG. 5M the production seals 280 have just began to enter into the production seal bore 345. This feature may be desirable in some embodiments because as the production seals 280 enter the production seal bore 345, the flow from below will be cut off and a larger pressure increase at surface will be seen. In addition, the user now has the opportunity to pressure-test the production seals 280 to ensure they will hold pressure during the upcoming production of hydrocarbons (or during the next phase which is production of the well). In the illustrated embodiment, the orientation port 220 remains located on a high side of the outer string 550, for example, opposite the orientation slot 330.

In this position, flow from inside the orientation port 220 continues to be blocked from passing to the annular space and continues to provide a higher-pressure indication at the surface regarding the location of the alignment key 260. However, alignment key 260 has entered the muleshoe guide slot 355, thus orientation port 220 has performed its intended purpose. In some embodiments, the distal end of orientation slot 330 could be terminated at this point. Again, many embodiments could be utilized to attain a pressure-change at surface while the assembly is moving towards/into the latched position.

With continued reference to FIGS. 5O and 5P, the inner string 510 continues to be insert within the outer string 550, including allowing the alignment key 260 to fully enter (e.g., land) into the muleshoe guide slot 355 of the muleshoe 350. For instance, the alignment key 260 is shown a distance ($x_8$) (e.g., 55.88 cm/22 inches in one embodiment) past the tip of the muleshoe 350. At this stage, the latch mechanism 270 of the inner string 510 may engage with a latch profile 340 in the outer string 520, thereby axially fixing the two. While the embodiments of FIGS. 5A through 5P discuss the use of a single orientation port 220 in the inner string 510, other embodiments may exist wherein multiple orientation ports may be used separately or in conjunction with the orientation slot 330.

Figure 6A:
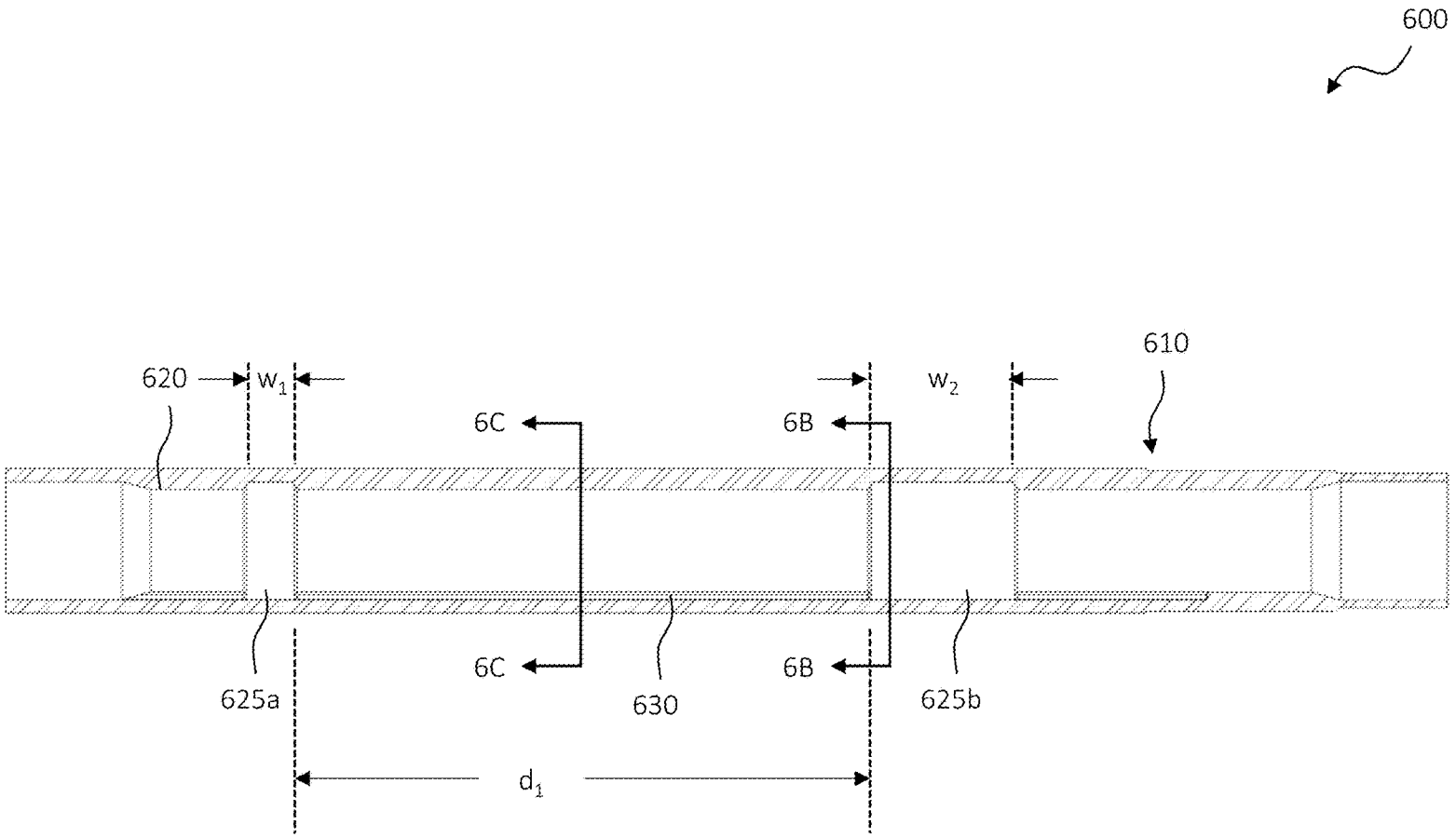
FIGS. 6A through 6C illustrate various different cross-sectional views of an alternative embodiment of an outer string designed, manufactured and/or operated according to one or more alternative embodiments of the disclosure.
Figure 6C:
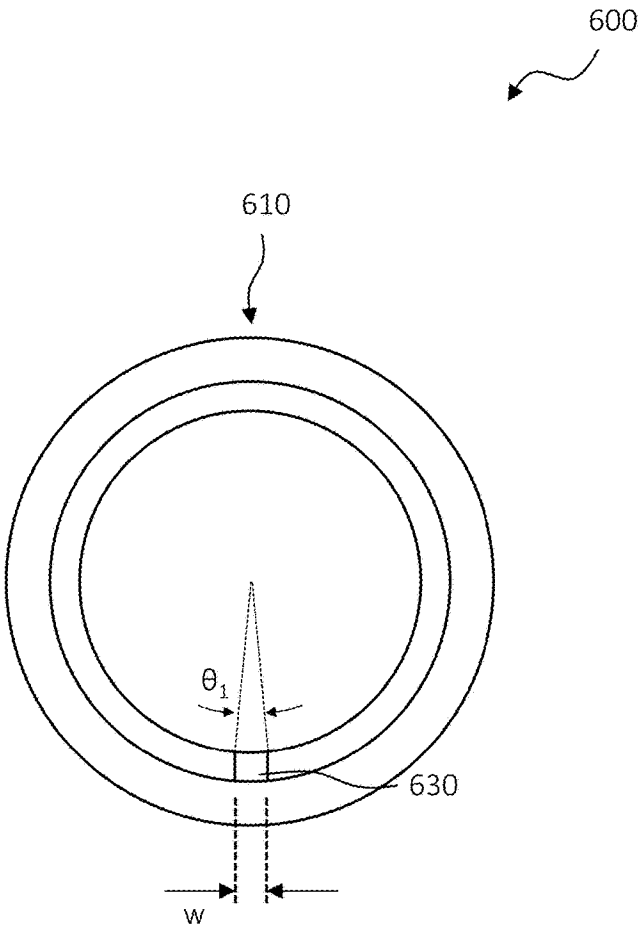
Figure 6B:
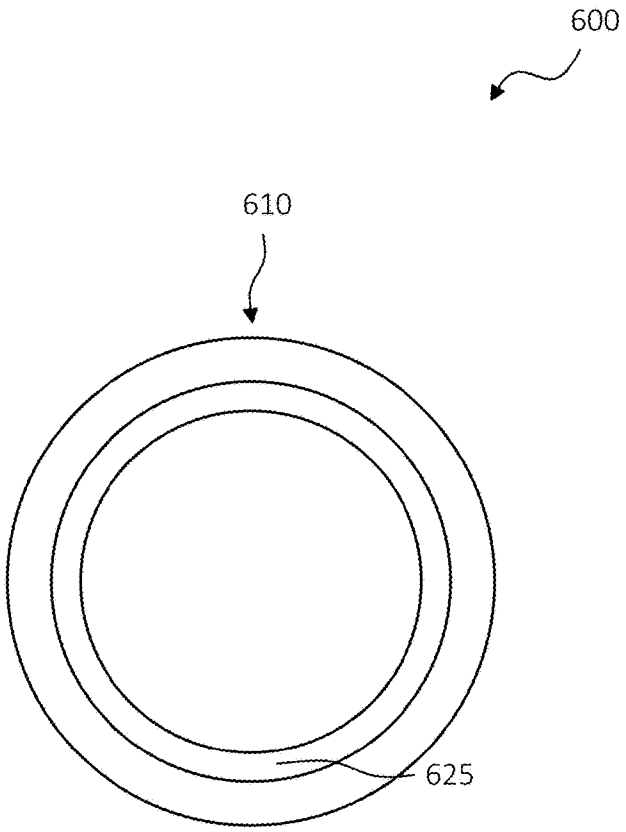

Turning to FIGS. 6A through 6C, illustrated are various different cross-sectional views of an alternative embodiment of an outer string 600 designed, manufactured and/or operated according to one or more alternative embodiments of the disclosure. The outer string 600, in the illustrated embodiment, includes an outer tubular 610 configured to extend at least partially around an inner tubular (e.g., inner tubular 210 of FIG. 2). In the illustrated embodiment, the outer tubular 610 includes one or more seal surfaces 620 (e.g., one or more non-continuous seal bores).

The outer string 600, in accordance with this embodiment, further includes two or more radial orientation slots 625*a* . . . 625*n* (e.g., two radial orientation slots 625*a*, 625*b* illustrated in FIG. 6A) located along an inside surface of the outer tubular 610. In the illustrated embodiment, the two radial orientation slots 625*a*, 625*b* are offset from one another by a distance ($d_1$), and are configured to align with an orientation port (e.g., orientation port 220) in the inner tubular (e.g., inner tubular 210) that it is configured to engage with. Accordingly, the two radial orientation slots 625*a*, 625*b* may provide two pressure readings indicative of a relative location (e.g., relative axial location) of the inner tubular to the outer tubular 610. For example, the two radial orientation slots 625*a*, 625*b*, in at least one embodiment, would provide a pair of pressure pulses (e.g., different value pressure pulses) to indicate the axial location of the orientation port (e.g., orientation port 220) that is passing therethrough, and thus function as axial indicators.

In at least one embodiment, a first of the two radial orientation slots 625*a* has a first width ($w_1$) and a second of the two radial orientation slots 625*b* has a second width ($w_2$). Further to this embodiment, the first radial orientation slot 625*a* may be uphole of the second radial orientation slot 625*b*, and the second width ($w_2$) is greater than the first width ($w_1$). In at least one embodiment, the second width ($w_2$) is at least 3 times the first width ($w_1$). In yet another embodiment, the distance ($d_1$) is at least 4 times the second width ($w_2$). Given the foregoing, one embodiment exists wherein the first width ($w_1$) is 5.08 cm (e.g., 2 inches) the second width ($w_2$) is 15.24 cm (e.g., 6 inches) and the distance ($d_1$) is 60.96 cm (e.g., 24 inches). Nevertheless, other values may exist for the first width ($w_1$), the second width ($w_2$), and the distance ($d_1$).

In the illustrated embodiment, the first and second radial orientation slots 625*a*, 625*b* extend 360 degrees around the inside surface of the outer tubular 610. Other embodiments may exist, as discussed below, wherein the first and second radial orientation slots 625*a*, 625*b* each extend less than 360 degrees around the inside surface of the outer tubular 610 (e.g., the first and second radial orientation slots 625*a*, 625*b* each extend 90 degrees or less around the inside surface of the outer tubular 610). Further to the embodiment of FIGS. 6A through 6C, the outer string 600 may additionally include a longitudinal orientation slot 630 located along the inside surface of the outer tubular 610. In the illustrated embodiment, the longitudinal orientation slot 630 connects the first and second radial orientation slots 625*a*, 625*b*, and may be similar in many respects to the longitudinal orientation slot 330 of FIG. 3.

Turning now to FIGS. 7A through 7F, illustrated are various different cross-sectional views of one embodiment of a pressure indication alignment system 700 designed, manufactured and/or operated according to one or more embodiments of the disclosure at various different operational stages. In the illustrated embodiment, the pressure indication alignment system 700 includes an inner string 710 and an outer string 750 according to one or more embodiments of the disclosure. The inner string 710 is similar in many respects to the inner string 200 discussed above. Similarly, the outer string 750 is similar in many respects to the outer string 600 discussed above. Accordingly, like reference numbers have been used to illustrate similar, if not identical, features. FIGS. 7A through 7F illustrate the inner string 710 and outer string 750 at different relative positions as the inner string 710 is being insert within the outer string 750.

In accordance with one embodiment of the disclosure, the orientation port 220 is configured to align and/or misalign with the radial orientation slots 625*a*, 625*b* to provide a pressure reading indicative of a relative location of the inner string 710 to the outer string 750. In one embodiment, the orientation port 220 is ultimately axially and rotationally aligned with the first radial orientation slot 625*a*, the axial and rotational alignment with the first radial orientation slot 625*a* configured to provide a first pressure drop indicative of a first relative location of the inner string 710 to the outer string 750. In at least one embodiment, the first relative location is a first axial relative location. In one embodiment, the orientation port 220 is ultimately axially and rotationally aligned with the second radial orientation slot 625*b*, the axial and rotational alignment with the second radial orientation slot 625*b* configured to provide a second pressure drop indicative of a second relative location of the inner string 710 to the outer string 750. In at least one embodiment, the second relative location is a second axial relative location. Ultimately, the detection of the first pressure drop and/or second pressure drop, or lack thereof, may be used to position the inner string 710 and outer string 750 relative to one another, and thus provides valuable information. As discussed above, the orientation slot 630 may be used to determine a relative rotational alignment of the inner string 710 to the outer string 750.

Figure 7A:
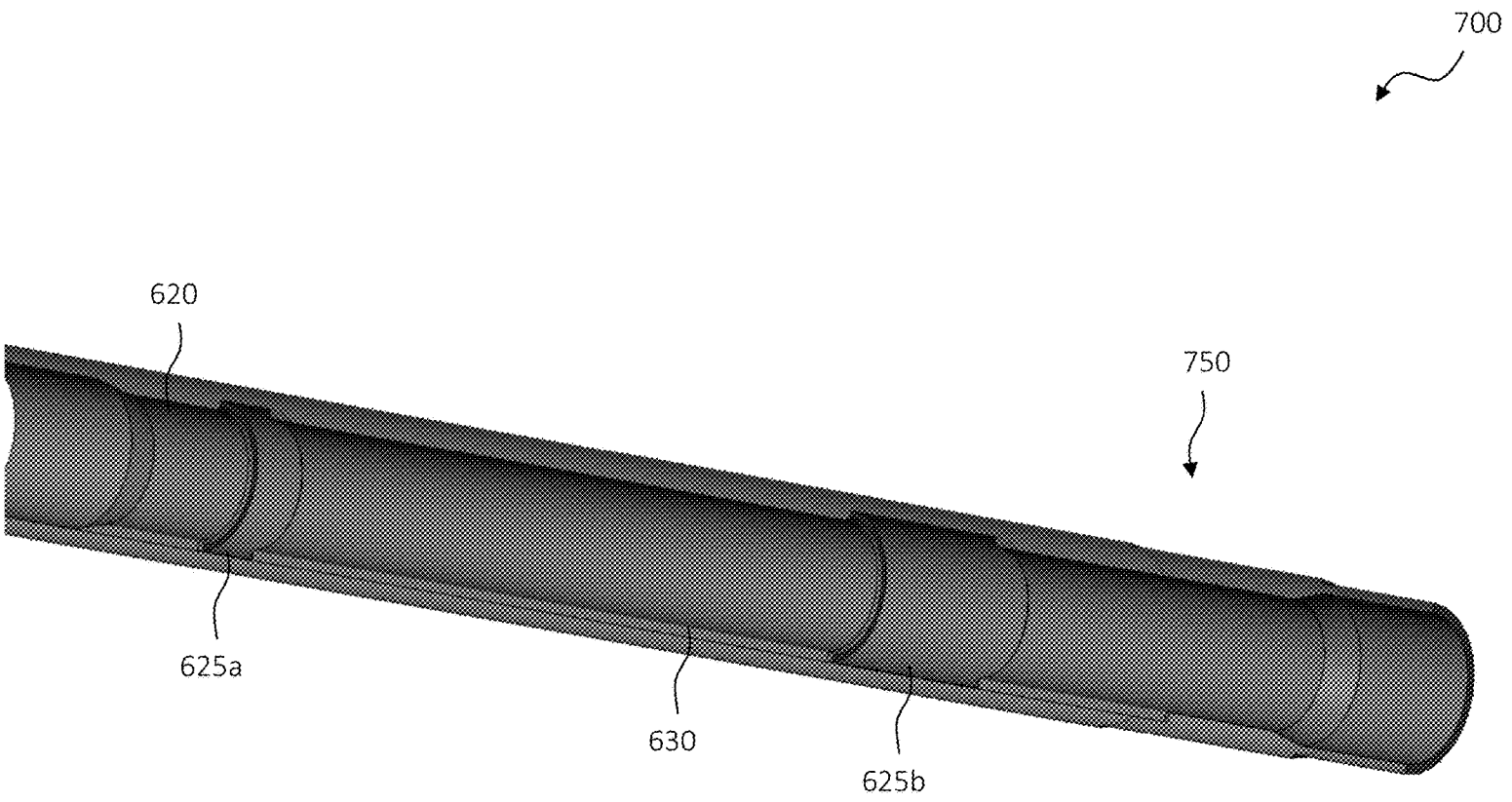
FIGS. 7A through 7F illustrate various different cross-sectional views of one embodiment of a pressure indication alignment system designed, manufactured and/or operated according to one or more embodiments of the disclosure at different relative positions as the inner string is being insert within the outer string.

With initial reference to FIG. 7A, the inner string 710 has yet to be insert within the outer string 750.

Figure 7B:
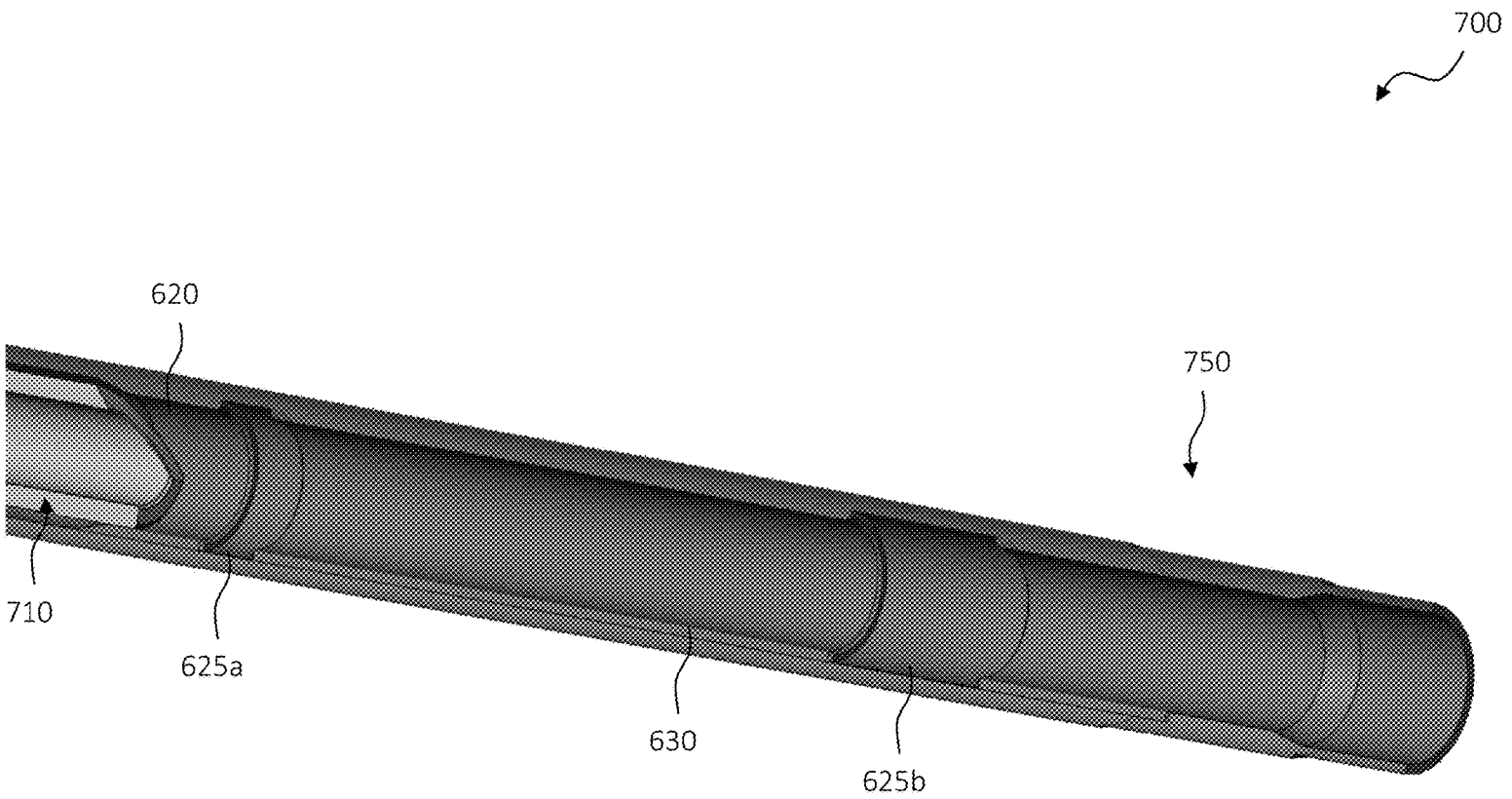

Turning to FIG. 7B, the inner string 710 has just been insert within the outer string 750, but the orientation port 220 is yet to be axially aligned with the first radial orientation slot 625*a*. Accordingly, at this stage, the orientation port 220 is axially misaligned with the first and second radial orientation slots 625*a*, 625*b*, which depending on the design could mean an acceptable rotational placement (as shown) or an unacceptable rotational placement (not shown).

Figure 7C:
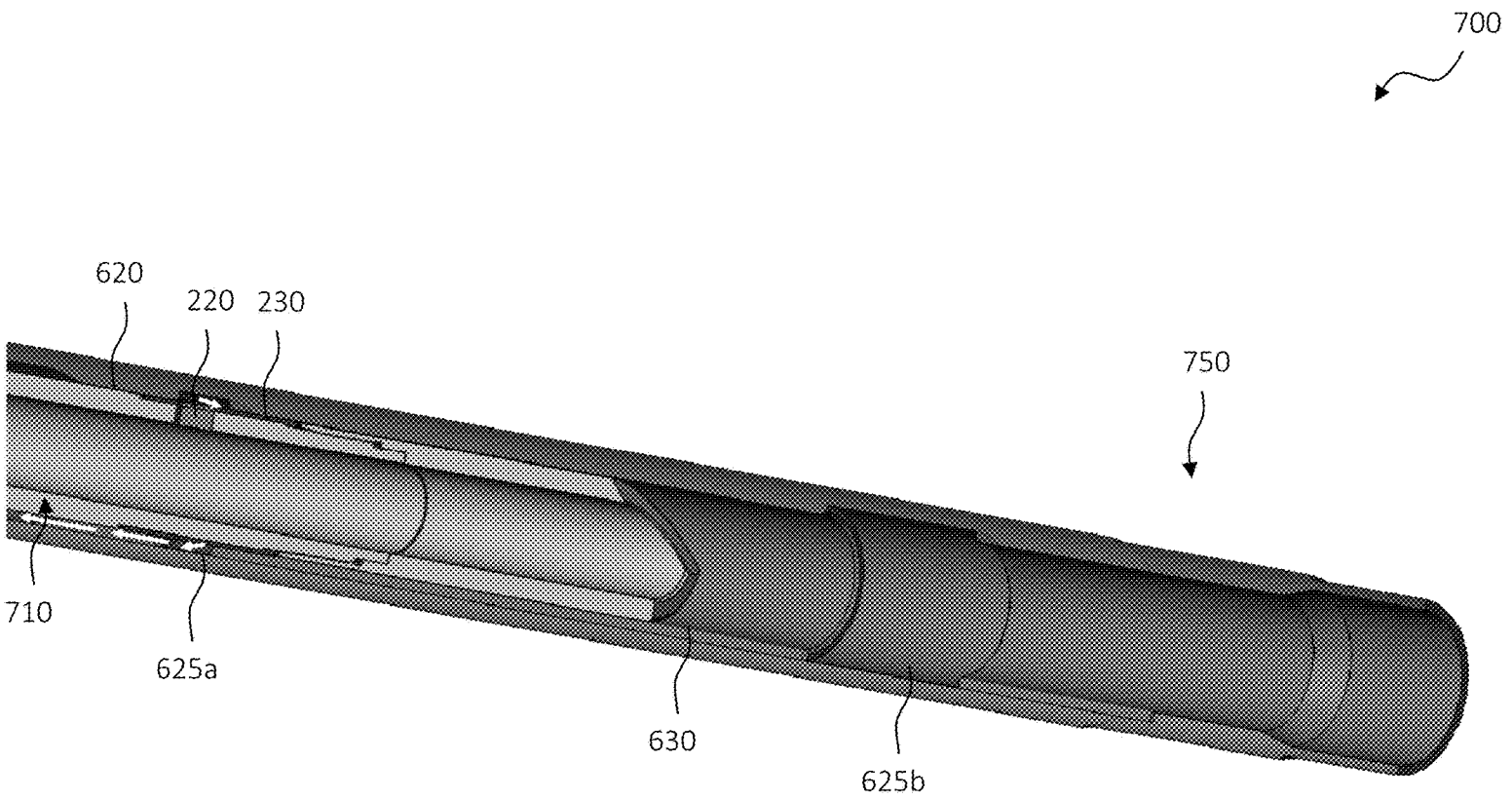

Turning to FIG. 7C, the inner string 710 continues to be insert within the outer string 750, and the orientation port 220 is axially aligned with the first radial orientation slot 625*a*. Given that the orientation port 220, and related orientation seal 225, are rotationally aligned with the first radial orientation slot 625*a* (e.g., do not seal against the inner surface of the outer tubular) a certain amount of the fluid travelling through the inner string 710 will exit into the first radial orientation slot 625*a*, and the longitudinal orientation slot 630 when used, and thus will register a first pressure drop. In the illustrated embodiment, this information is indicative of a known axial placement of the inner string 710 to the outer string 750.

Figure 7D:
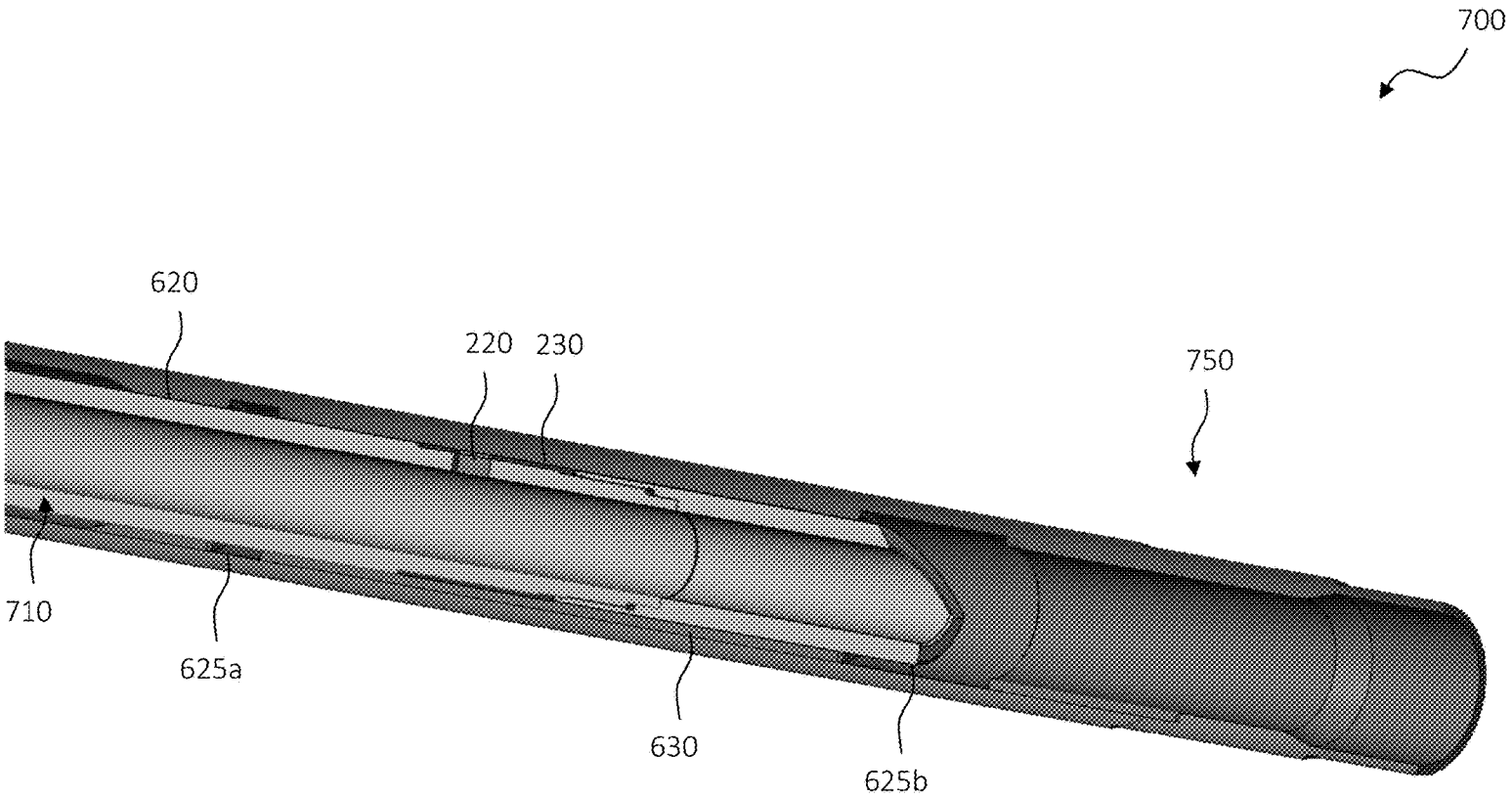

Turning to FIG. 7D, the inner string 710 continues to be insert within the outer string 750, and the orientation port 220 is located between the first radial orientation slot 625*a* and the second radial orientation slot 625*b*. While this may provide little axial location information (e.g., other that the orientation port 220 is between the first radial orientation slot 625*a* and the second radial orientation slot 625*b*), the existence of the longitudinal orientation slot 630, and the rotational location of the orientation port 220 relative thereto, may be used to provide rotational location information, as discussed above with regard to FIGS. 5A through 5P.

Figure 7E:
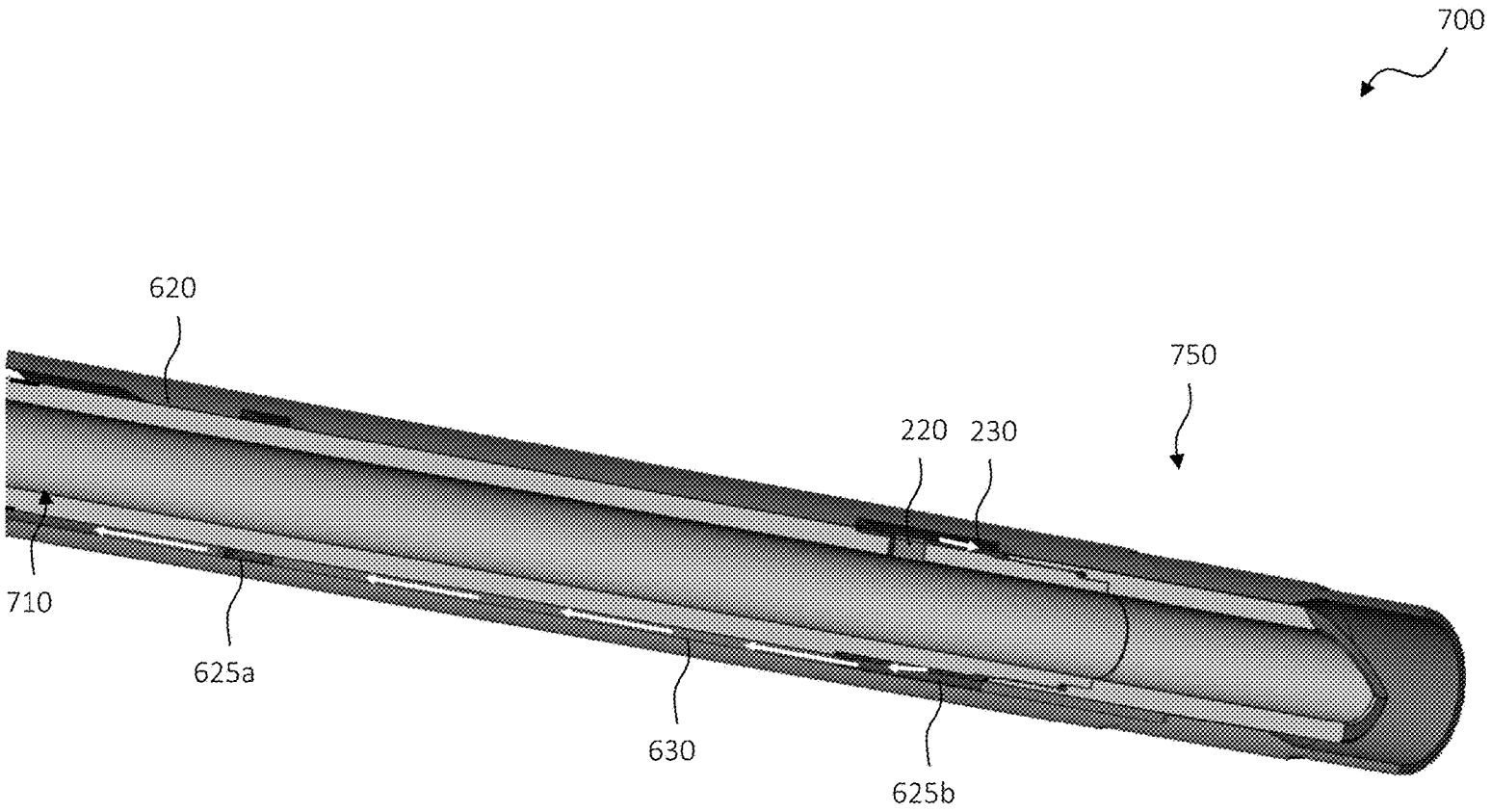

Turning to FIG. 7E, the inner string 710 continues to be insert within the outer string 750, and the orientation port 220 is axially aligned with the second radial orientation slot 625*b*. Given that the orientation port 220, and related orientation seal 225, are axially aligned with the second radial orientation slot 625*b* (e.g., do not seal against the inner surface of the outer tubular) a certain amount of the fluid travelling through the inner string 710 will exit into the second radial orientation slot 625*b*, and the longitudinal orientation slot 630 when used, and thus will register a second pressure drop. In the illustrated embodiment, this information is indicative of a second known axial placement of the inner string 710 to the outer string 750.

The orientation port 220, in one or more embodiments, may also provide rotational alignment information. For example, the rotational position of orientation port 220 could provide a few advantages. First, if another downhole device (e.g., device including an inner string) has the orientation port 220 rotationally misaligned with the longitudinal orientation slot 630, then one of at least two scenarios exist: a) the rotational orientation of orientation port 220 is unimportant, and only the axial location of orientation port 220 is important (e.g., the observed pressure pulses as the orientation port 220 passes the first and second radial orientation slots 625*a*, 625*b*); b) the rotational orientation of the orientation port 220 is important, in which case two or more longitudinal orientation slots 630 are employed, such that if the orientation port 220 rotates to partially align with one of the longitudinal orientation slots 630 a pressure drop will indicate a mis-alignment.

Second, if another downhole device (e.g., muleshoe with muleshoe guide slot) has the orientation port 220 aligned with the orientation slot 630, then a pressure drop at the surface will be expected unless the orientation port 220 becomes mis-aligned from the orientation slot 630 and a pressure increase occurs. In this second situation, an additional orientation port 620 at another rotational orientation may be desirable. The additional orientation port would then provide a pressure pulse when it passes over the first and/or second radial orientation slots 625*a*, 625*b*.

Figure 7F:
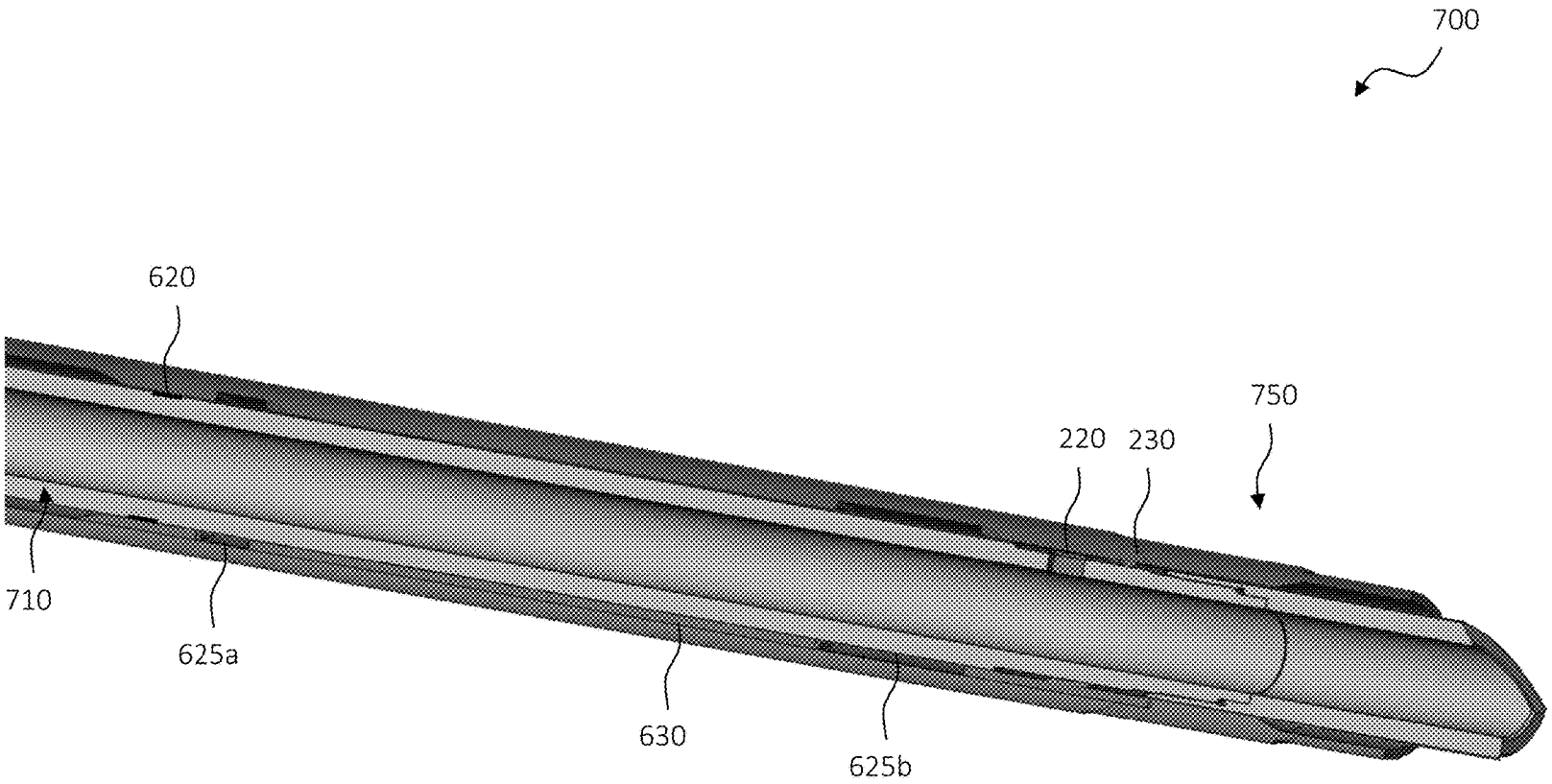

Turning to FIG. 7F, the inner string 710 continues to be insert within the outer string 750, including allowing an alignment key (not shown) to fully enter into the muleshoe guide slot (not shown) of the muleshoe (not shown). Given the knowledge provided by the pressure indication alignment system 700, the user may be confident that the inner string 710 is not within the dead zone.

Figure 8A:
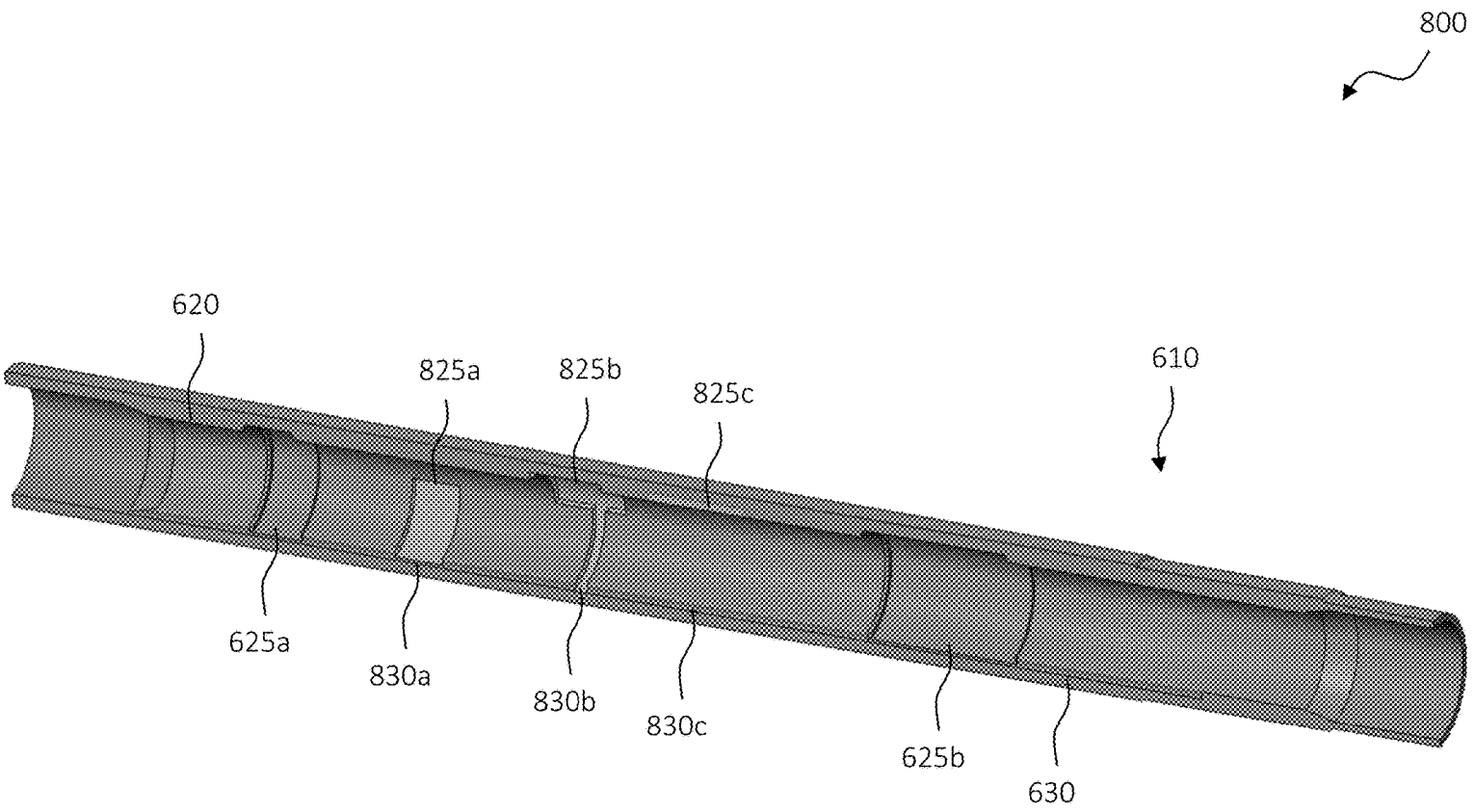
FIGS. 8A and 8B illustrate various different views of an alternative embodiment of an outer string designed, manufactured and/or operated according to one or more embodiments of the disclosure.
Figure 8B:
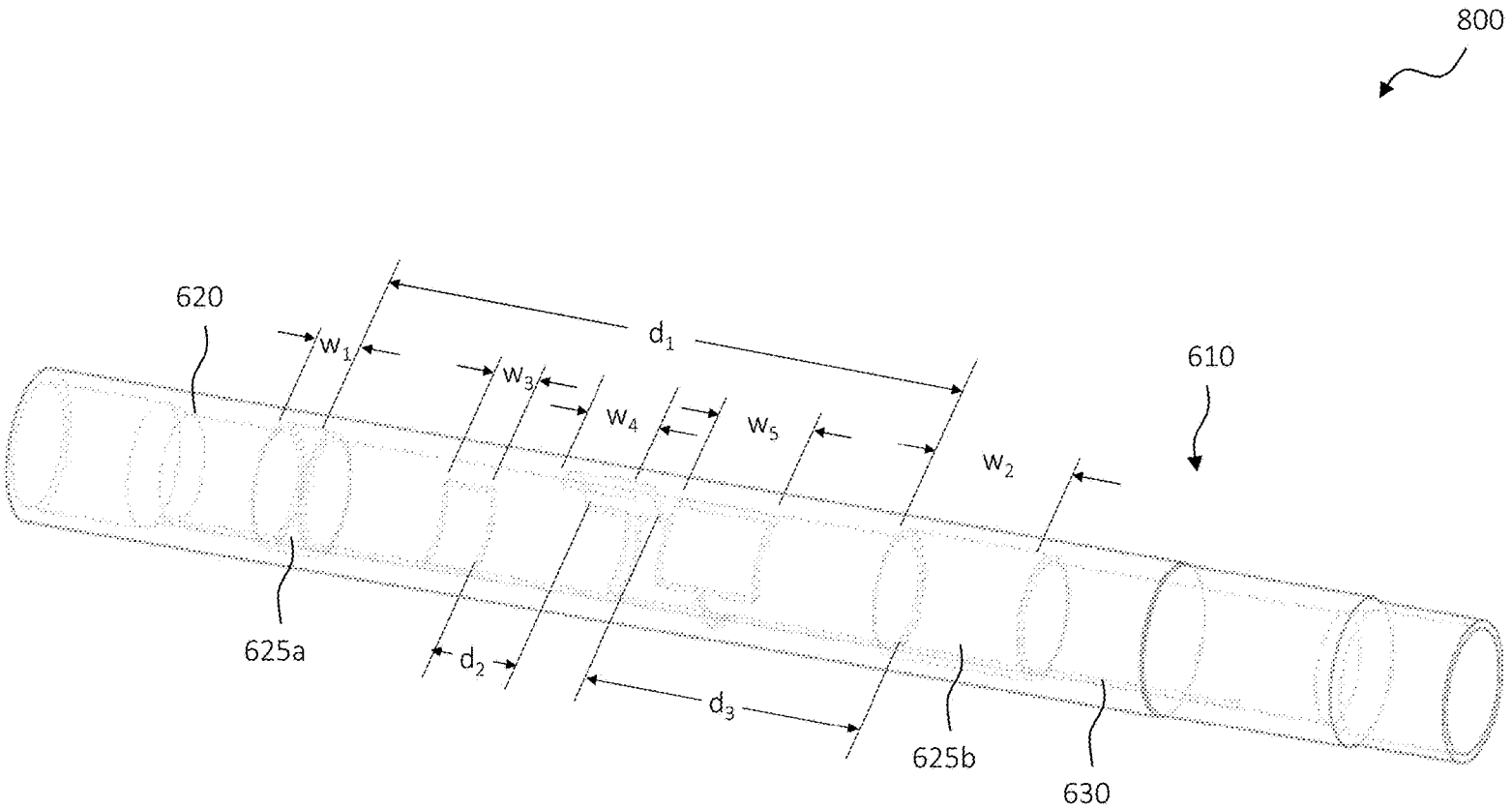
Figure 9A:
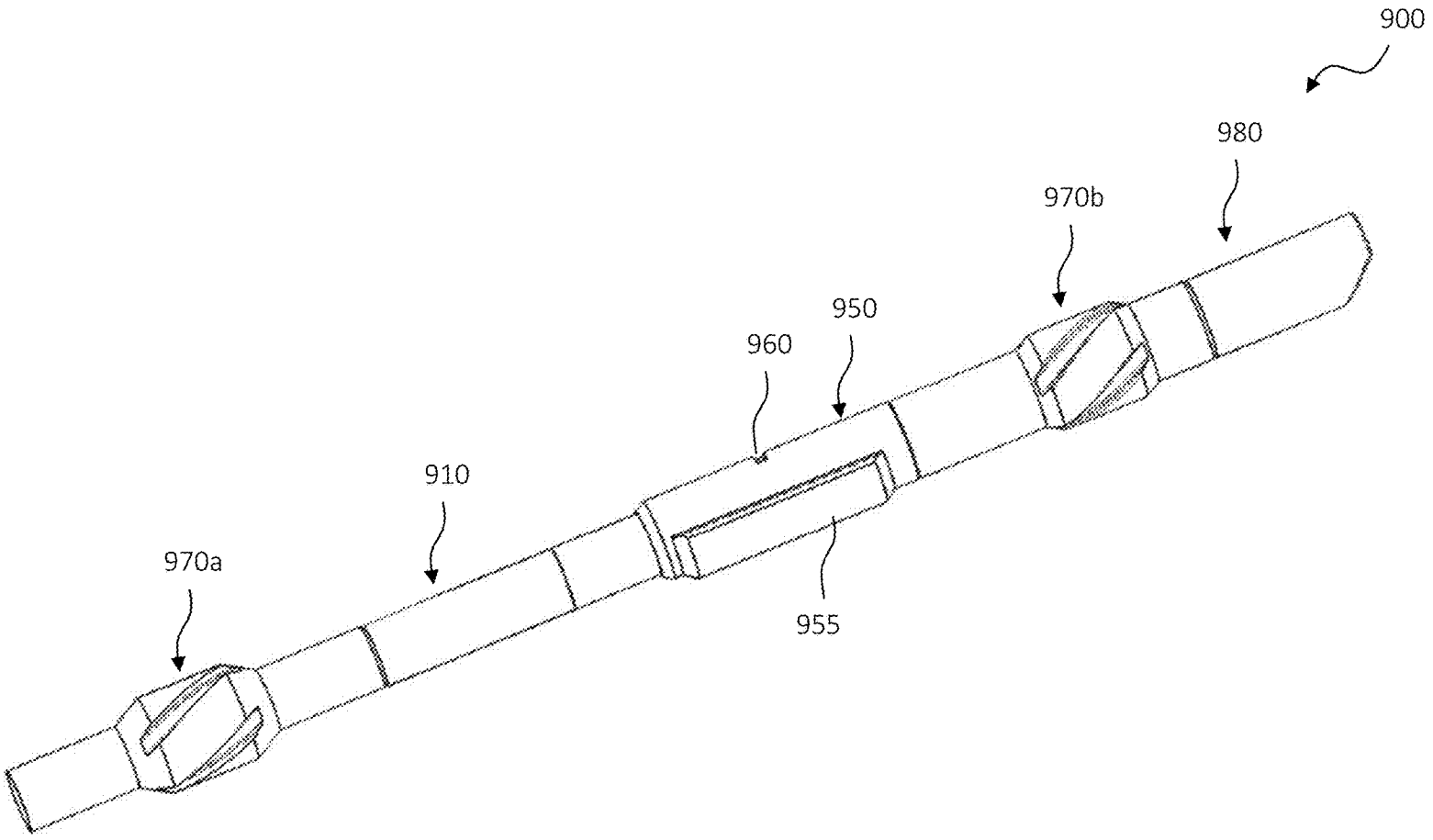
Figure 9B:
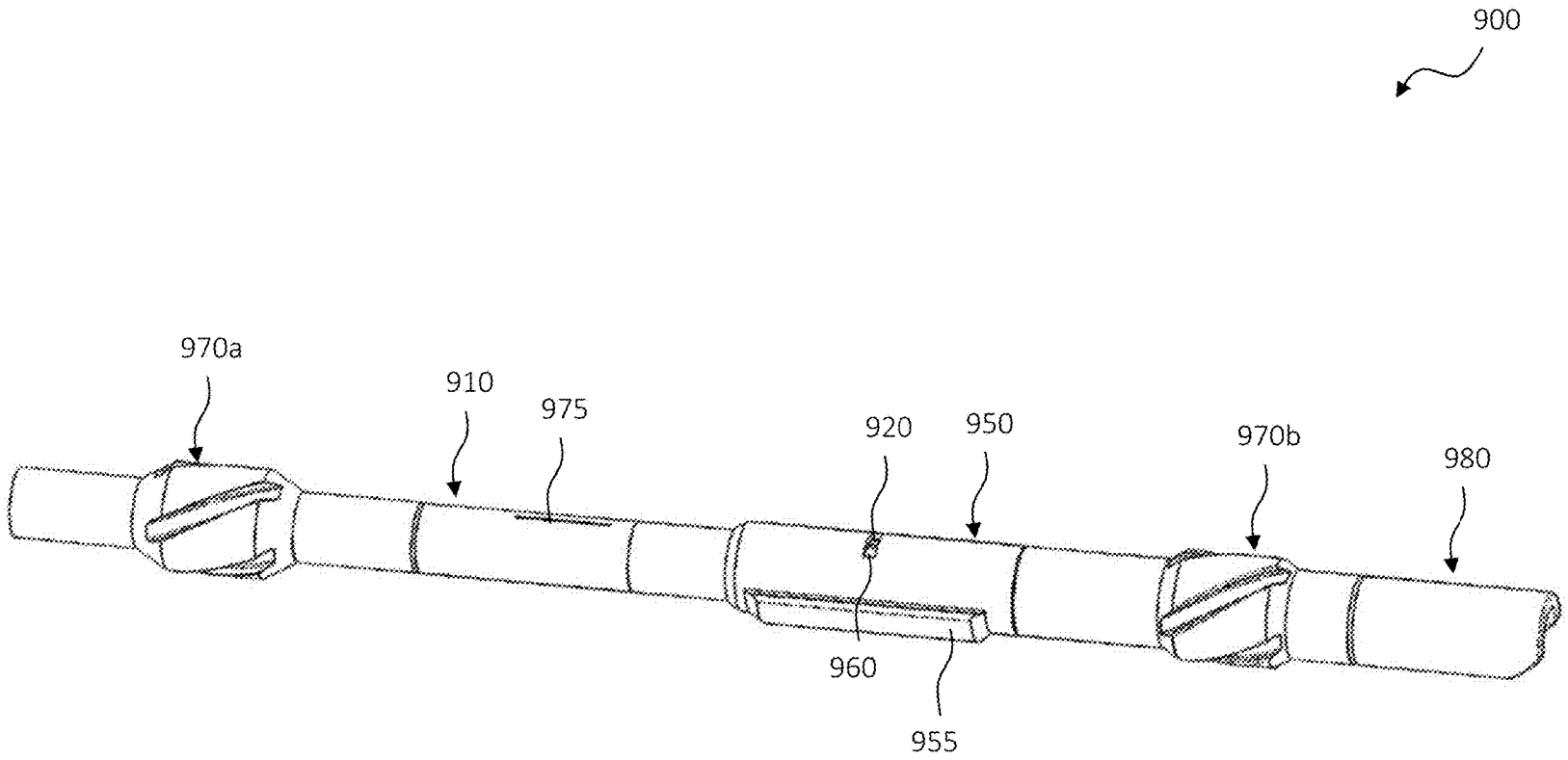
Figure 9C:
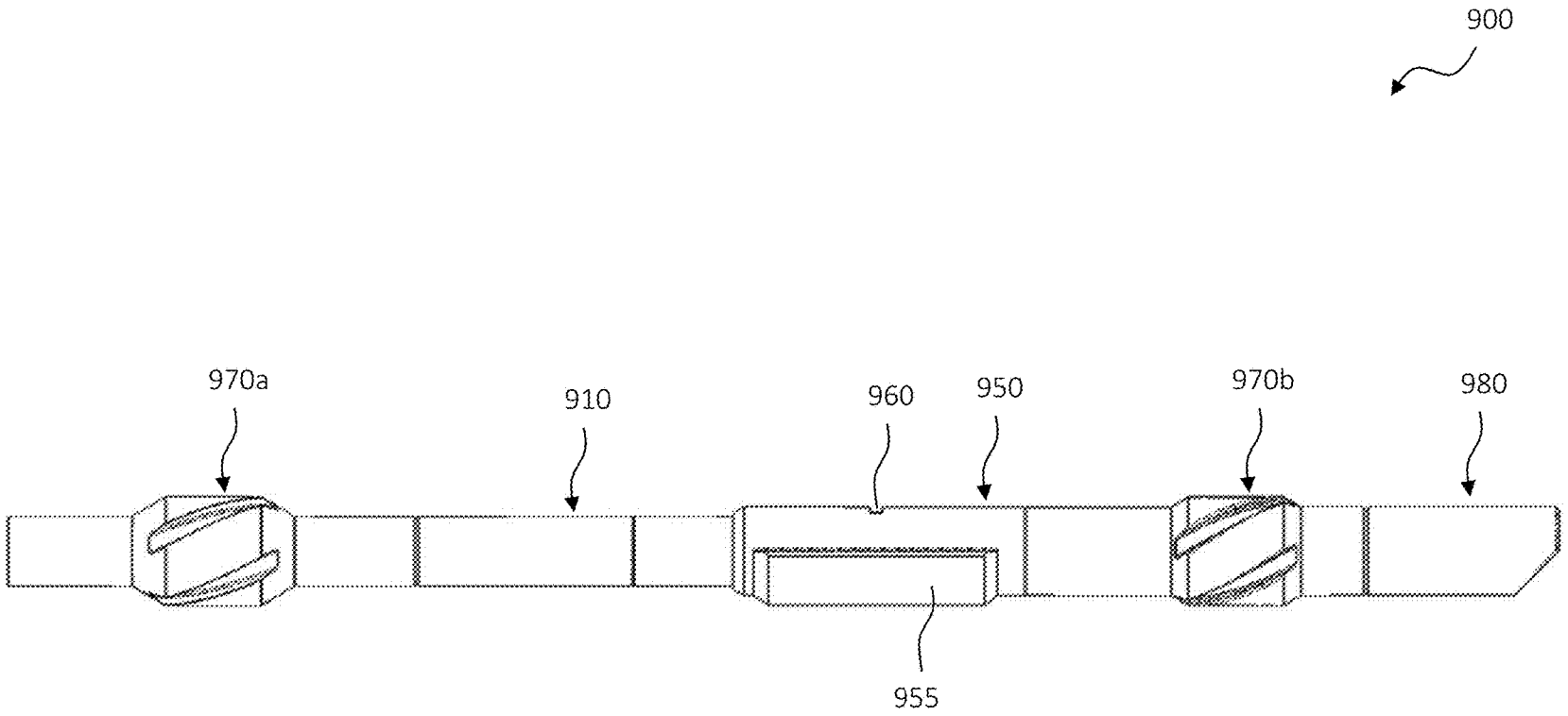
Figure 9D:
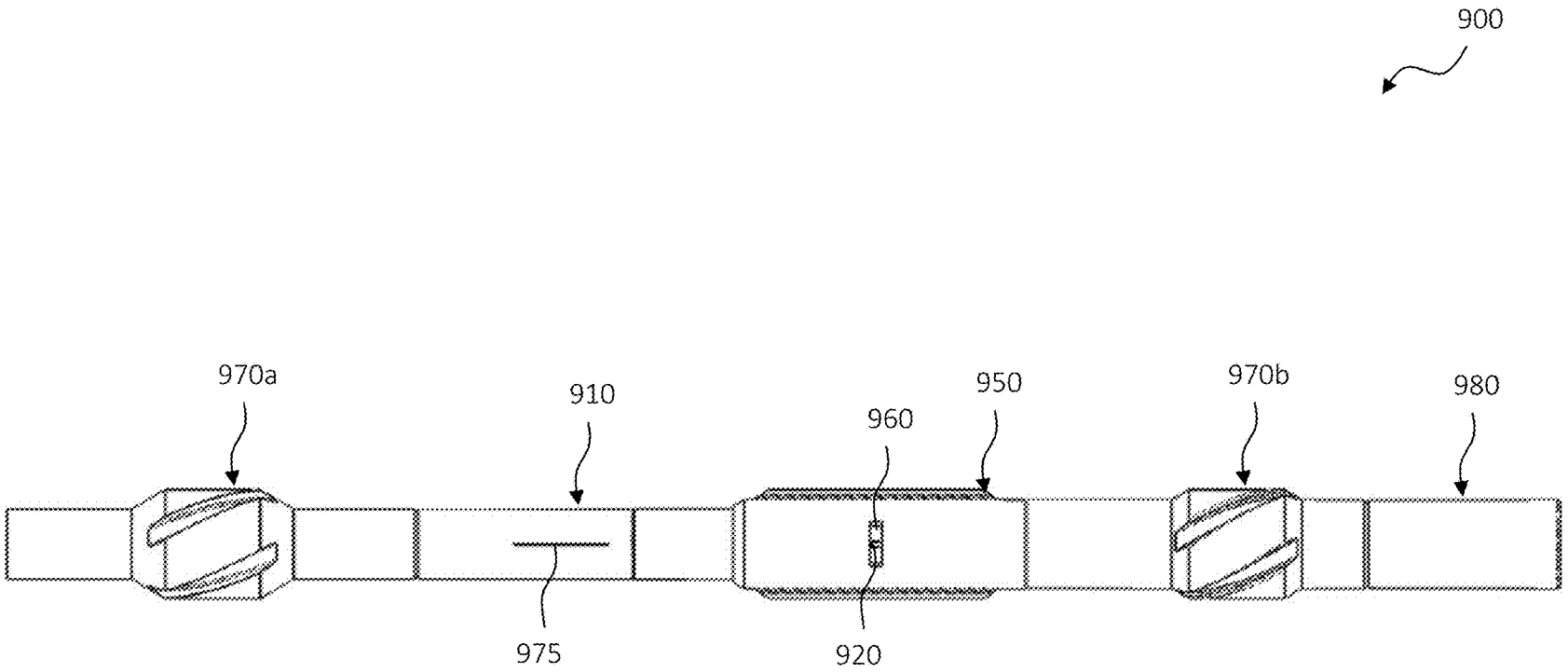
Figure 9E:
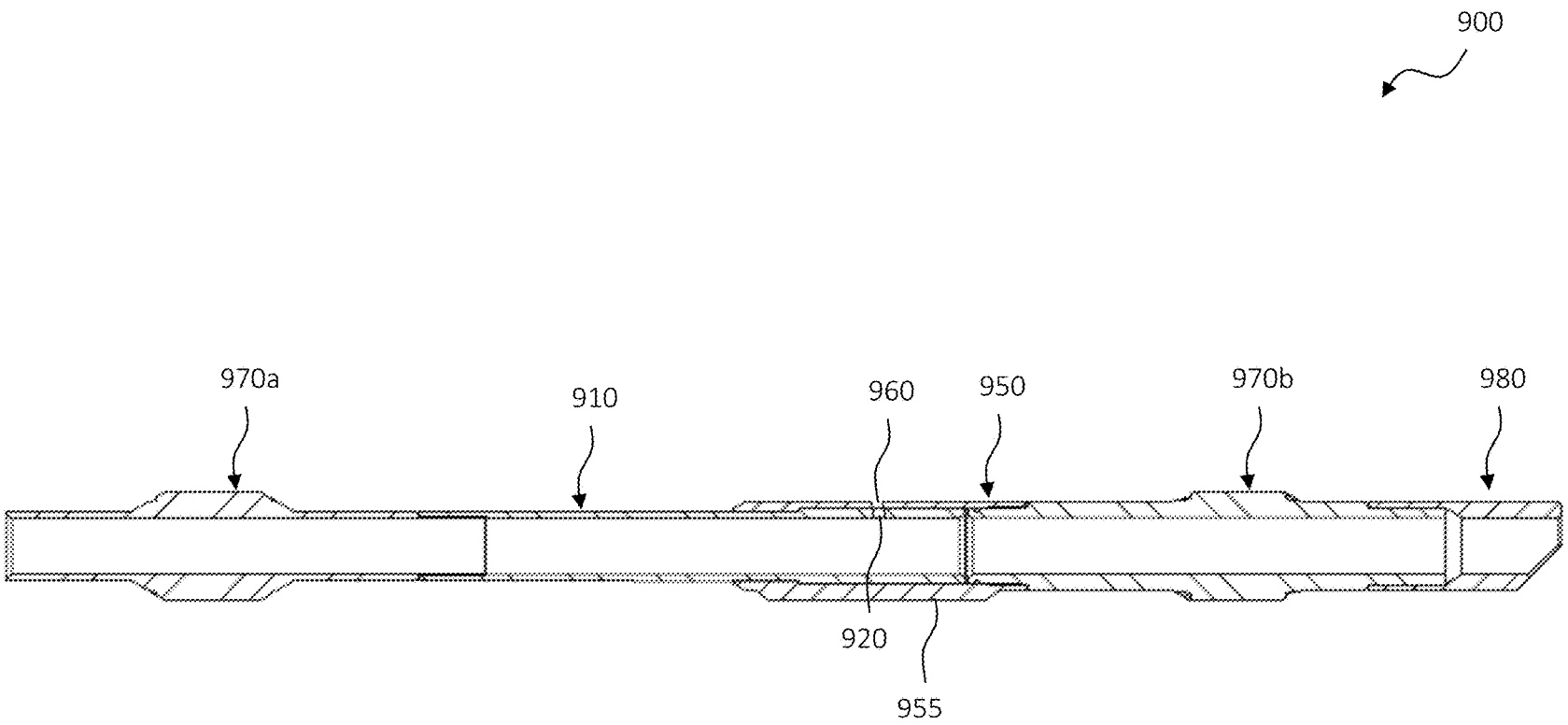

Turning to FIGS. 8A and 8B, illustrated are various different views of an alternative embodiment of an outer string 800 designed, manufactured and/or operated according to one or more embodiments of the disclosure. The outer string 800 is similar in many respects to the outer string 600 of FIG. 6A through 6C. Accordingly, like reference numbers have been used to indicated similar, if not identical, features. The outer string 800 differs, for the most part, from the outer string 600 in that the outer string 800 employs third radial orientation slot 825*a* (e.g., e.g., 3 to 6-o'clock opening), fourth radial orientation slot 825*b* (e.g., e.g., 12 to 3-o'clock opening) and fifth radial orientation slot 825*c* (e.g., e.g., 6 to 9-o'clock opening) that each extend less than 360 degrees around the inside surface of the outer tubular. For example, the third, fourth and fifth radial orientation slots 825*a*, 825*b*, 825*c* each extend 90 degrees or less around the inside surface of the outer tubular. In at least one embodiment, as shown, the third, fourth and fifth radial orientation slots 825*a*, 825*b*, 825*c* are radially offset from one another.

Further to the embodiment of FIGS. 8A and 8B, the third radial orientation slot 825*a* has a width ($w_3$), the fourth radial orientation slot 825*b* has a width ($w_4$) and the fifth radial orientation slot 825*c* has a width ($w_5$). In at least one embodiment, the fifth width ($w_5$) is greater than the fourth width (w4) which is greater than the third width (w3). Furthermore, the third radial orientation slot 825*a* is offset from the fourth radial orientation slot by a distance ($d_2$), and the fourth radial orientation slot is offset from the fifth radial orientation slot by a distance ($d_3$). Moreover, the third radial orientation slot 825*a* is uphole of the fourth radial orientation slot 825*b*, and the fourth radial orientation slot 825*b* is uphole of the fifth radial orientation slot 825*c*.

In the illustrated embodiment, a first tail section 830*a* couples the third radial orientation slot 825*a* and the longitudinal orientation slot 630, a second tail section 830*b* couples the fourth radial orientation slot 825*b* and the longitudinal orientation slot 630, and a third tail section 830*c* couples the fifth radial orientation slot 825*c* and the longitudinal orientation slot 630.

The third, fourth and fifth radial orientation slots 825*a*, 825*b*, 825*c* (e.g., ¼-radial orientation slots) will provide a pressure-drop signal when the orientation port is aligned with one of the third, fourth and fifth radial orientation slots 825*a*, 825*b*, 825*c*. For example, if the orientation port is aligned with the fifth radial orientation slot 825*c*, then a pressure-drop will occur. The fluid will exit the orientation port, pass through the fifth radial orientation slot 825*c* and then exit the related tail section leading to the longitudinal slot 630. In some embodiments, ⅛-radial orientation slots may be utilized to provide a pressure-indication at 45-degree increments. In one or more embodiments, other number, sizes, orientation of slots may be used to provide other pressure-indications of finer, coarser resolution (e.g., 5-degree or 180-degree). Furthermore, the third, fourth and fifth radial orientation slots 825*a*, 825*b*, 825*c*, in certain embodiments, may be used without the first and second radial orientation slots 625*a*, 625*b*. While the embodiments of FIGS. 6A through 8A discuss the use of a single orientation port (e.g., single orientation port 220), other embodiments may exist wherein multiple orientation ports (e.g., multiple orientation ports 220) may be used separately or in conjunction with the first, second, third, fourth, and fifth radial orientation slots 625*a*, 625*b*, 825*a*, 825*b*, 825*c*.

Turning to FIGS. 9A through 9E, illustrated are various different views of an alternative embodiment of an inner string 900 designed, manufactured and/or operated according to one or more embodiments of the disclosure. The inner string 900, in the illustrated embodiment, includes an inner tubular 910 including a sidewall having a thickness ($t_3$). In one or more embodiments, the inner tubular 910 has an orientation port 920 extending entirely through the sidewall to provide fluid access from an interior of the inner tubular 910 to an exterior of the inner tubular 910. The inner string 900 may additionally have one or more orientation seals (not shown). The one or more orientation seals may be similar to the one or more orientation seals 230 disclosed above.

The inner string 900 may additionally have a weighted swivel 950 located around the inner tubular 910. In at least one embodiment, the weighted swivel 950 includes an orientation slot 960. In accordance with one embodiment, the orientation slot 960 is configured to align with the orientation port 920 to provide a pressure reading indicative of a relative location of the inner tubular 910 to the weighted swivel 950. In at least one embodiment, the orientation slot 960 spans a radial angle ($\theta_2$) of at least 60 degrees. Nevertheless, other values for the radial angle ($\theta_2$) are within the scope of the disclosure.

In one or more embodiments, the weighted swivel 950 includes an eccentric weighted portion 955. In at least one embodiment, as shown, a radial centerpoint ($CP_{os}$) of the orientation slot 960 is radially misaligned by 180 degrees to a radial centerpoint ($CP_{wp}$) of the eccentric weighted portion 955.

The inner string 900 may additionally include a first centralizer 970*a* and a second centralizer 970*b* coupled to the weighted swivel 950. In at least one embodiment, the first centralizer 970*a* is a first uphole centralizer and the second centralizer 970*b* is a second downhole centralizer. The inner string 900 may additionally include an orientation reference 975 located along the exterior of the inner tubular 910 and not under the weighted swivel 950. In accordance with one embodiment, a radial centerpoint ($CP_{op}$) of the orientation port 920 is radially aligned with a radial centerpoint ($CP_{or}$) of the orientation reference 975. In at least one embodiment, the inner string 900 may further include a muleshoe 980.

While not shown in these views (but may be seen in FIG. 2), the inner string 900 may additionally include an alignment key extending radially outward from the inner tubular, and one or more production seals located along the exterior of the inner tubular, the one or more production seals positioned between the orientation port and the alignment key. The inner string 900 may additionally include a latch mechanism extending radially outward from the inner tubular, and a completion window coupled to the inner tubular, the completion window including a window opening configured to align with a lateral wellbore opening. In at least one embodiment, a radial centerpoint ($CP_{op}$) of the orientation port is radially aligned with a radial centerpoint ($CP_{wo}$) of the window opening.

Figure 10A:
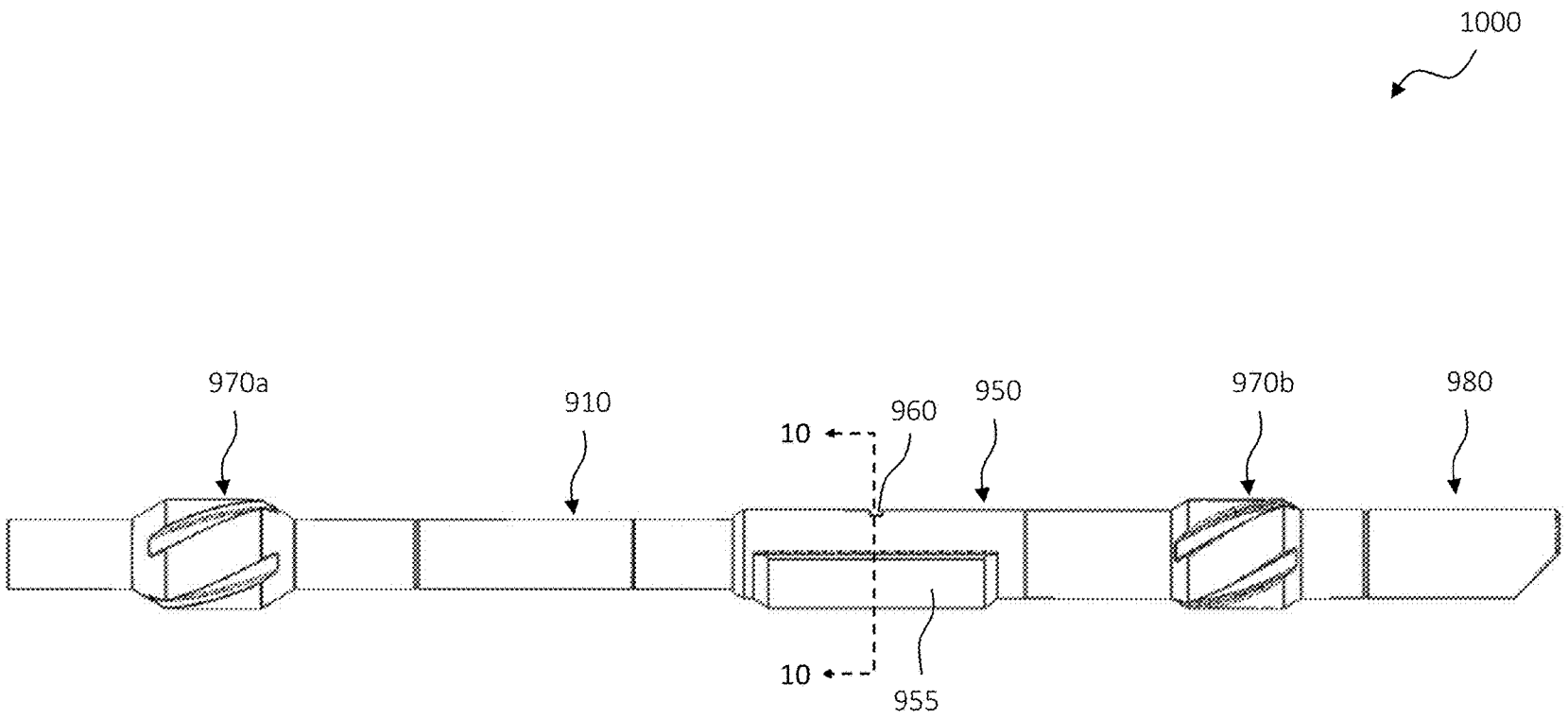

Turning to FIG. 10A, illustrated is an alternative embodiment of an inner string 1000 designed, manufactured and/or operated according to one or more embodiments of the disclosure. The inner string 1000 is similar in many respects to the inner string 900 of FIG. 9. Accordingly, like reference numbers have been used to indicate similar, if not identical features.

Figure 10D:
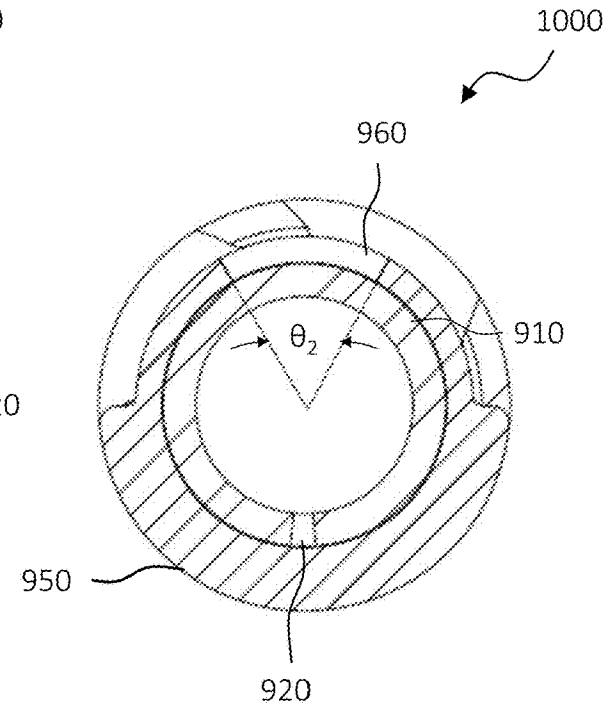
Figure 10C:
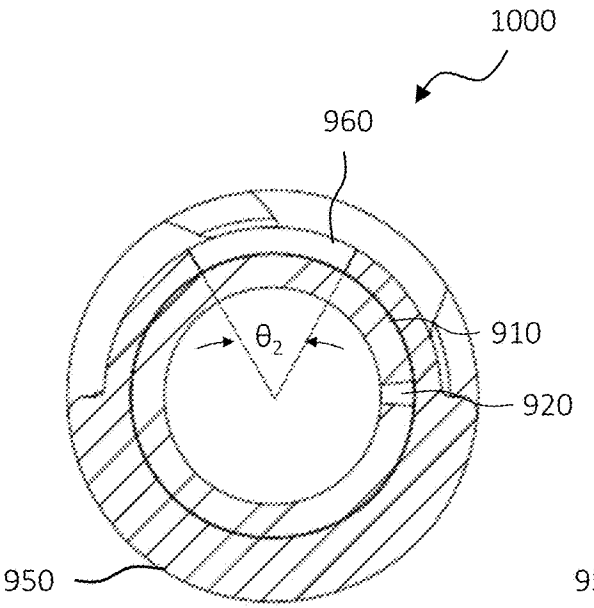
Figure 10B:
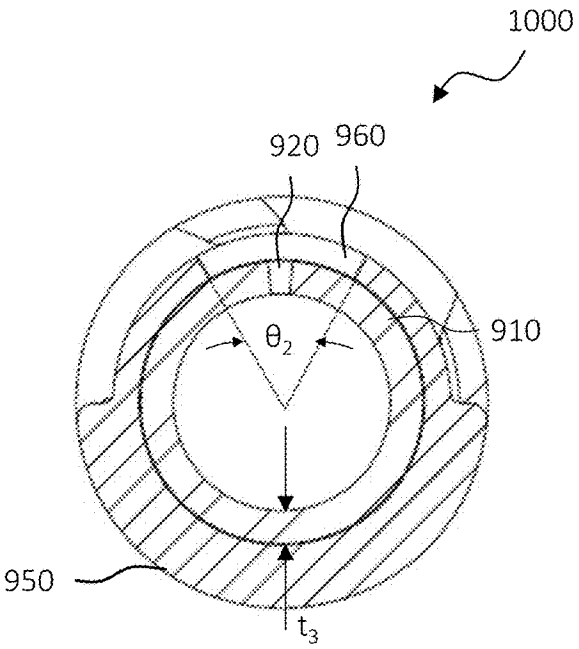

Turning to FIG. 10B, illustrated is one cross-sectional view of the inner string 1000 taken through the line 10-10. FIG. 10B illustrates what the inner string might look like if the orientation port 920 was oriented at 0 degrees from high side, and thus directly in the middle of the orientation slot 960. In this embodiment, fluid from the inner tubular 910 would exit through the orientation port 920 and the orientation slot 960 to the outside of the inner tubular 910. In at least one embodiment, the fluid would exit into an annulus between the inner string 1000 and an outer string (not shown) that radially surrounds the inner string 1000. In the illustrated embodiment, the orientation slot 960 spans a radial angle ($\theta_2$). In at least one embodiment, the radial angle ($\theta_2$) at least 60 degrees.

Turning to FIG. 10C, illustrated is one cross-sectional view of the inner string 1000 taken through the line 10-10. FIG. 10C illustrates what the inner string might look like if the orientation port 920 was oriented at 90 degrees from high side. In this embodiment, fluid from the inner tubular 910 would not be able to exit through the orientation port 920 and the orientation slot 960 to the outside of the inner tubular 910.

Turning to FIG. 10D, illustrated is one cross-sectional view of the inner string 1000 taken through the line 10-10. FIG. 10D illustrates what the inner string might look like if the orientation port 920 was oriented at 180 degrees from high side. In this embodiment, fluid from the inner tubular 910 would not be able to exit through the orientation port 920 and the orientation slot 960 to the outside of the inner tubular 910.

Figure 10F:
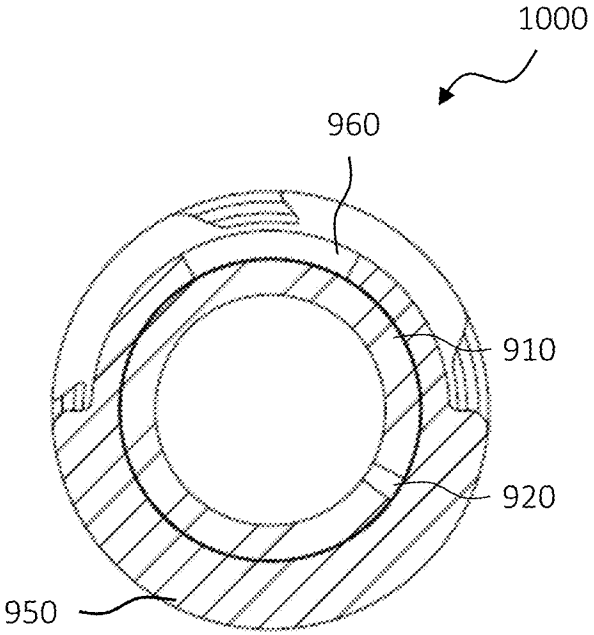
Figure 10E:
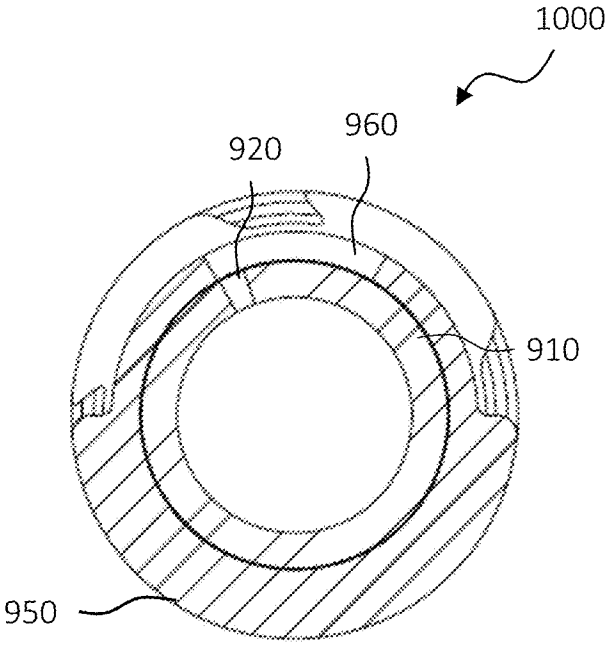

Turning to FIG. 10E, illustrated is one cross-sectional view of the inner string 1000 taken through the line 10-10. FIG. 10E illustrates what the inner string might look like if the orientation port 920 was oriented at +/−30 degrees from high side, which is a common orientation for multilateral windows. In this orientation, a pressure drop would be detectable, as the fluid could escape through the orientation port 920.

Turning to FIG. 10F, illustrated is one cross-sectional view of the inner string 1000 taken through the line 10-10. FIG. 10F illustrates what the inner string might look like if the orientation port 920 was oriented at +31 degrees from high side through 180 degrees from high side and to +269 degrees from high side. In this orientation, a pressure drop would not be detectable as the fluid could not escape through the orientation port 920.

While the above is a detailed discussion of one or more embodiments of the disclosure, other slots, ports, features, profiles, seals, etc. may be added to the disclosed embodiments. Moreover, other indications, including pressure-changing indications, may be provided. Other features may be added to provide other indications during the landing, orienting, locating, latching in, and/or manipulation of string (production strings, drill pipe string, work string, frac string, injection string, coiled tubing, control line pipe, intelligent strings and other conduits—round, circular, with/without one or more holes, D-shaped items such as D-Tubes, Double barrel tubes, etc.).

Aspects disclosed herein include:

A. An inner string, the inner string including: 1) an inner tubular configured to extend at least partially within a seal surface of an outer tubular, the inner tubular including a sidewall having a thickness ($t_1$); and 2) an orientation port extending entirely through the sidewall to provide fluid access from an interior of the inner tubular to an exterior of the inner tubular, the orientation port configured to align with an orientation slot in the outer tubular that it is configured to engage with to provide a pressure reading indicative of a relative location of the inner tubular to the outer tubular.

B. An outer string, the outer string including: 1) an outer tubular configured to extend at least partially around an inner tubular, the outer tubular including a seal surface; and 2) an orientation slot located along an inside surface of the outer tubular, the orientation slot configured to align with an orientation port in the inner tubular that it is configured to engage with to provide a pressure reading indicative of a relative location of the inner tubular to the outer tubular.

C. A well system, the well system including: 1) a wellbore extending through a subterranean formation; and 2) a pressure indication alignment system positioned within the wellbore, the pressure indication alignment system including: a) an outer string located in the wellbore, the outer string including: i) an outer tubular including a seal surface; and ii) an orientation slot located along an inside surface of the outer tubular; and b) an inner string located at least partially within the outer string, the inner string including: i) an inner tubular extending at least partially within the seal surface of the outer tubular, the inner tubular including a sidewall having a thickness ($t_1$); and ii) an orientation port extending entirely through the sidewall to provide fluid access from an interior of the inner tubular to an exterior of the inner tubular, the orientation port configured to align with the orientation slot in the outer tubular to provide a pressure reading indicative of a relative location of the inner tubular to the outer tubular.

D. An inner string, the inner string including: 1) an inner tubular configured to extend at least partially within a seal surface of an outer tubular, the inner tubular including a sidewall having a thickness ($t_2$); and 2) an orientation port extending entirely through the sidewall to provide fluid access from an interior of the inner tubular to an exterior of the inner tubular, the orientation port configured to align with two radial orientation slots in the outer tubular that it is configured to engage with to provide two pressure readings indicative of a relative location of the inner tubular to the outer tubular.

E. An outer string, the outer string including: 1) an outer tubular configured to extend at least partially around an inner tubular, the outer tubular including a seal surface; and 2) two radial orientation slots located along an inside surface of the outer tubular, the two radial orientation slots offset from one another by a distance ($d_1$), the two radial orientation slots configured to align with an orientation port in the inner tubular that it is configured to engage with to provide two pressure readings indicative of a relative location of the inner tubular to the outer tubular.

F. A well system, the well system including: 1) a wellbore extending through a subterranean formation; and 2) a pressure indication alignment system positioned within the wellbore, the pressure indication alignment system including: a) an outer string located in the wellbore, the outer string including: i) an outer tubular including a seal surface; and ii) two radial orientation slots located along an inside surface of the outer tubular, the two radial orientation slots offset from one another by a distance ($d_1$); and b) an inner string located at least partially within the outer string, the inner string including: i) an inner tubular extending at least partially within the seal surface of the outer tubular, the inner tubular including a sidewall having a thickness ($t_2$); and ii) an orientation port extending entirely through the sidewall to provide fluid access from an interior of the inner tubular to an exterior of the inner tubular, the orientation port configured to align with the two radial orientation slots in the outer tubular to provide two pressure readings indicative of a relative location of the inner tubular to the outer tubular.

G. An inner string, the inner string including: 1) an inner tubular including a sidewall having a thickness ($t_3$), the inner tubular having an orientation port extending entirely through the sidewall to provide fluid access from an interior of the inner tubular to an exterior of the inner tubular; and 2) a weighted swivel located around the inner tubular, the weighted swivel including an orientation slot, the orientation slot configured to align with the orientation port to provide a pressure reading indicative of a relative location of the inner tubular to the weighted swivel.

H. A well system, the well system including: 1) a wellbore extending through a subterranean formation; and 2) a pressure indication alignment system positioned within the wellbore, the pressure indication alignment system including: a) an outer string located in the wellbore, the outer string including an outer tubular; and b) an inner string located at least partially within the outer string, the inner string including: i) an inner tubular including a sidewall having a thickness ($t_3$), the inner tubular having an orientation port extending entirely through the sidewall to provide fluid access from an interior of the inner tubular to an exterior of the inner tubular; and ii) a weighted swivel located around the inner tubular, the weighted swivel including an orientation slot, the orientation slot configured to align with the orientation port to provide a pressure reading indicative of a relative location of the inner tubular to the outer tubular.

Aspects A, B, C, D, E, F, G, and H may have one or more of the following additional elements in combination: Element 1: further including one or more orientation seals located along the exterior of the inner tubular and surrounding the orientation port. Element 2: wherein the one or more orientation seals is a single orientation seal located along the exterior of the inner tubular and surrounding all sides of the orientation port. Element 3: wherein the orientation port is a polygon shaped orientation port. Element 4: further including an alignment key extending radially outward from the inner tubular. Element 5: further including one or more production seals located along the exterior of the inner tubular, the one or more production seals positioned between the orientation port and the alignment key. Element 6: further including a latch mechanism extending radially outward from the inner tubular. Element 7: wherein the inner tubular is a collection of separate tubulars coupled together. Element 8: further including a completion window coupled to the inner tubular, the completion window including a window opening configured to align with a lateral wellbore opening. Element 9: wherein a radial centerpoint ($CP_{op}$) of the orientation port is radially aligned with a radial centerpoint ($CP_{wo}$) of the window opening. Element 10: wherein the orientation slot is a longitudinal orientation slot. Element 11: wherein a length (l) of the longitudinal orientation slot is greater than a width (w) of the longitudinal orientation slot. Element 12: wherein the outer tubular includes an uphole end and a downhole end, and further wherein the orientation slot is positioned between the downhole end and the seal surface. Element 13: wherein the outer tubular further includes a latch profile along the inside surface, the latch profile positioned between the uphole end and the seal surface. Element 14: wherein the outer tubular forms at least a portion of a liner hanger. Element 15: wherein the liner hanger includes a muleshoe with a muleshoe guide slot proximate the uphole end thereof. Element 16: wherein a radial centerpoint ($CP_{os}$) of the orientation slot is radially misaligned with a radial centerpoint ($CP_{gs}$) of the muleshoe guide slot. Element 17: wherein the radial centerpoint ($CP_{os}$) of the orientation slot is radially misaligned by 180 degrees relative to the radial centerpoint ($CP_{gs}$) of the muleshoe guide slot. Element 18: wherein the orientation port is axially and rotationally aligned with the orientation slot, the axial and rotational alignment configured to provide a pressure drop indicative of the relative location of the inner tubular to the outer tubular. Element 19: wherein the axial and rotational alignment is configured to provide a pressure drop indicative of an acceptable rotational placement of the inner tubular to the outer tubular. Element 20: wherein the axial and rotational alignment is configured to provide a pressure drop indicative of an unacceptable rotational placement of the inner tubular to the outer tubular. Element 21: wherein the orientation port is axially aligned and rotationally misaligned with the orientation slot, the axial alignment and rotational misalignment configured to provide the pressure reading indicative of the relative location of the inner tubular to the outer tubular. Element 22: wherein the axial alignment and rotational misalignment is configured to provide a pressure reading indicative of an acceptable rotational placement of the inner tubular to the outer tubular. Element 23: wherein the axial alignment and rotational misalignment is configured to provide a pressure reading indicative of an unacceptable rotational placement of the inner tubular to the outer tubular. Element 24: wherein the outer tubular forms at least a portion of a liner hanger. Element 25: wherein the liner hanger includes a muleshoe with a muleshoe guide slot proximate an uphole end thereof, the muleshoe guide slot configured to engage with an alignment key extending radially outward from the inner tubular. Element 26: wherein a radial centerpoint ($CP_{os}$) of the orientation slot is radially misaligned with a radial centerpoint ($CP_{gs}$) of the muleshoe guide slot. Element 27: wherein the radial centerpoint ($CP_{os}$) of the orientation slot is radially misaligned by 180 degrees relative to the radial centerpoint ($CP_{gs}$) of the muleshoe guide slot. Element 28: wherein a first of the two radial orientation slots has a first width ($w_1$) and a second of the two radial orientation slots has a second width ($w_2$), the first radial orientation slot being uphole of the second radial orientation slot, and further wherein the second width ($w_2$) is greater than the first width ($w_1$). Element 29: wherein the second width ($w_2$) is at least 3 times the first width ($w_1$). Element 30: wherein the distance ($d_1$) is at least 4 times the second width ($w_2$). Element 31: further including a third, fourth and fifth radial orientation slots located along the inside surface of the outer tubular, the third radial orientation slot having a width ($w_3$) and offset from the fourth radial orientation slot by a distance ($d_2$), the fourth radial orientation slot offset having a width ($w_4$) and offset from the fifth radial orientation slot by a distance ($d_3$), and the fifth radial orientation slot having a width ($w_5$), the third and fourth radial orientation slots being uphole of the fifth radial orientation slot, and further wherein the fifth width ($w_5$) is greater than the fourth width (w4) which is greater than the third width (w3). Element 32: wherein the third, fourth and fifth radial orientation slots each extend less than 360 degrees around the inside surface of the outer tubular. Element 33: wherein the third, fourth and fifth radial orientation slots each extend 90 degrees or less around the inside surface of the outer tubular. Element 34: wherein the third, fourth and fifth radial orientation slots are radially offset from one another. Element 35: wherein the first and second radial orientation slots each extend less than 360 degrees around the inside surface of the outer tubular. Element 36: wherein the wherein the first and second radial orientation slots each extend 90 degrees or less around the inside surface of the outer tubular. Element 37: further including a longitudinal orientation slot located along the inside surface of the outer tubular. Element 38: further including a first tail section coupling the first radial orientation slot and the longitudinal orientation slot and a second tail section coupling the second radial orientation slot and the longitudinal orientation slot. Element 39: wherein the first and second radial orientation slots each extend 360 degrees around the inside surface of the outer tubular. Element 40: wherein the orientation port is axially and rotationally aligned with the first radial orientation slot, the axial and rotational alignment with the first radial orientation slot configured to provide a first pressure drop indicative of the relative location of the inner tubular to the outer tubular. Element 41: wherein the orientation port is axially and rotationally aligned with the second radial orientation slot, the axial and rotational alignment with the second radial orientation slot configured to provide a second greater pressure drop indicative of the relative location of the inner tubular to the outer tubular. Element 42: further including a centralizer coupled to the inner tubular. Element 43: wherein the centralizer is a first centralizer and further including a second centralizer coupled to the weighted swivel. Element 44: wherein the first centralizer is a first uphole centralizer and the second centralizer is a second downhole centralizer. Element 45: further including an orientation reference located along the exterior of the inner tubular and not under the weighted swivel. Element 46: wherein a radial centerpoint ($CP_{op}$) of the orientation port is radially aligned with a radial centerpoint ($CP_{or}$) of the orientation reference. Element 47: wherein the orientation slot spans a radial angle ($\theta_2$) of at least 60 degrees. Element 48: wherein the weighted swivel includes an eccentric weighted portion. Element 49: wherein a radial centerpoint ($CP_{os}$) of the orientation slot is radially misaligned by 180 degrees to a radial centerpoint ($CP_{wp}$) of the eccentric weighted portion. Element 50: further including an alignment key extending radially outward from the inner tubular. Element 51: further including one or more production seals located along the exterior of the inner tubular, the one or more production seals positioned between the orientation port and the alignment key. Element 52: further including a latch mechanism extending radially outward from the inner tubular. Element 53: wherein the inner tubular is a collection of separate tubulars coupled together. Element 54: further including a completion window coupled to the inner tubular, the completion window including a window opening configured to align with a lateral wellbore opening. Element 55: wherein a radial centerpoint ($CP_{op}$) of the orientation port is radially aligned with a radial centerpoint ($CP_{wo}$) of the window opening. Element 56: wherein the orientation port is rotationally aligned with the orientation slot, the rotational alignment configured to provide a pressure drop indicative of the relative location of the inner tubular to the weighted swivel. Element 57: wherein the rotational alignment is configured to provide a pressure drop indicative of an acceptable rotational placement of the inner tubular to the weighted swivel. Element 58: wherein the rotational alignment is configured to provide a pressure drop indicative of an unacceptable rotational placement of the inner tubular to the weighted swivel. Element 59: wherein the orientation port is rotationally misaligned with the orientation slot, the rotational misalignment configured to provide the pressure reading indicative of the relative location of the inner tubular to the weighted swivel. Element 60: wherein the rotational misalignment is configured to provide a pressure reading indicative of an acceptable rotational placement of the inner tubular to the weighted swivel. Element 61: wherein the rotational misalignment is configured to provide a pressure reading indicative of an unacceptable rotational placement of the inner tubular to the weighted swivel.

Those skilled in the art to which this application relates will appreciate that other and further additions, deletions, substitutions, and modifications may be made to the described embodiments.

What is claimed is:

1. An inner string, comprising:

an inner tubular including a sidewall having a thickness ($t_3$), the inner tubular having an orientation port extending entirely through the sidewall to provide fluid access from an interior of the inner tubular to an exterior of the inner tubular; and a weighted swivel located around the inner tubular, the weighted swivel configured to rotate relative to the inner tubular but not axially slide relative to the inner tubular, the weighted swivel including an orientation slot, the orientation slot configured to align with the orientation port to provide a pressure reading indicative of a relative location of the inner tubular to the weighted swivel.

2. The inner string as recited in claim 1, further including one or more orientation seals located along the exterior of the inner tubular and surrounding the orientation port.

3. The inner string as recited in claim 2, wherein the one or more orientation seals is a single orientation seal located along the exterior of the inner tubular and surrounding all sides of the orientation port.

4. The inner string as recited in claim 1, further including a centralizer coupled to the inner tubular.

5. The inner string as recited in claim 4, wherein the centralizer is a first centralizer and further including a second centralizer coupled to the weighted swivel.

6. The inner string as recited in claim 5, wherein the first centralizer is a first uphole centralizer and the second centralizer is a second downhole centralizer.

7. The inner string as recited in claim 1, further including an orientation reference located along the exterior of the inner tubular and not under the weighted swivel.

8. The inner string as recited in claim 7, wherein a radial centerpoint ($CP_{op}$) of the orientation port is radially aligned with a radial centerpoint ($CP_{or}$) of the orientation reference.

9. The inner string as recited in claim 1, wherein the orientation slot spans a radial angle (02) of at least 60 degrees.

10. The inner string as recited in claim 1, wherein the weighted swivel includes an eccentric weighted portion.

11. The inner string as recited in claim 10, wherein a radial centerpoint ($CP_{os}$) of the orientation slot is radially misaligned by 180 degrees to a radial centerpoint ($CP_{wp}$) of the eccentric weighted portion.

12. The inner string as recited in claim 1, further including an alignment key extending radially outward from the inner tubular.

13. The inner string as recited in claim 12, further including one or more production seals located along the exterior of the inner tubular, the one or more production seals positioned between the orientation port and the alignment key.

14. The inner string as recited in claim 12, further including a latch mechanism extending radially outward from the inner tubular.

15. The inner string as recited in claim 12, wherein the inner tubular is a collection of separate tubulars coupled together.

16. The inner string as recited in claim 1, further including a completion window coupled to the inner tubular, the completion window including a window opening configured to align with a lateral wellbore opening.

17. The inner string as recited in claim 16, wherein a radial centerpoint ($CP_{op}$) of the orientation port is radially aligned with a radial centerpoint ($CP_{wo}$) of the window opening.

18. A well system, comprising:

a wellbore extending through a subterranean formation; and a pressure indication alignment system positioned within the wellbore, the pressure indication alignment system including:

an outer string located in the wellbore, the outer string including an outer tubular; and an inner string located at least partially within the outer string, the inner string including:

an inner tubular including a sidewall having a thickness ($t_3$), the inner tubular having an orientation port extending entirely through the sidewall to provide fluid access from an interior of the inner tubular to an exterior of the inner tubular; and a weighted swivel located around the inner tubular, the weighted swivel configured to rotate relative to the inner tubular but not axially slide relative to the inner tubular, the weighted swivel including an orientation slot, the orientation slot configured to align with the orientation port to provide a pressure reading indicative of a relative location of the inner tubular to the outer tubular.

19. The well system as recited in claim 18, wherein the orientation port is rotationally aligned with the orientation slot, the rotational alignment configured to provide a pressure drop indicative of the relative location of the inner tubular to the weighted swivel.

20. The well system as recited in claim 19, wherein the rotational alignment is configured to provide a pressure drop indicative of an acceptable rotational placement of the inner tubular to the weighted swivel.

21. The well system as recited in claim 19, wherein the rotational alignment is configured to provide a pressure drop indicative of an unacceptable rotational placement of the inner tubular to the weighted swivel.

22. The well system as recited in claim 18, wherein the orientation port is rotationally misaligned with the orientation slot, the rotational misalignment configured to provide the pressure reading indicative of the relative location of the inner tubular to the weighted swivel.

23. The well system as recited in claim 22, wherein the rotational misalignment is configured to provide a pressure reading indicative of an acceptable rotational placement of the inner tubular to the weighted swivel.

24. The well system as recited in claim 22, wherein the rotational misalignment is configured to provide a pressure reading indicative of an unacceptable rotational placement of the inner tubular to the weighted swivel.

25. The well system as recited in claim 18, further including one or more orientation seals located along the exterior of the inner tubular and surrounding the orientation port.

26. The well system as recited in claim 25, wherein the one or more orientation seals is a single orientation seal located along the exterior of the inner tubular and surrounding all sides of the orientation port.

27. The well system as recited in claim 18, further including a centralizer coupled to the inner tubular.

28. The well system as recited in claim 27, wherein the centralizer is a first centralizer and further including a second centralizer coupled to the weighted swivel.

29. The well system as recited in claim 28, wherein the first centralizer is a first uphole centralizer and the second centralizer is a second downhole centralizer.

30. The well system as recited in claim 18, further including an orientation reference located along the exterior of the inner tubular and not under the weighted swivel.

31. The well system as recited in claim 30, wherein a radial centerpoint ($CP_{op}$) of the orientation port is radially aligned with a radial centerpoint ($CP_{or}$) of the orientation reference.

32. The well system as recited in claim 18, wherein the orientation slot spans a radial angle ($\theta_2$) of at least 60 degrees.

33. The well system as recited in claim 18, wherein the weighted swivel includes an eccentric weighted portion.

34. The well system as recited in claim 33, wherein a radial centerpoint ($CP_{os}$) of the orientation slot is radially misaligned by 180 degrees to a radial centerpoint ($CP_{wp}$) of the eccentric weighted portion.

35. The well system as recited in claim 18, further including an alignment key extending radially outward from the inner tubular.

36. The well system as recited in claim 35, further including one or more production seals located along the exterior of the inner tubular, the one or more production seals positioned between the orientation port and the alignment key.

37. The well system as recited in claim 35, further including a latch mechanism extending radially outward from the inner tubular.

38. The well system as recited in claim 35, wherein the inner tubular is a collection of separate tubulars coupled together.

39. The well system as recited in claim 18, further including a completion window coupled to the inner tubular, the completion window including a window opening configured to align with a lateral wellbore opening.

40. The well system as recited in claim 39, wherein a radial centerpoint ($CP_{op}$) of the orientation port is radially aligned with a radial centerpoint ($CP_{wo}$) of the window opening.

* * * * *